US005442431A

United States Patent [19]

Fujimoto et al.

[11] Patent Number: 5,442,431

[45] Date of Patent: Aug. 15, 1995

[54] AUTOMATIC ORIGINAL FEEDING APPARATUS OF ORIGINAL SIDE-BY-SIDE MOUNT TYPE

[75] Inventors: Hitoshi Fujimoto, Kawasaki; Akimaro Yoshida, Yokohama; Norifumi Miyake, Kawasaki; Satoshi Choho, Tokyo, all of Japan

[73] Assignee: Canon Kabushiki Kaisha, Tokyo, Japan

[21] Appl. No.: 336,755

[22] Filed: Nov. 8, 1994

Related U.S. Application Data

[63] Continuation of Ser. No. 192,302, Feb. 4, 1994, abandoned, which is a continuation of Ser. No. 50,566, Apr. 21, 1993, abandoned.

[30] Foreign Application Priority Data

Apr. 22, 1992 [JP] Japan ..... 4-130225
Jun. 15, 1992 [JP] Japan ..... 4-181853

[51] Int. Cl.[6] ..... G03G 21/00; G03G 15/00

[52] U.S. Cl. ..... 355/311; 355/50; 271/202; 271/270

[58] Field of Search ..... 355/311, 309, 50; 271/202, 270, 3

[56] References Cited

U.S. PATENT DOCUMENTS

| | | | |
|---|---|---|---|
| 4,660,957 | 4/1987 | Ueda et al. . | |
| 4,731,637 | 3/1988 | Acquaviva et al. . | |
| 4,934,683 | 6/1990 | Ueda et al. | 271/3.1 |
| 4,935,775 | 6/1990 | Ueda et al. | 355/202 |
| 4,937,634 | 6/1990 | Hirabayashi et al. | 271/270 |
| 5,018,716 | 5/1991 | Yoshida et al. | 271/227 |
| 5,105,225 | 4/1992 | Honjo et al. | 355/233 |
| 5,119,145 | 6/1992 | Honjo et al. | 355/311 X |
| 5,124,758 | 6/1992 | Hamakawa | 355/311 |
| 5,132,741 | 7/1992 | Kitajima et al. | 355/311 X |
| 5,181,705 | 1/1993 | Ueda et al. | 271/3 |

FOREIGN PATENT DOCUMENTS

| | | |
|---|---|---|
| 2604266 | 9/1987 | France . |
| 60-2942 | 1/1985 | Japan . |
| 60-84945 | 5/1985 | Japan . |
| 60-93462 | 5/1985 | Japan . |
| 62-55667 | 3/1987 | Japan . |
| 62-125626 | 6/1987 | Japan . |

OTHER PUBLICATIONS

Abstract of Japanese Patent Document 03-174553 Published Jul. 29, 1991.

*Primary Examiner*—R. L. Moses
*Attorney, Agent, or Firm*—Fitzpatrick, Cella, Harper & Scinto

[57] ABSTRACT

The present invention provides an automatic original feeding apparatus comprising first rotary supply means for supplying a sheet original, second rotary supply means disposed at a downstream side of the first supply means to supply the sheet original, control means for rotating the second rotary supply means reversely to return the sheet original toward an upstream side by a small amount, retract means for directing a trailing end of the returned sheet original out of a sheet path connecting between the first and second rotary supply means, controlling means for controlling the first rotary supply means to cause the first rotary supply means to feed a next sheet original until a leading end of the next sheet original is overlapped with the trailing end of the first sheet original, information means for the kind of sheet originals, and means for changing a return amount of the sheet original effected by the controlling means, in accordance with the kind of the sheet original from the information means.

13 Claims, 45 Drawing Sheets

| FIG. 27A |
| --- |
| FIG. 27B |

| |
|---|
| FIG. 38A |
| FIG. 38B |

AUTOMATIC ORIGINAL FEEDING APPARATUS OF ORIGINAL SIDE-BY-SIDE MOUNT TYPE

This application is a continuation of application Ser. No. 08/192,302, filed Feb. 4, 1994, now abandoned, which is a continuation of application Ser. No. 08/050,566, filed Apr. 21, 1993, now abandoned.

BACKGROUND OF THE INVENTION

1. Field of the Invention

The present invention relates to an automatic original feeding apparatus of original side-by-side mount type and an image forming apparatus having such an original feeding apparatus. More particularly, it relates to an automatic original feeding apparatus (ADF apparatus) wherein originals rested on an original support are separated one by one and are fed to an image reading portion (platen) so that a plurality of (normally two) originals are mounted or set on the platen side by side, and an image forming apparatus having such an ADF apparatus wherein the originals are read and an image corresponding to plural originals is formed on a single copy sheet.

Incidentally, the original side-by-side mount type may include the type wherein the originals are set on the platen side by side and then are read or the type wherein the originals are read while two originals are being passed through the platen successively.

2. Related Background Art

Some automatic original feeding apparatuses incorporated into image forming apparatuses such as copying machines are so designed that continuous or successive supply control (referred to as "two in one (2 in 1) control" hereinafter) for feeding originals rested on an original support of an image reading portion of the image forming apparatus two by two continuously can be effected in order to read two originals simultaneously at the image reading portion.

In this two in one control, as disclosed in the Japanese Patent Application Laid-Open No. 3-174553 (corresponding to U.S. Ser. No. 118,825), in order to reduce a distance between two originals set on the image reading portion of the image forming apparatus, during the feeding of the originals, a trailing end of a first original is slightly overlapped with a leading end of a next or second original. By setting a feeding speed of a first feeding means for feeding the first original faster than a feeding speed of a second feeding means for feeding the second original, the overlapping relation is cancelled until or immediately before the second original reaches the first feeding means, thereby feeding the first and second originals to the reading portion by the first feeding means.

According to the above-mentioned technique, although two originals can easily be set on the reading portion so as to make the distance between the originals zero, it is feared that the nipping operation of the feeding means for nipping the original becomes inconvenient.

That is to say, in order to overlap the originals, the first original must be stopped in a condition that the trailing end of the first original is slightly protruded toward an upstream side of the feeding means and then the leading end of the second original must be entered below the protruded end of the first original. In this case, there is provided an escaping recessed portion for the protruded trailing end of the first original in order to prevent the collision between the leading end of the second original and the trailing end of the first original. Because of the presence of the escaping recessed portion, when the original is first fed to the feeding means, it is feared that the leading end of the original is not directed to the feeding means satisfactorily.

SUMMARY OF THE INVENTION

The present invention aims to eliminate the above-mentioned conventional drawback, and an object of the present invention is to provide an automatic original feeding apparatus wherein a distance or interval between a first original and a second original is maintained properly.

Another object of the present invention is to always keep a distance between originals constant regardless of the kind of originals.

In order to achieve the above object, an automatic original feeding apparatus according to the present invention is characterized in that, after a first original is fed by a predetermined amount, the first original is returned back in a reverse direction and is stopped there, and then a leading end of a second original is overlapped with a trailing end of the returned first original.

In order to achieve the above object, an automatic original feeding apparatus according to the present invention is characterized in that a return amount of the first original for adjusting the interval between the originals can be varied in accordance with the kind of originals.

According to the above-mentioned features of the present invention, since the trailing end of the first original can be protruded by returning the first original, it is possible to provide an escaping portion for the trailing end of the first original at a location where a feed path for the second original is not affected.

Further, since the return amount of the first original is varied in accordance with the kind of originals on the basis of the original kind of information, the interval between the first and second originals is always kept constant regardless of the kind of the originals, thereby preventing the original interval from increasing or the first and second originals from overlapping with each other. Thus, images on the first and second originals can be correctly read at the image reading portion of the image forming apparatus, thereby preventing the lack or omission of the image and preventing the damage of the originals due to the contact between the originals.

DETAILED DESCRIPTION OF THE PREFERRED EMBODIMENTS

The present invention will now be explained in connection with embodiments thereof with reference to the accompanying drawings.

First of all, a first embodiment of the present invention will be described.

Figure 1:
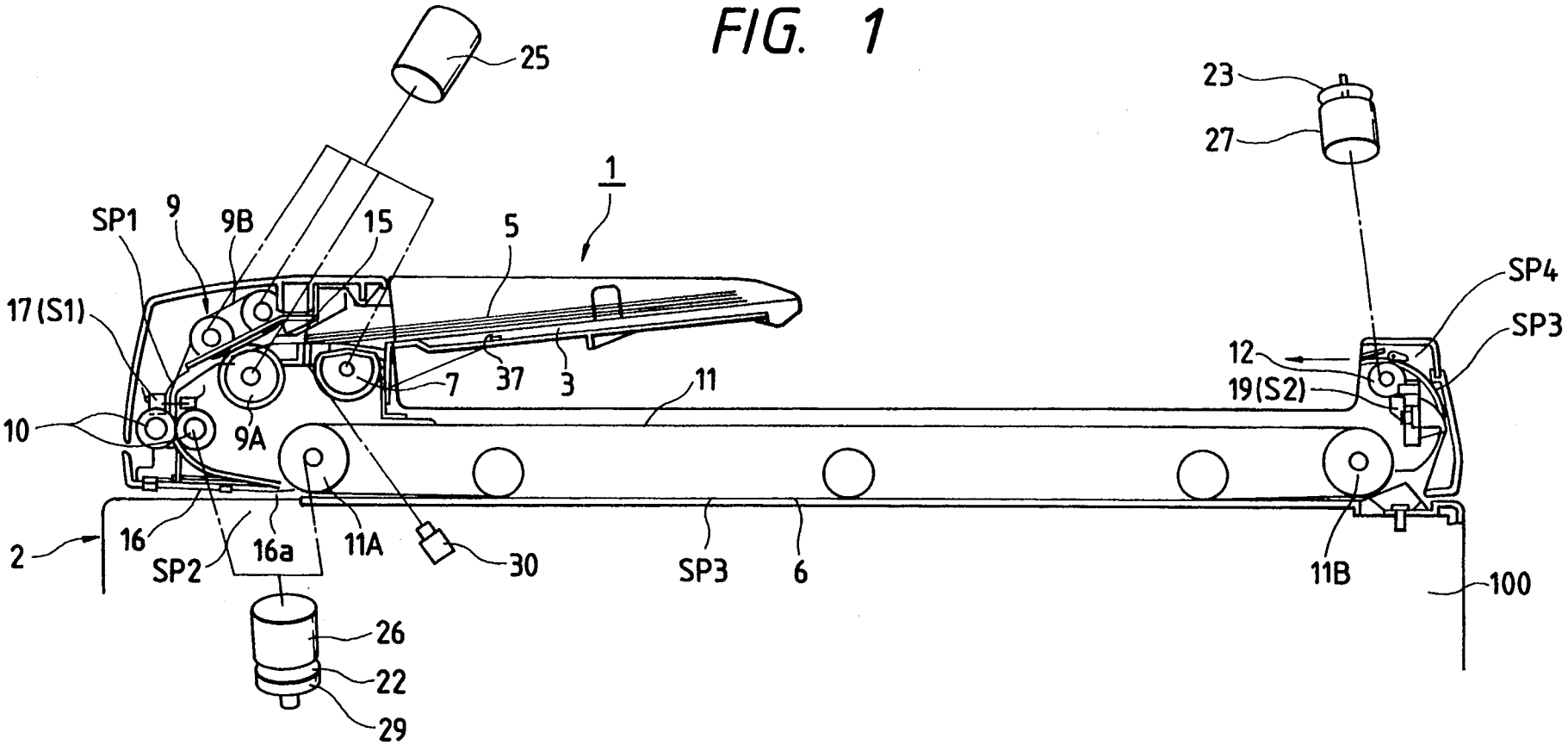
FIG. 1 is a sectional side view of an automatic original feeding apparatus according to a preferred embodiment of the present invention.

FIG. 1 is a sectional side view of an automatic original feeding apparatus according to a first embodiment of the present invention.

The automatic original feeding apparatus 1 is mounted on an image forming apparatus (copying machine) 2 and is designed so that originals 5 rested on an original support or stack tray 3 are separated one by one and are fed to a platen glass (image reading portion) 6 arranged on a top portion of the image forming apparatus 2. The originals 5 rested on the original support 3 are supplied to a separation device 9 successively from a lowermost one by means of a semi-circular sheet supply roller 7 rotated in a clockwise direction.

The separation device 9 comprises a feed roller 9A rotated in a counter-clockwise direction, and a retard belt (endless belt) 9B turned in a counter-clockwise direction. When several originals 5 are fed to the separation device 9, only the lowermost original is sent toward a downstream side by the feed roller 9A and the other originals 5 are returned to the original support 3 by the retard belt 9B.

The original 5 separated by the separation device 9 is sent to a nip of a pair of regist rollers 10 which are now stopped, thereby correcting the skew-feed of the original. Thereafter, the original 5 is fed to a predetermined position on the platen glass 6 by the pair of regist rollers 10 and a convey belt (endless belt) 11 which are now rotated at a predetermined timing.

When the originals 5 are set on the predetermined positions on the platen glass 6, an image forming operation of the image forming apparatus 2 is started. After the image forming operation, the originals 5 rested on the platen glass are discharged onto a discharge tray (not shown) out of the apparatus by means of the convey belt 11 now rotated in a counter-clockwise direction and a pair of discharge rollers 12 rotated in a sheet discharge direction.

While the above-mentioned original supplying operation is being effected, a stopper 15 for regulating the sliding movement of the originals 5 rested on the inclined original support 3 is lowered by a solenoid 30, thereby permitting the sliding movement of the originals 5.

Further, in the above-mentioned original feeding operation, the original 5 that passed through the paired regist rollers 10 is directed between the convey belt 11 and the platen glass 6 by a lower guide 16. In this case, a leading end of the original pushes down a Myler 16*a*. The Myler 16*a* has a rear end fixed to a roller guide and a front free end biased upwardly.

Incidentally, the sheet supply roller 7, the feed roller 9A of the separation device 9, and pulleys for the retard belt 9B of the separation device 9 are rotatingly driven by a rotating force of a separation motor 25. Further, the paired regist rollers 10 and a drive pulley 11A for the convey belt 11 are rotatingly driven by a rotating force of a belt motor 26. Further, the paired discharge rollers 12 are rotatingly driven by a rotating force of a sheet discharge motor 27.

The belt motor 26 is provided with a belt clock interrupter 22 for counting the number of revolutions of the belt motor, and an electromagnetic brake 29 for applying a braking force to a motor shaft of the belt motor. Further, the sheet discharge motor 27 is provided with a sheet discharge clock interrupter 23 for counting the number of revolutions of the sheet discharge motor.

Next, the original supply operation of the automatic original feeding apparatus under the two in one control (continuous supply control) will be explained with reference to FIGS. 2A to 2D.

Figure 2A:
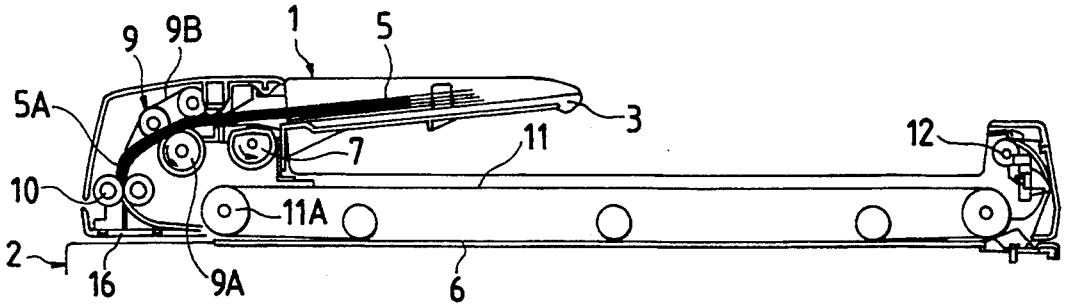
FIGS. 2A to 2D are sectional side views of the automatic original feeding apparatus for explaining the operation of the apparatus under the two in one control.
Figure 2B:
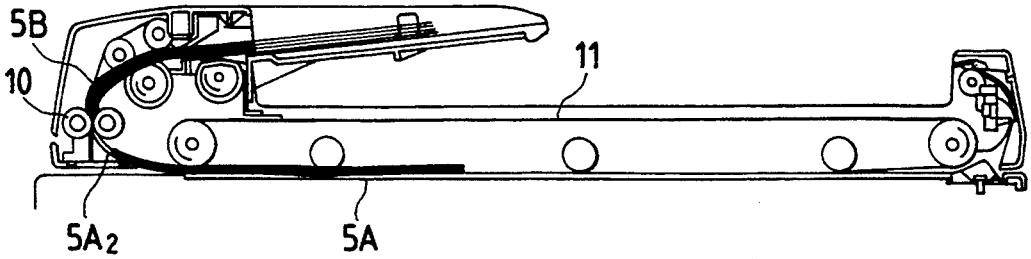

First of all, a first original (preceding original) 5A is supplied and is sent to the nip between the paired regist rollers 10 which are now stopped (refer to FIG. 2A).

Then, the first original 5A is fed by the regist rollers 10 and the convey belt 11 until a trailing end 5A2 of the first original has just passed through the nip of the paired regist rollers 10. Then, a second original (next original) 5B is supplied and is sent to the nip between the paired regist rollers 10 which are now stopped after the feeding of the first original 5A (refer to FIG. 2B).

Figure 2C:
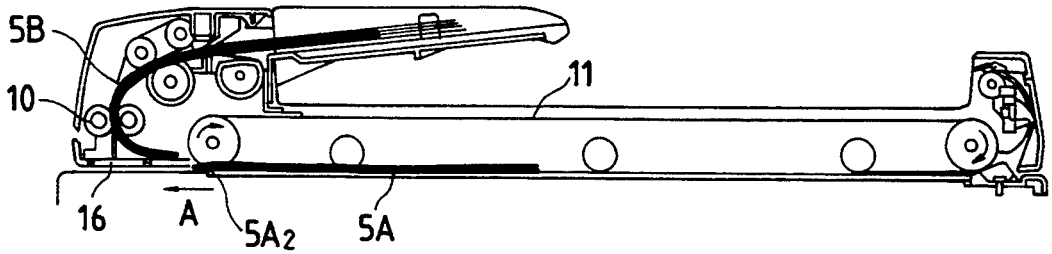
Figure 2D:
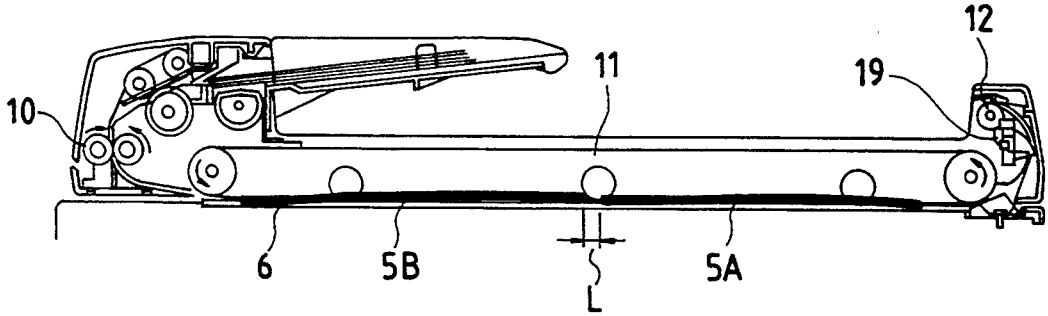

Then, the first and second originals 5A, 5B are simultaneously fed by the regist rollers 10 and the convey belt 11 until the trailing end of the first original 5A passes through the lower guide, and the originals are stopped (refer to FIG. 2C).

Then, in this condition, the convey belt 11 is rotated in a clockwise direction (reverse direction), thereby returning the first original 5A by a predetermined amount in a direction shown by the arrow A to reduce an interval or distance between the first and second originals 5A and 5B. In this case, since the trailing end of the first original 5A has passed through the lower guide 16, when the first original 5A is returned to the direction A by the convey belt 11, the trailing end of the first original enters below the lower guide 16 while being guided by the Myler 16*a*.

Figure 3:
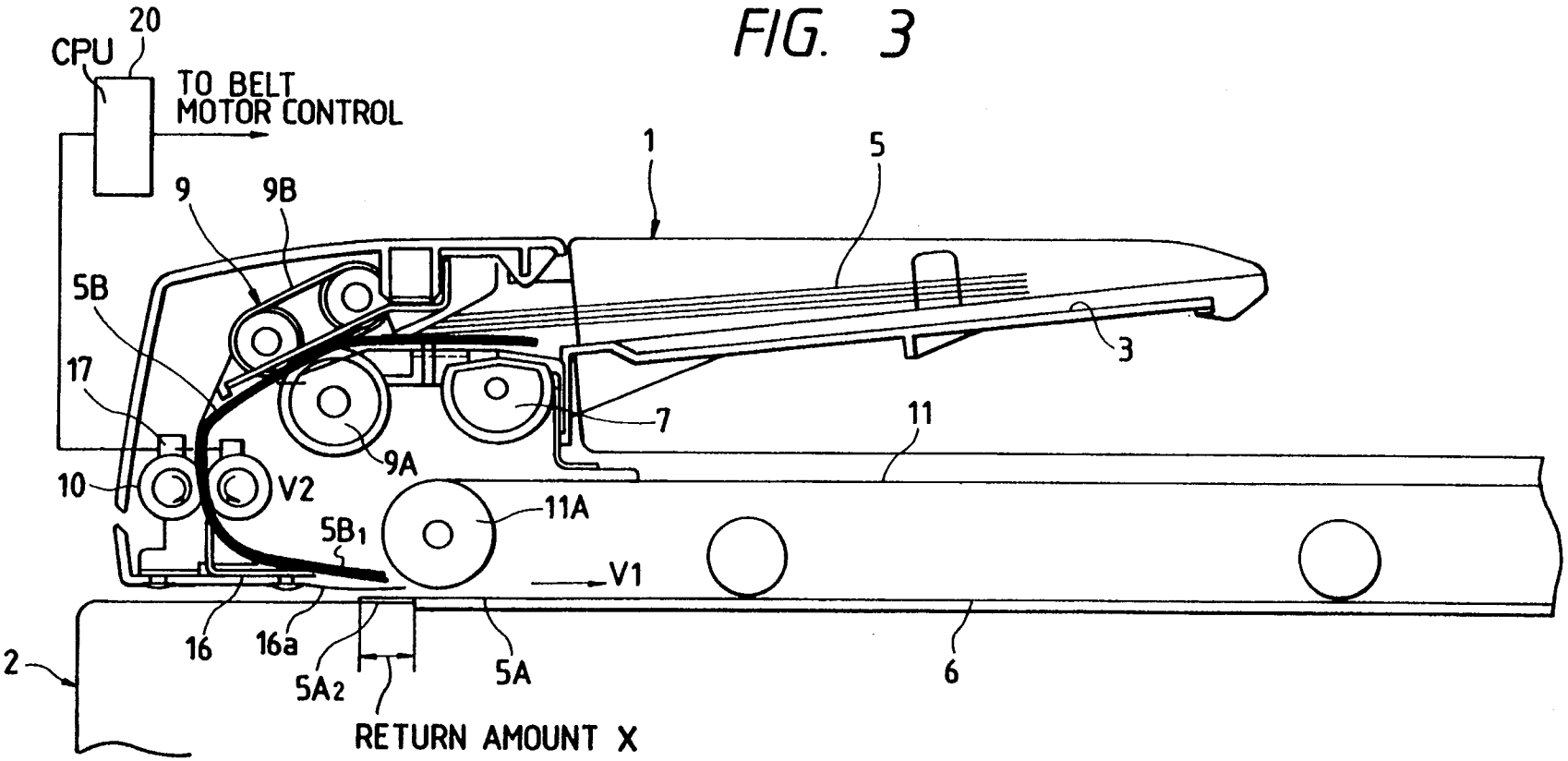
FIG. 3 is a partial enlarged sectional side view of the automatic original feeding apparatus explaining a returning operation for the first original under the two in one control.

In this way, in this automatic original feeding apparatus 1, when the first original 5A is returned by the predetermined amount, a value of the return amount X shown in FIG. 3 is varied in accordance with the size (length) of the original 5A. That is to say, when the first and second originals 5A, 5B are fed simultaneously, it is necessary to prevent the buckling of the original due to the pushing of the second original. To this end, normally, a convey speed V1 of the convey belt 11 for conveying the first original 5A is selected to be slightly greater than a peripheral speed V2 of the paired regist rollers 10 for conveying the second original 5B ($V1>V2$).

However, since the difference in conveying speed between the first and second originals 5A and 5B exists until the second original 5B has passed through the nip of the paired regist rollers 10, the influence of the difference in conveying speed between the first and second originals 5A and 5B is increased more, thereby increasing the interval between the first and second originals 5A and 5B.

To avoid this, in this automatic original feeding apparatus 1, a regist sensor (original size detection means) 17 is arranged immediately in front of (at an upstream side of) the paired regist rollers 10, so that the size of the first original 5A is measured on the basis of an original detection signal from the regist sensor 17, thereby varying the return amount X on the basis of the measured size of the original. In this way, it is possible to keep the interval between the originals constant regardless of the lengths of the sheets.

When the first original 5A is returned by the predetermined amount in this way, the regist rollers 10 and the convey belt 11 are rotated again (in the normal direction), thereby feeding the first and second originals 5A, 5B to predetermined positions on the platen glass 6. In this case, the first and second originals 5A, 5B are set on the platen glass 6 with a predetermined sheet interval L (refer to FIG. 2D). The sheet interval L is calculated on the basis of the overlapped amount between the trailing end 5A2 of the original 5A and the leading end 5B1 of the original 5B, the sizes of the originals, and the difference in the feeding speed between the belt 11 and the rollers 10.

In this condition, the image operation of the image forming apparatus 2 is effected, whereby the images on the first and second originals 5A, 5B are simultaneously copied on a copy sheet. After the image forming operation of the image forming apparatus 2 is finished in this way, the first and second originals 5A, 5B are discharged onto the discharge tray out of the apparatus by the convey belt 11 and the paired discharge rollers 12.

Incidentally, during the discharge of the originals, the first and second originals 5A, 5B are detected by a sheet discharge sensor 19 arranged immediately in front of (at an upstream side of) the pair of discharge rollers 12.

Figure 4:
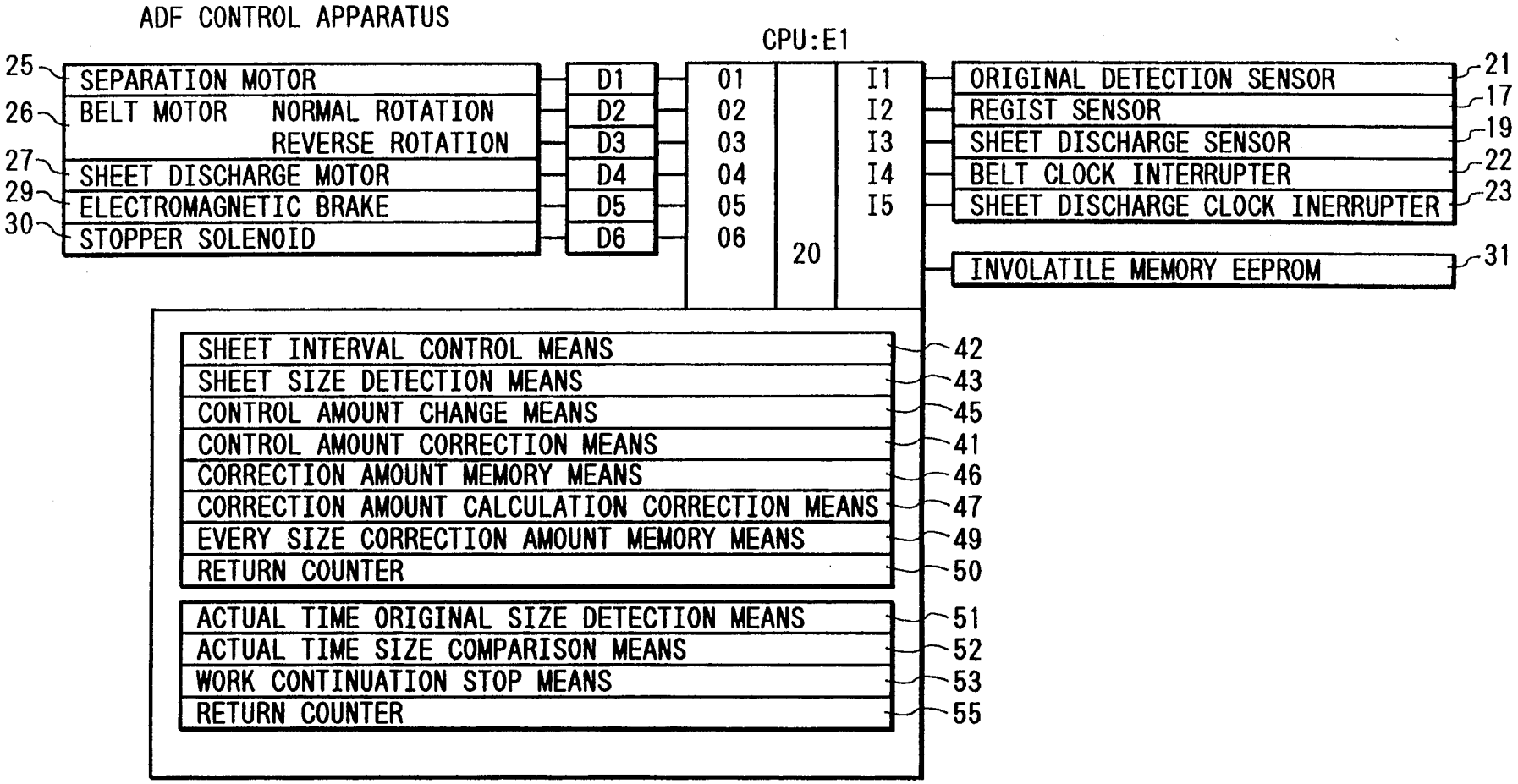
FIG. 4 is a block diagram of a control circuitry of the automatic original feeding apparatus.
Figure 5:
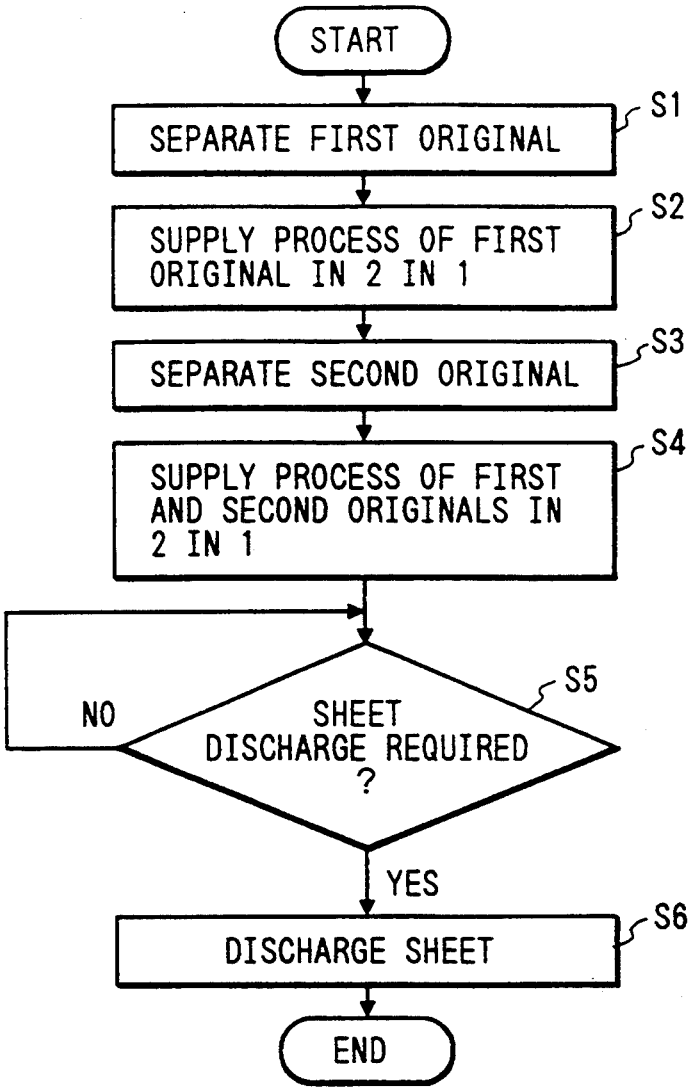
FIG. 5 is a flow chart showing of two in one original supply executed by a CPU of the automatic original feeding apparatus.
Figure 6:
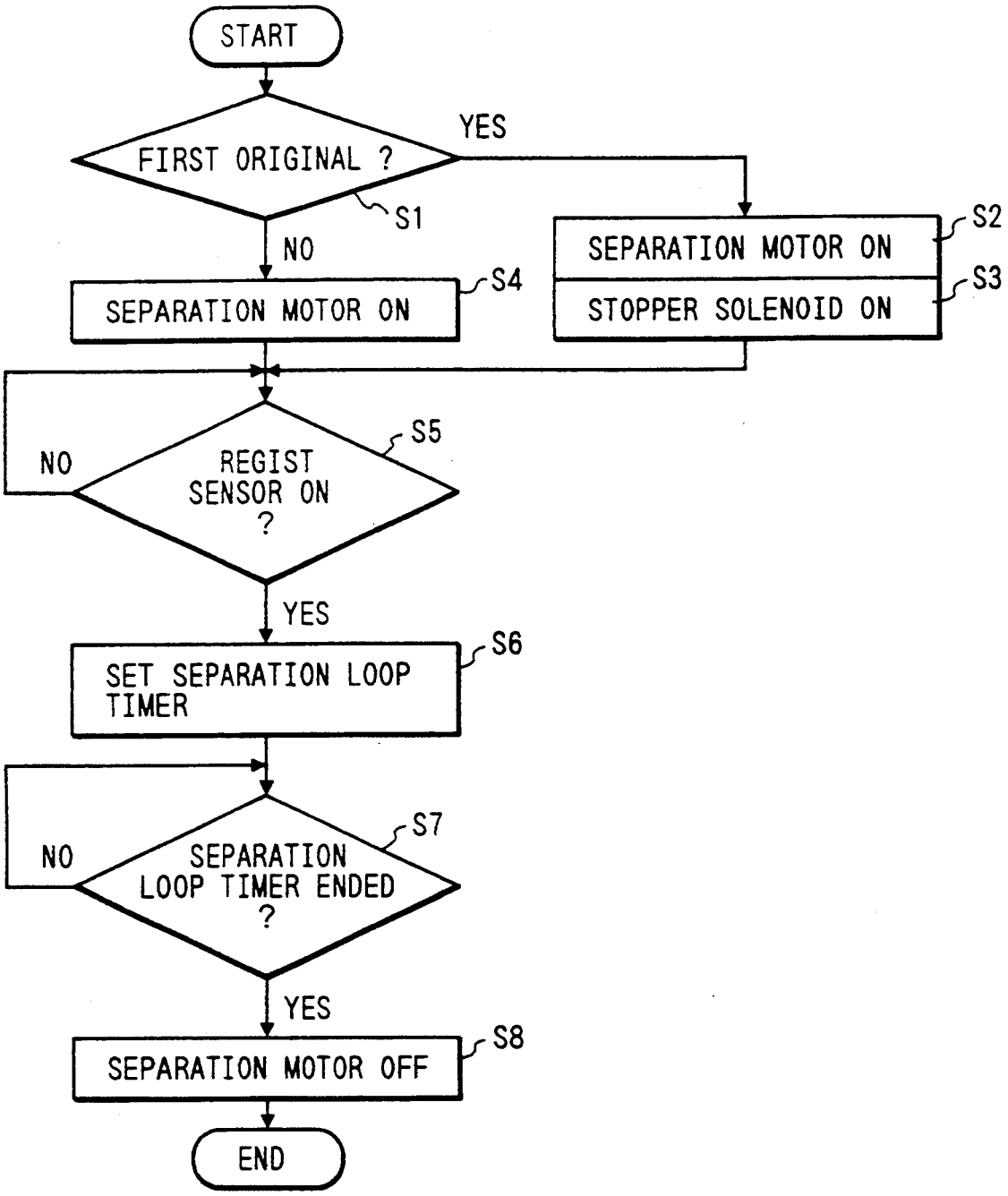
FIG. 6 is a flow chart showing an original separation process executed by the CPU.
Figure 7:
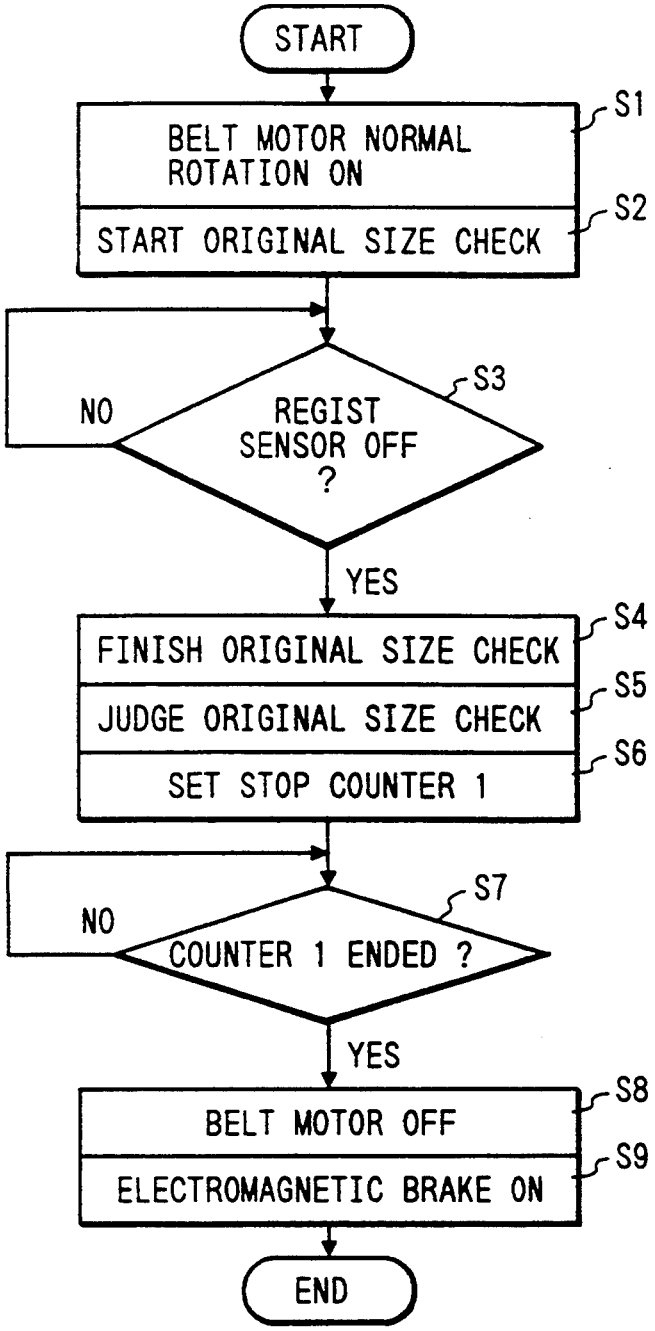
FIG. 7 is a flow chart showing a normal original supply process executed by the CPU.
Figure 8:
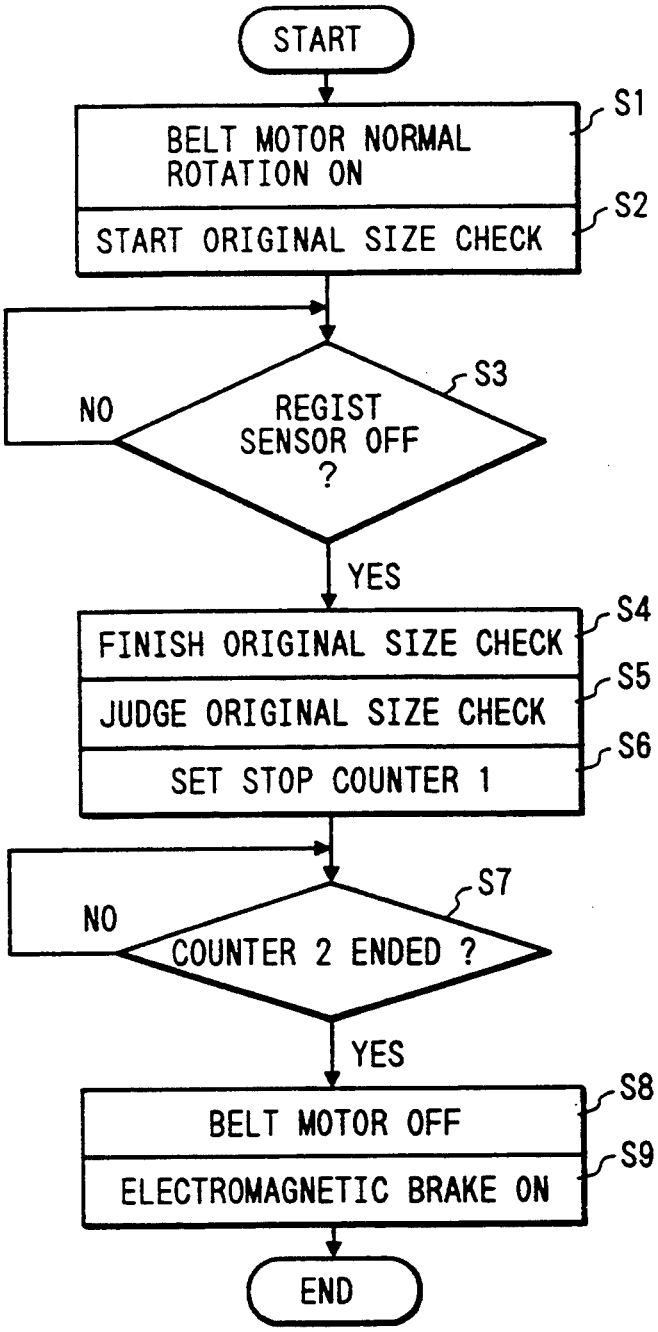
FIG. 8 is a flow chart showing a first original supply process in 2 in 1 executed by the CPU.
Figure 9:
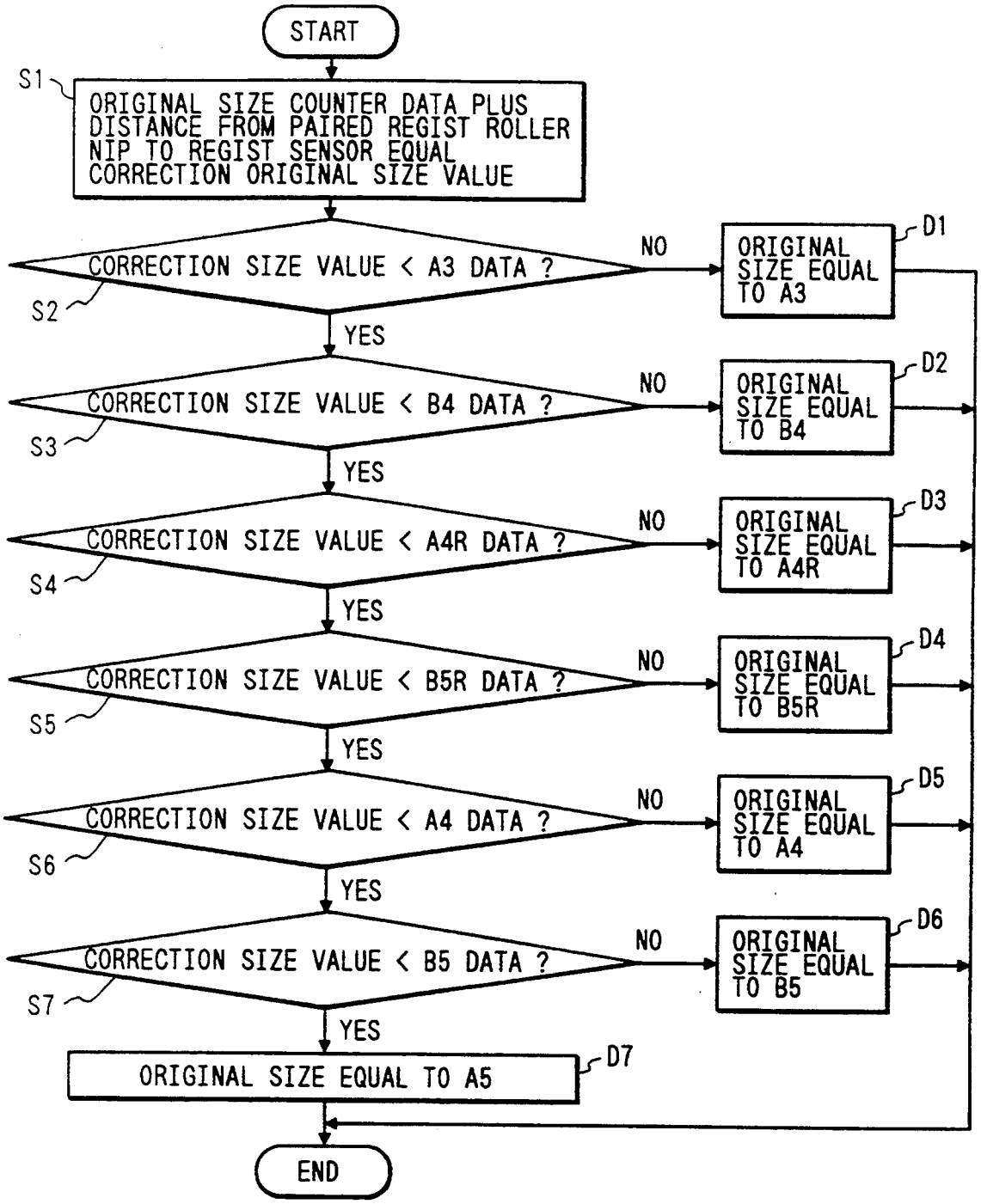
FIG. 9 is a flow chart showing an original size check sub-routine executed by the CPU.
Figure 10:
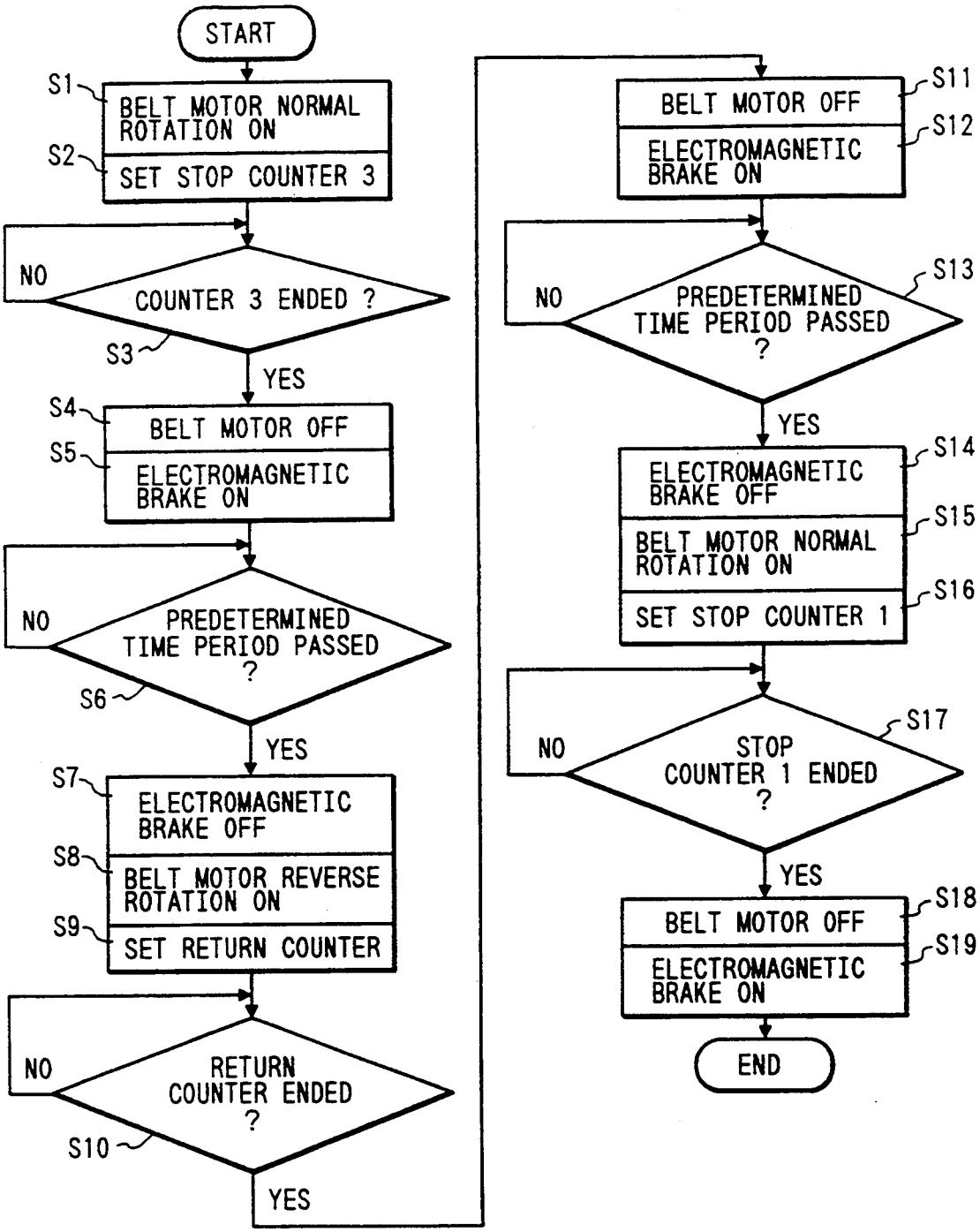
FIG. 10 is a flow chart showing a supply process of first and second originals in 2 in 1 executed by the CPU.
Figure 11:
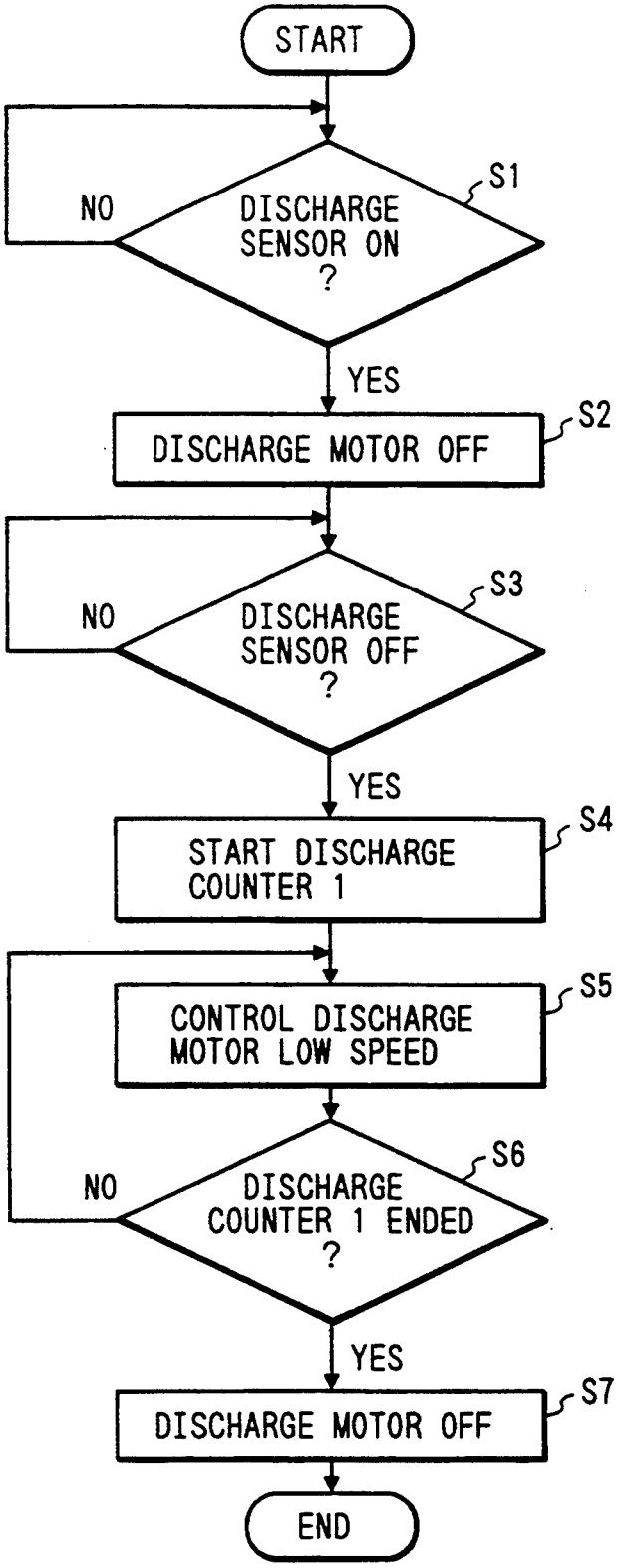
FIG. 11 is a flow chart showing an original discharge process executed by the CPU.

FIG. 4 shows the whole construction of the control circuitry of the automatic original feeding apparatus 1.

An original detection sensor 21 for detecting the presence/absence of the originals 5 resting on the original support 3, a regist sensor 17 for detecting the original 5 supplied from the original support 3, the sheet discharge sensor 19 for detecting the original 5 discharged from the platen glass 6 out of the apparatus, the belt clock interrupter 22 provided on the belt motor, and the sheet discharge clock interrupter 23 provided on the sheet discharge motor are electrically connected to input ports I1–I5 of a CPU (one chip microcomputer including a ROM, RAM and the like) 20 for controlling the whole automatic original feeding apparatus 1, respectively.

Further, the separation motor 25, belt motor 26, sheet discharge motor 27, electromagnetic brake 29 provided on the belt motor 26, and stopper solenoid 30 for driving the stopper 15 for regulating the sliding movement of the originals 5 rested on the original support 3 are electrically connected to output ports O1–O6 of the CPU 20, respectively.

The CPU 20 includes therein an involatile memory 31 the contents of which can be rewritten from the outside. The return amount X of the first original 5A which differs from size to size of the originals is stored in this memory 31. That is to say, the memory 31 stores correction values for effecting the return control for each original.

Next, the controlling operation of the CPU 20 will be explained with reference to FIGS. 5 to 11.

Original Supply in 2 in 1 (refer to FIG. 5):

First of all, the separation process of the first original 5A (step Sl) and the supply process of the first original (step $2) are effected, thereby feeding the first original until the trailing end 5A2 of the first original reaches a position spaced apart downstream from the paired regist rollers 10 by a predetermined distance. Then, the separation process of the second original 5B (step S3) is effected, thereby feeding the second original to the nip of the paired regist rollers 10 (condition shown in FIG. 2B). Then, the supply process of the first and second originals 5A, 5B (step S4) is effected, thereby setting the originals 5A, 5B on the exposure positions on the platen glass 6 side by side (condition shown in FIG. 2D). Thereafter, when the sheet discharge (step S5) is required after the image forming operation of the image forming apparatus, the discharge process of the originals 5A, 5B (step S6) is effected. In this way, the original supply operation in 2 in 1 control is ended.

Original Separation Process (refer to FIG. 6):

First of all, it is judged whether the separation process is required for the first original (step S1). If the separation process of the first original 5A is required, the separation motor 25 is turned ON (step S2) and at the same time the stopper solenoid 30 is turned ON (step S3). On the other hand, if the separation process of the second original 5B is required, only the separation motor 25 is turned ON (step S4).

Then, when the regist sensor 17 detects the leading end of the original (step S5), a separation loop timer is started (step S6). When the time set in the timer is elapsed (step S7), the separation motor 25 is turned OFF (step S8). In this way, a predetermined amount of loop is formed in the first or second original 5A or 5B at the regist rollers 10, thereby correcting the skew-feed of the original in the separation process.

Normal Original Supply Process (refer to FIG. 7):

First of all, the belt motor 26 is turned ON for the normal rotation, thereby driving the paired regist rollers 10 and the convey belt 11 to feed the original 5 after separation (step S1). At the same time, an original size check counter capable of counting by clock signals from the belt clock interrupter 22 is started (step S2), thereby starting the measurement of the original size.

Then, when the trailing end of the original passes through the regist sensor 17 (step S3), the original size check counter is stopped (step S4), and the original size is discriminated on the basis of the count data from the counter in an original size check sub-routine which will be described later (step S5). At the same time, a stop counter 1 for stopping the original 5 at the predetermined position on the platen glass 6 is started (step S6). When the count of the counter 1 is ended (step S7), the belt motor 26 is turned OFF (step S8) and the electromagnetic brake 29 is turned ON (step S9). In this way, the supply process is completed.

First Original Supply Process in 2 in 1 (refer to FIG. 8):

First of all, the belt motor 26 is turned ON for the normal rotation, thereby driving the paired regist rollers 10 and the convey belt 11 to feed the first original 5A after separation (step S1). At the same time, the original size check counter capable of counting by clock signals from the belt clock interrupter 22 is started (step S2), thereby starting the measurement of the original size.

Then, when the trailing end 5A2 of the original passes through the regist sensor 17 (step S3), the original size check counter is stopped (step S4), and the original size is discriminated on the basis of the count data from the counter in the original size check sub-routine which will be described later (step S5). At the same time, a stop counter 2 for stopping the trailing end 5A2 of the first original 5 at a predetermined position spaced apart downstream from the nip of the paired regist rollers 10 by a predetermined distance (for example, 29 mm) is started (step S6). When the count of the counter 2 is ended (step S7), the belt motor 26 is turned OFF (step S8) and the electromagnetic brake 29 is turned ON (step S9). In this way, the supply process of the first original in 2 in 1 is completed.

Original Size Check Process (refer to FIG. 9):

First of all, an original size value is calculated by adding a value of a distance value between the nip of the paired regist rollers 10 and the regist sensor 17 to the data from the original size check counter (step S1). In this case, since the original is being fed by the paired regist rollers 10 and the convey belt 11, the feeding amount of the original corresponds to the count value given by the belt clock interrupter 22 without fail.

Then, by comparing the calculated original size with various original size data D1 to D7 (step S2–step S7), it is determined which original size A3, B4, A4R, B5R, A4, B5 or A5 corresponds to the size of the actual original.

First and Second Original Supply Process in 2 in 1 (refer to FIG. 10 ):

First of all, the belt motor 26 is turned ON for the normal rotation, thereby driving the paired regist rollers 10 and the convey belt 11 to feed the first and second originals 5A, 5B (step S1). At the same time, a stop counter 3 is started (step S2) to stop the originals in a condition that the first and second originals 5A, 5B straddle between the lower guide 16 and the platen glass 6 (condition shown in FIG. 2C). When the count of the counter 3 is ended (step S3), the belt motor 26 is turned OFF (step S4) and the electromagnetic brake 29 is turned ON (step S5).

Then, when a predetermined time period is elapsed (step S6), the electromagnetic brake 29 is turned OFF (step S7), and at the same time the belt motor 26 is turned ON for the reverse rotation (step S8), and a return counter for controlling the predetermined return amount of the first original 5A is started (step S9). Then, when the count of the counter is ended (step S10), the belt motor 26 is turned OFF again (step S11) and at the same time the electromagnetic brake 29 is turned ON (step S12).

Then, when a predetermined time period is elapsed (step S13), the electromagnetic brake 29 is turned OFF (step S14), and the belt motor 26 is turned ON for the normal rotation (step S15). At the same time, a stop counter 1 for stopping the first and second originals 5A, 5B at the predetermined positions on the platen glass 6 is started (step S16). Then, when the count of the counter 1 is ended (step S17), the belt motor 26 is turned OFF (step S18) and the electromagnetic brake 29 is turned ON (step S19). In this way, the supply of first and second originals in 2 in 1 control is finished.

During this process, since the return counter must be variable in accordance with the sizes of the originals, the base value of the return counter for each original size is previously stored in the ROM permanently, and, by adding or subtracting the correction value to or from the base value in accordance with the kind of the apparatus and/or the environmental condition, the more accurate control for the sheet interval can be permitted.

Further, the correction value is stored in the involatile memory 31 of the CPU 20, which memory can be rewritten from the outside.

Original Discharge Process (refer to FIG. 11):

First of all, at the time when the sheet discharge sensor 19 detects the leading end of the original (step S1), the sheet discharge motor 27 is rotated to drive the pair of sheet discharge rollers 12 (step S2).

Then, at the time when the sheet discharge sensor 19 detects the trailing end of the original (step S3), a sheet discharge counter 1 corresponding to a distance of 10 mm from the sheet discharge sensor 19 toward the center of the nip of the paired discharge rollers 12 is started (step S4), and the sheet discharging speed is reduced until the count of the sheet discharge counter 1 is ended (step S5). When the count of the sheet discharge counter 1 is ended (step S6), the sheet discharge motor 27 is stopped (step S7). In this way, the sheet discharge process is completed.

During the sheet discharge process, the count amount given by the sheet discharge counter (sheet discharge clock interrupter 23) corresponds to the feeding amount of the original given by the paired discharge rollers 12 without fail.

Figure 12:
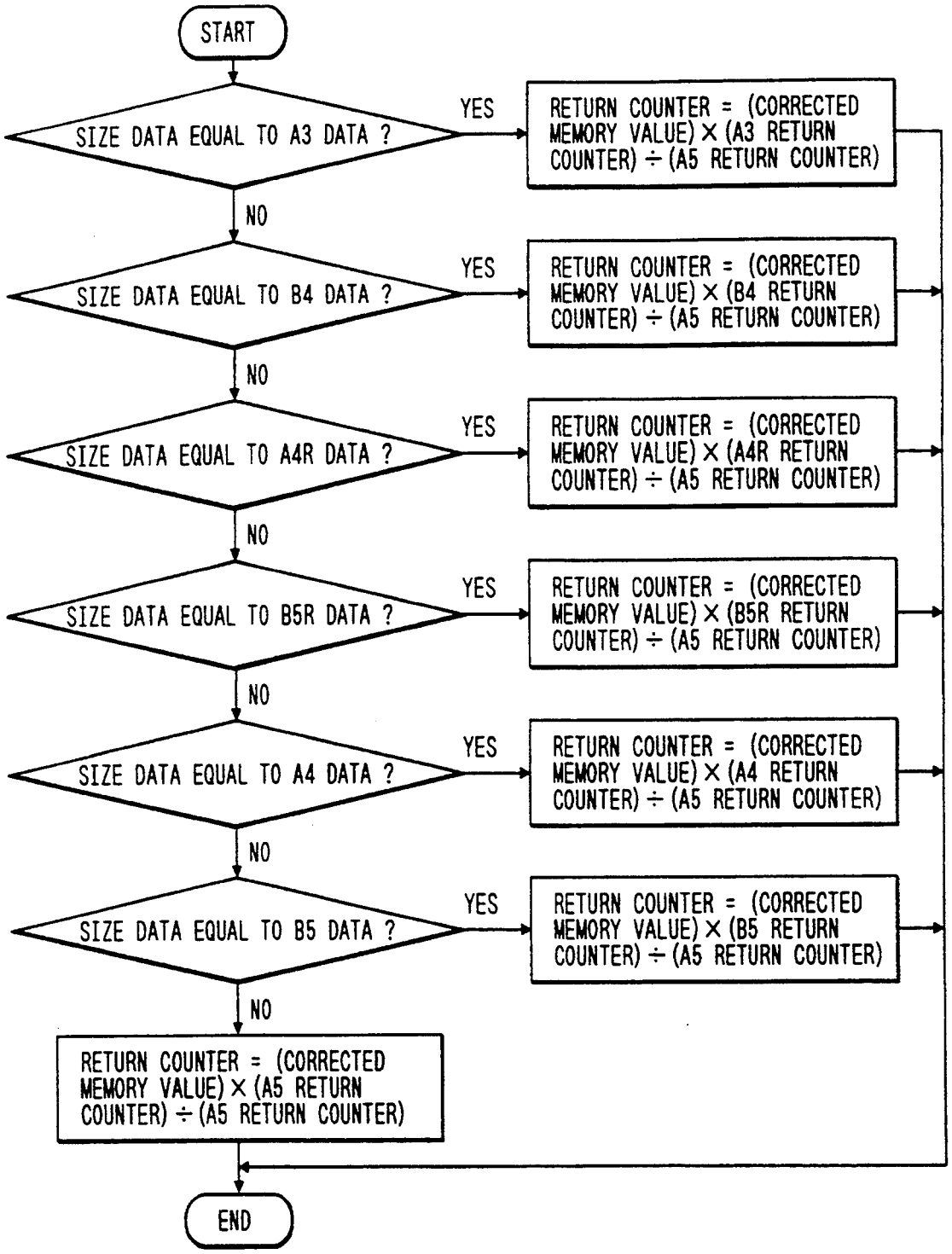
FIG. 12 is a flow chart showing a return counter set sub-routine.

Next, a return counter set sub-routine will be explained with reference to FIG. 12.

In this return counter set sub-routine, the return amount for each original is called out in reference to the size data discriminated by the size check sub-routine and stored in the RAM of the CPU, and the correction is effected by calculating the return amount with the return amount correction value for each apparatus stored in the involatile memory (EEPROM), whereby the corrected return amount is converted into the shifting amount of the convey belt 11 driven by the belt motor 26, thereby setting such shifting amount as the return counter value. In this case, the calculating formula will be as follows:

[return counter] = [stored correction value for each apparatus] × [base value for *A5* size in return counter] ÷ [detected original size value in return counter].

In the first embodiment, while only a single correction value was stored in the involatile memory which can be rewritten and the correction was calculated for each original size on the basis of the feeding distance of the original in the abovementioned return counter set sub-routine, in a second embodiment, if the capacity of the involatile memory which can be rewritten is adequate, a plurality of correction values for respective original sizes are stored in the memory and these values can be corrected as needed.

Figure 13:
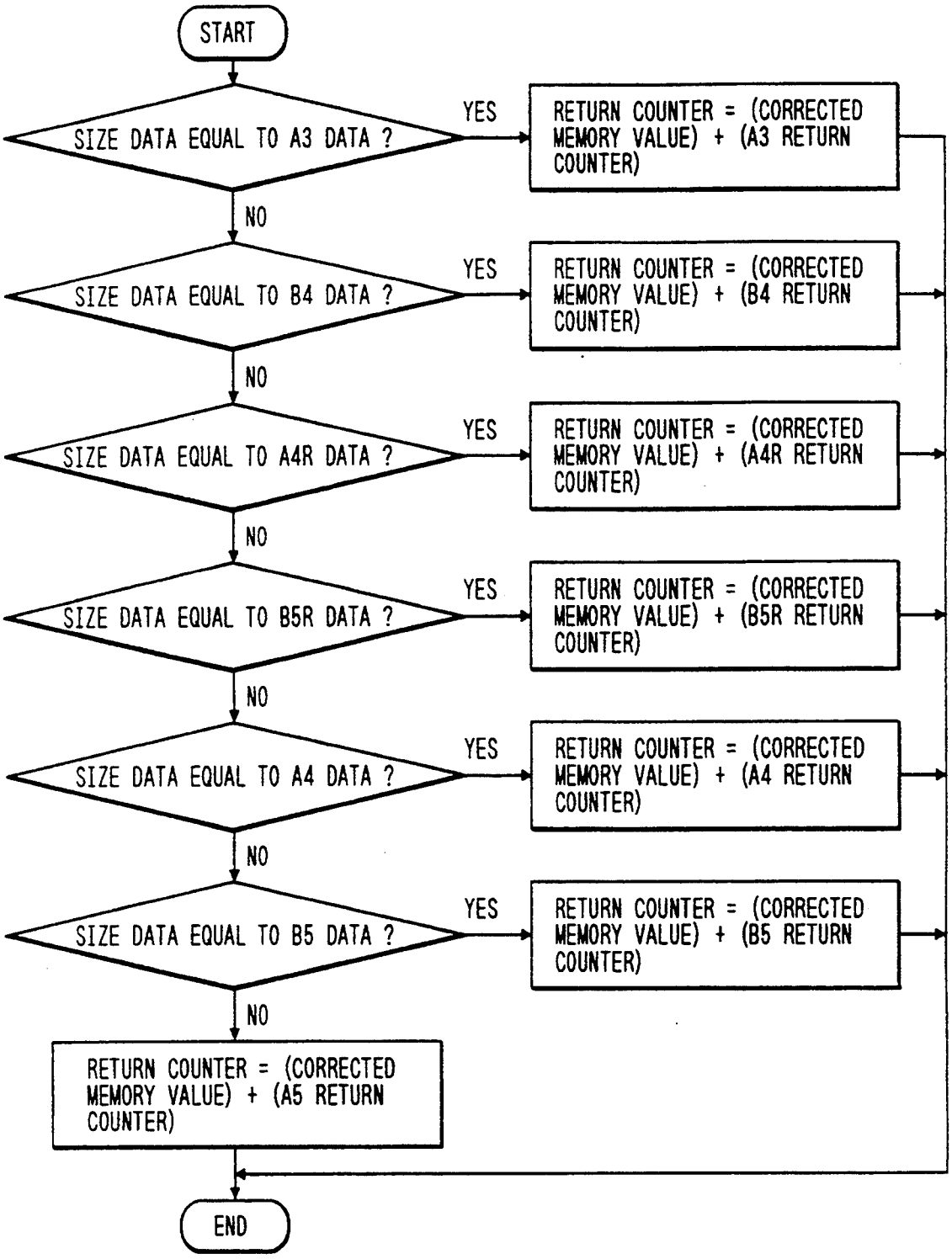
FIG. 13 is a flow chart showing a return counter set sub-routine according to a second embodiment.

In this second embodiment, a return counter set sub-routine will be as shown in FIG. 13.

Now, the return counter set sub-routine according to the second embodiment will be explained.

In this return counter set sub-routine, the return amount for each original is called out in reference to the size data discriminated by the size check sub-routine and stored in the RAM of the CPU, the return amount correction values for each apparatus and for each original size are called out from the involatile memory (EEPROM), and the correction is effected by calculating the return amount with the return amount correction values, whereby the corrected return amount for each original size is converted into the shifting amount of the convey belt 11 driven by the belt motor (BELTMTR), thereby setting such shifting amount as the return counter value. In this case, the calculating formula will be as follows:

[return counter] = [stored correction value for each apparatus] × [stored correction value for each original size].

In the above second embodiment, while the involatile memory (EEPROM) which can be rewritten was used as a memory means for storing the correction values for the original return control, in a third embodiment, by utilizing the A/D converting function of the CPU, an analogue VR is connected to an A/D converting function port, and, after the set value of the analogue VR is A/D converted, the data is used as the correction value for the original return control.

Figure 14:
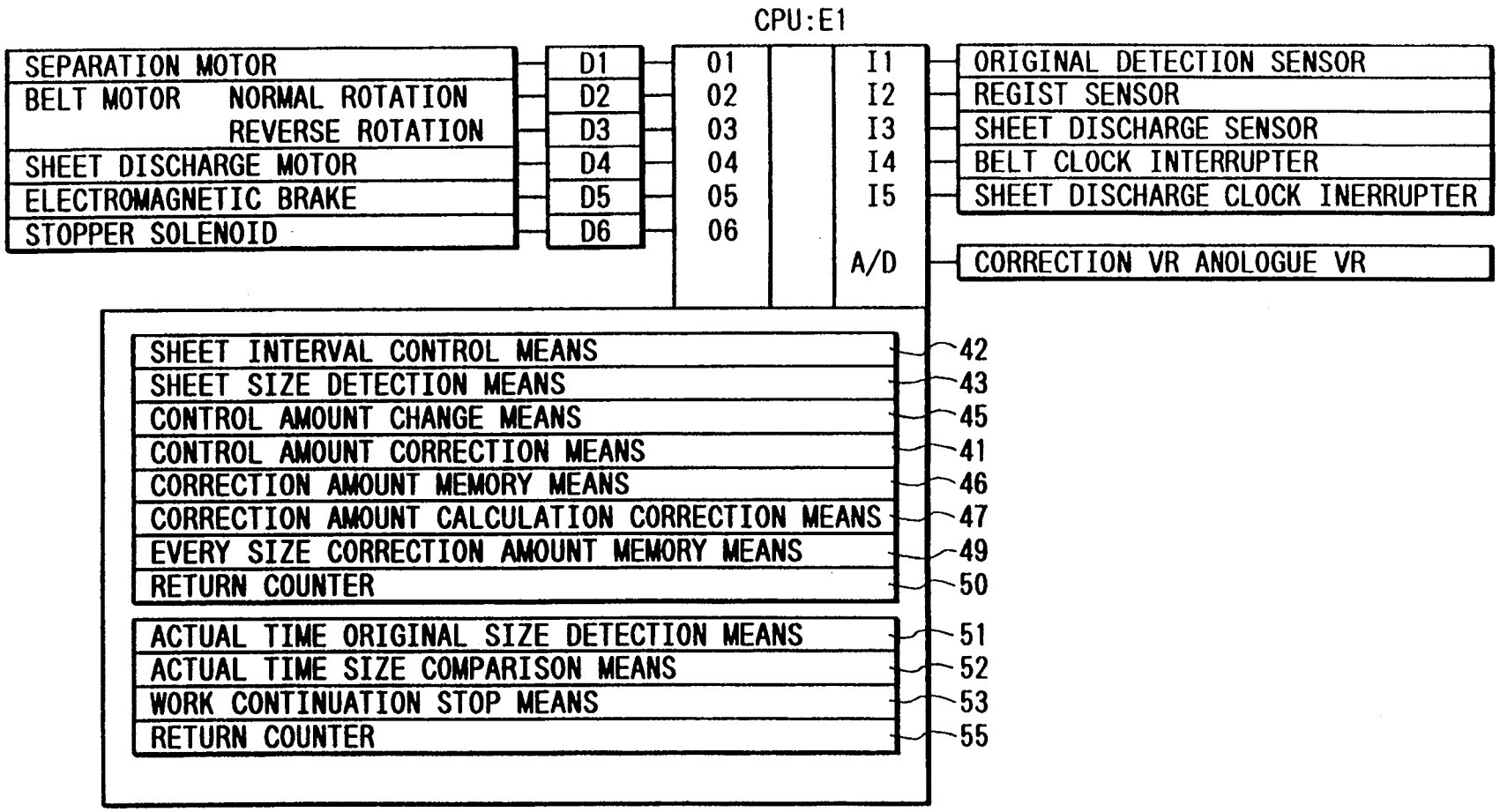
FIG. 14 is a block diagram of a control circuitry of an automatic original feeding apparatus according to a third embodiment.

A block diagram of the control circuitry according to the third embodiment is shown in FIG. 14.

The control circuit according to the third embodiment comprises a one chip microcomputer (E1) 40 including ROM, RAM and the like, and signals from various sensors are inputted to input ports I1–I5 of the microcomputer E1. Further, various loads are connected to output ports O1–O6 of the microcomputer E1 via drivers D1–D6.

There are provided a separation roller 9, a separation motor 25 for driving a feed roller, regist rollers 10, a belt motor 26 for driving a convey belt 11, a belt clock interrupter 22 for counting the number of revolutions of the belt motor (number of revolutions of the regist rollers 10 and the convey belt 11), an electromagnetic brake 29 for stopping a drive shaft of the belt motor, a stopper driving solenoid 30 for driving an original stopper (not shown), a sheet discharge motor 27 for driving sheet discharge rollers 12, a sheet discharge clock interrupter 23 for counting the number of revolutions of the sheet discharge motor (number of revolutions of the sheet discharge rollers 12), an original detection sensor 37 for detecting the presence of the originals rested on an original support 3, a regist sensor 17 disposed at an upstream side of the regist rollers 10, and a sheet discharge sensor 19 disposed at an upstream side of the sheet discharge rollers 12.

Further, in the controller El, an involatile memory element (EEPROM) for storing correction values for effecting the correction in the return control for each original (which will be described later) is arranged, which memory element can be rewritten from the outside.

Figure 15:
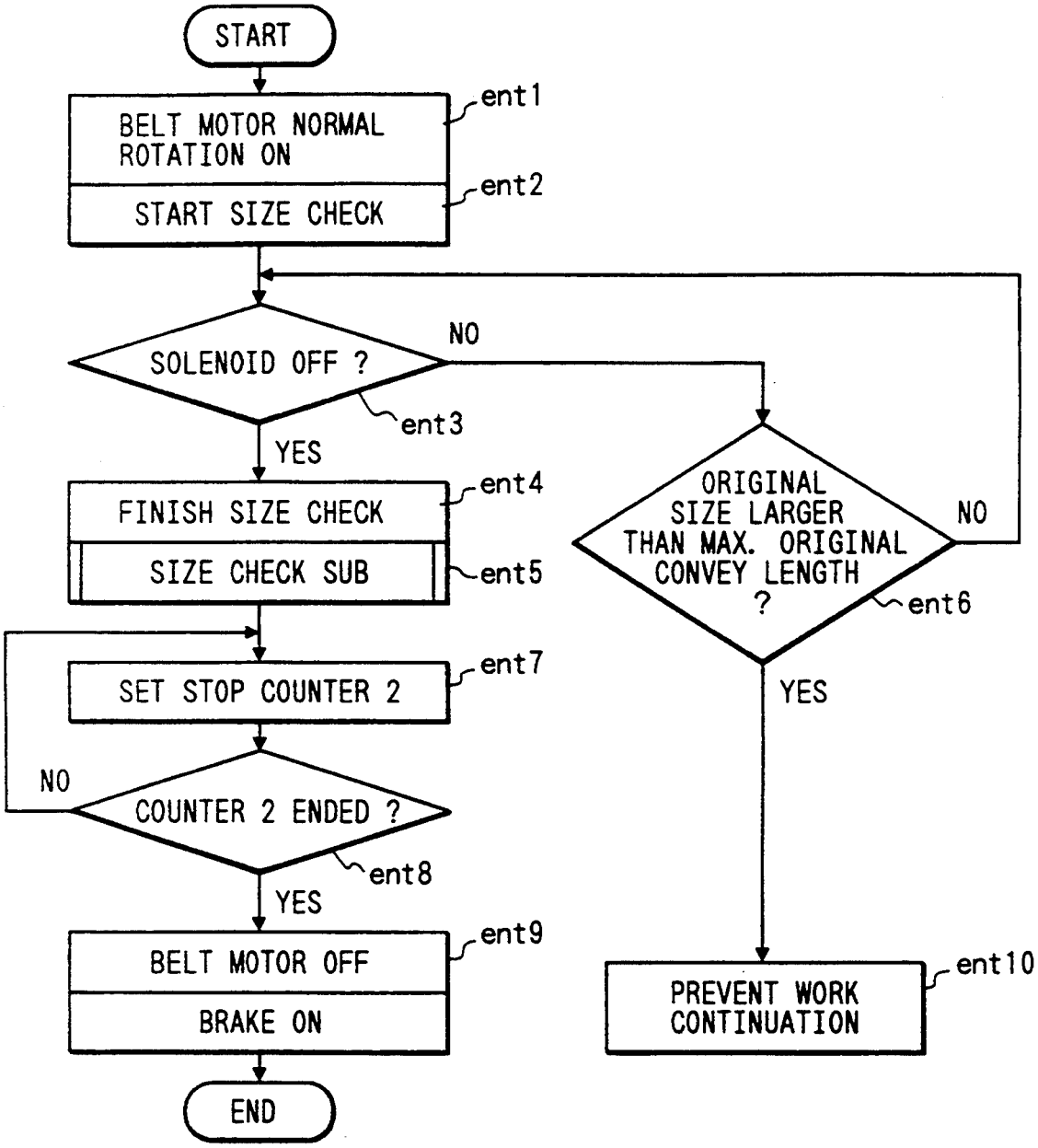
FIG. 15 is a flow chart showing a first original supply process in 2 in 1 according to a fourth embodiment.
Figure 16:
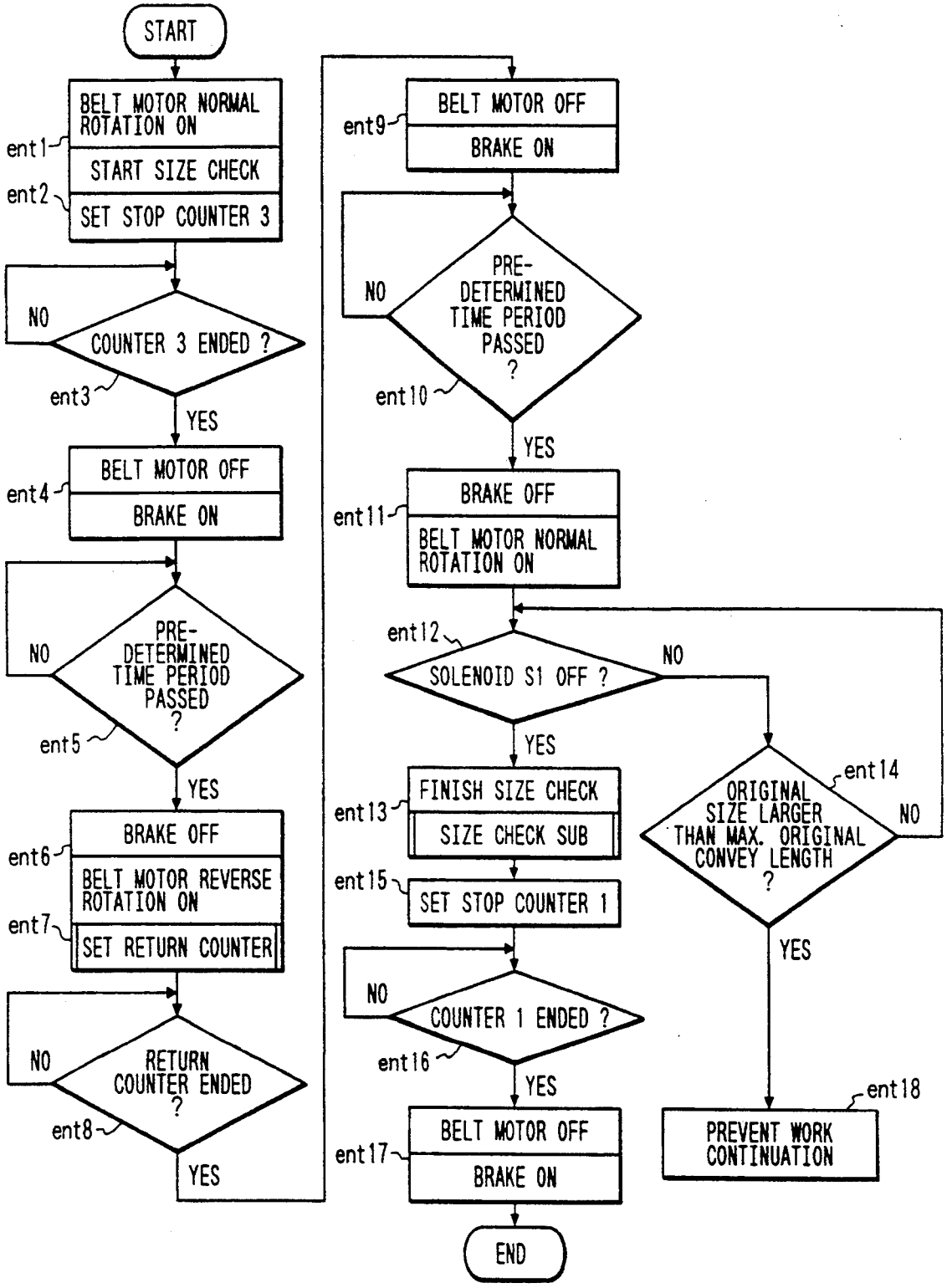
FIG. 16 is a flow chart showing a second original supply process in 2 in 1.
Figure 17:
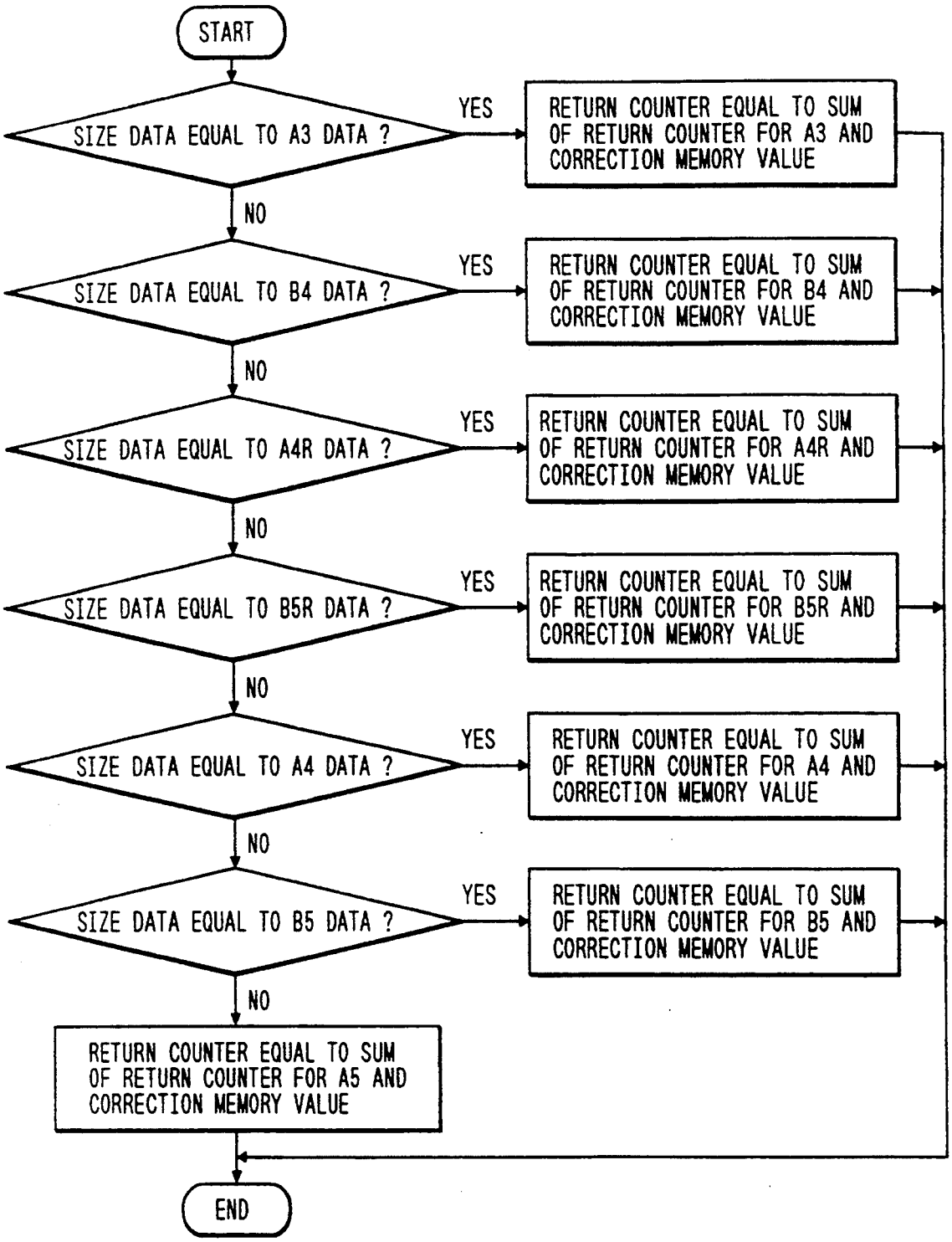
FIG. 17 is a flow chart showing a return counter set sub-routine.

The fourth embodiment will be fully explained with reference to FIGS. 15 to 17. Incidentally, since the construction of the apparatus and flow charts for controlling the operation of the apparatus are the same as those shown in the first embodiment, these will be omitted from illustration and explanation.

First Original Supply Process in 2 in 1 (refer to FIG. 15):

In the first original supply process in 2 in 1 control (2 in 1_1 entsq), the paired regist rollers 10 and the convey belt 11 are driven, and the belt motor 26 is rotated in the normal direction (ent 1) to feed the original from a sheet path SP1 to a sheet path SP2, and at the same time a size check counter capable of counting clock signals from the belt clock interrupter 22 is started, thereby starting the measurement of the original size (ent 2). At the time when the trailing end of the original has passed through the regist sensor 17 (ent 3), the size check counter is stopped (ent 4), and the original size is discriminated on the basis of the counter data in the size check sub-routine (ent 5).

Further, in the ent 3, a predetermined maximum original feeding distance is compared with the actual original length (ent 6). If the original length is longer than the maximum feeding distance, the program goes to ent 10, where a further feeding of the original is immediately stopped by a work continuation preventing means. In the ent 6, if the original size length is shorter than the maximum feeding distance, the program is continued, thereby starting a stop counter 1 or 2 for stopping the original at a position spaced apart downstream from the center of the nip of the paired regist rollers 10 by a predetermined distance (20 mm in the illustrated embodiment) (ent 7). After the count of the counter 1 or 2 is ended (ent 8), the belt motor 26 is turned OFF and at the same time the electromagnetic brake 29 is turned ON (ent 9). In this way, the first original supply process in the 2 in 1 control is finished.

Second Original Supply Process in 2 in 1 (refer to FIG. 16):

Now, the second original supply process in the 2 in 1 control will be described. In the second original supply process in 2 in 1 control (2 in 1_1-2 entsq), the paired regist rollers 10 and the convey belt 11 are driven, and the belt motor 26 is rotated in the normal direction (ent 1) to feed the original from the sheet path SP1 to the sheet path SP2, and at the same time a size check counter for detecting the original size is started (ent 1). A stop counter 3 is started (ent 2) to stop the originals in a condition that two originals straddle between the sheet paths SP1, SP2 (refer to FIG. 2C). When the count of the counter 3 is ended (ent 3), the belt motor 26 is turned OFF and at the same time the electromagnetic brake 29 is turned ON (ent 4). Further, after a predetermined time period is elapsed (ent 5), the electromagnetic brake 29 is turned OFF and the belt motor 26 is turned ON for the reverse rotation. At the same time the return counter is started (ent 7) by calling out the return counter set value for controlling the predetermined return amount of the first original. After the count of the return counter is ended (ent 8), the belt motor 26 is turned OFF again and at the same time the electromagnetic brake 29 is turned ON (ent 9). Further, after a predetermined time period is elapsed (ent 10), the electromagnetic brake 29 is turned OFF and the belt motor 26 is turned ON for the normal rotation (ent 11). When the trailing end of the original is detected by the regist sensor 17 (ent 12), the size check counter is stopped and the original size is discriminated in the size check sub-routine (ent 13).

In ent 14, the predetermined maximum original feeding distance is compared with the total of "(discriminated original size length)+(the first original size length)+(sheet interval)" at real time. If the maximum original feeding distance is smaller than the original size length, the program goes to ent 18, where a further feeding of the original is immediately stopped by the work continuation preventing means. In the ent 14, if the maximum original feeding distance is greater than the original size length, the stop counter 1 for simultaneously stopping the first and second originals at the predetermined positions on the platen glass 6 is started (ent 15). After the count of this counter is ended (ent 16), the belt motor 26 is turned OFF and at the same time the electromagnetic brake 29 is turned ON (ent 17). In this way, the second original supply process in the 2 in 1 control is completed.

In this case, as mentioned above, since the value of the return counter must be variable in accordance with the original sizes, the base value for each size in the return counter is previously stored in the memory permanently, and, by calculating the correction value due to the kind of apparatus and/or the original size in the feeding direction with the base value, the more accurate control for the sheet interval can be permitted.

Further, the correction value is stored in the involatile memory of the controller, which memory can be rewritten from the outside.

Next, a return counter set sub-routine will be explained with reference to FIG. 17.

In this return counter set sub-routine, the return amount for each original is called out in reference to the size data discriminated in the size check sub-routine and stored in the RAM of the CPU, and the correction is effected by calculating the return amount with the return amount correction value for each apparatus stored in the involatile memory (EEPROM), whereby the corrected return amount is converted into the shifting amount of the convey belt 11 driven by the belt motor 26, thereby setting such shifting amount as the return counter value.

Next, a fifth embodiment of the present invention will be explained.

Figure 18:
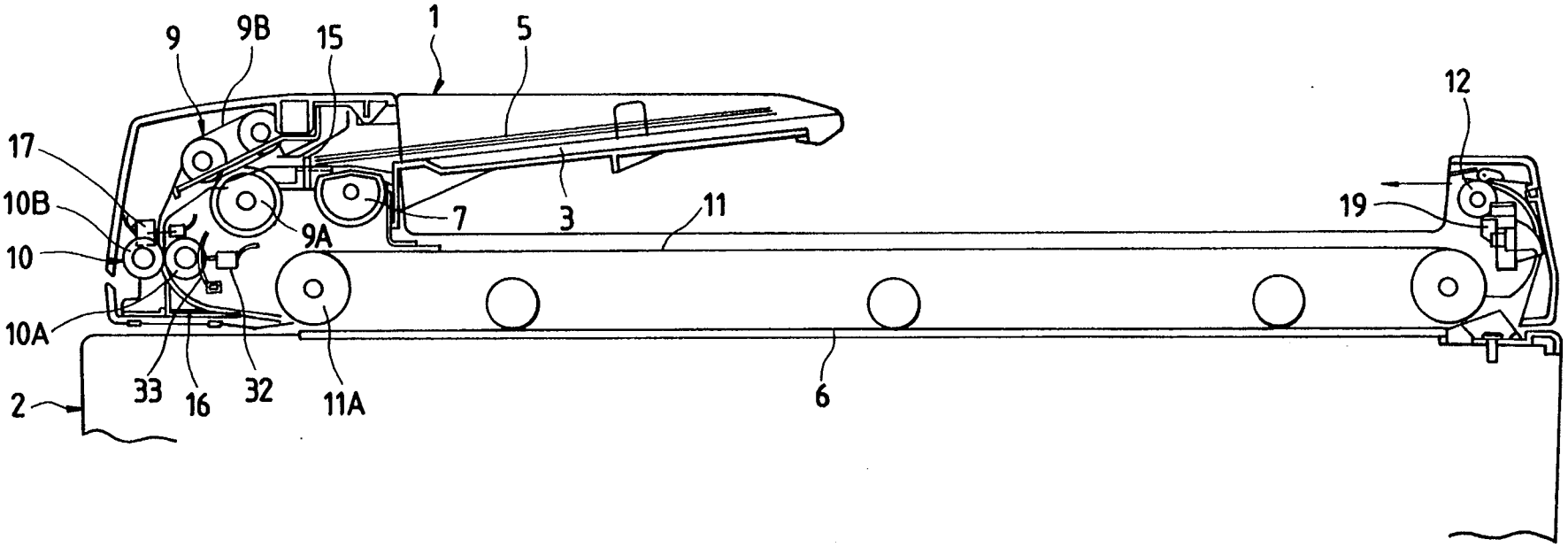
FIG. 18 is a sectional side view of an automatic original feeding apparatus according to a fifth embodiment of the present invention.

FIG. 18 shows the whole construction of an automatic original feeding apparatus according to a fifth embodiment of the present invention.

In the automatic original feeding apparatus 1 according to this embodiment, in consideration of the fact that an original feeding time effected by the paired regist rollers 10 and the like is varied as a thickness of the original 5 is changed, the means for detecting the thickness of the original 5 is further added in the automatic original feeding apparatus 1 of the first embodiment, so that, in the 2 in 1 supply control, the value of the return amount of the first original 5A is determined by the size and thickness of the original 5.

In this embodiment, as the means for detecting the thickness of the original 5, a displacement amount detection sensor 32 for detecting a displacement amount of a movable roller 10A of the paired regist rollers 10, and the thickness of the first original 5A is measured on the basis of the displacement information from the displacement amount detection sensor 32.

Incidentally, the movable roller 10A of the paired regist rollers 10 is urged against a fixed roller 10B with a predetermined pressure by a pressurizing spring (leaf spring) 33.

Next, a flow of the originals when a plurality of originals are continuously supplied by using the automatic original feeding apparatus and the images on the originals are simultaneously copied will be explained with reference to FIGS. 41 to 44.

First of all, a plurality of originals 5 resting on the original support 3 are sent to the separation device 9 by the semi-circular sheet supply roller 7, where the originals are separated one by one from the lowermost one, and the separated original passes through the original detection sensor S1 and reaches the paired regist rollers 10, and where the original is temporarily stopped by the nip of the regist rollers 10 (refer to FIG. 2A).

The first original 5A is fed from the paired regist rollers 10 toward the convey belt 11. When the trailing end of the first original is left from the nip of the regist rollers 10 by a small distance, the original is stopped again. Then, the second original 5B is separated by the separation device 9 in the same manner as that of the first original, and is abutted against the nip of the regist rollers 10 and is stopped there temporarily (refer to FIG. 41). In this case, it is assumed that a distance or interval between the trailing end of the first original 5A and the leading end of the second original 5B is $L_1$.

Then, the first and second originals 5A, 5B are simultaneously fed, and, when the trailing end of the first original 5A has just passed through the lower guide 16, the feeding of the originals is stopped again (refer to FIG. 42). In this case, when the original feeding speed of the paired regist rollers 10 is $V_1$ and the original feeding speed of the convey belt 11 is $V_2$, as the originals 5A, 5B are fed from the condition shown in FIG. 41 to the condition shown in FIG. 42, the second original 5B is fed at the feeding speed of $V_1$ while being pinched by the paired regist rollers 10, and the first original 5A is fed at the feeding speed of $V_2$ by the convey belt 11. When the sheet interval created by the difference in the feeding speed is $\Delta l_1$, a distance $L_2$ between the trailing end of the first original 5A and the leading end of the second original 5B in the condition shown in FIG. 42 will be $(L_1+L_2)$. Further, as the originals 5A, 5B are fed until the leading end of the original 5B reaches the nip between the convey belt 11 and the platen glass, when the sheet interval corresponding the difference in the sheet feeding length due to the difference in the feeding speed is $\Delta l_2$, the sheet interval $L_3$ between the first and second originals 5A, 5B will be $(L_2+\Delta l_2)$.

In the normal two in one mode, since it is desirable for $L_3$ zero to be, in this automatic original feeding apparatus, the sheet interval between the first and second originals 5A, 5B is adjusted. That is to say, the convey belt 11 is rotated reversely from the condition shown in FIG. 42 by a distance corresponding to the sheet interval $L_3$, thereby feeding the first original 5A back (refer to FIG. 43). By adjusting the feeding amount of the first original in this case, the interval between the first and second originals 5A and 5B is adjusted. An operator can set the reverse feeding optionally by an external input means.

When the reverse feeding operation is finished, the first and second originals 5A, 5B are both set on the predetermined image reading areas on the platen glass 6 by the paired regist rollers 10 and the convey belt 11, and then the reading of the information is effected. After the reading, the first and second originals 5A, 5B are left from the platen glass 6 and are discharged onto the discharge tray of the apparatus by the discharge rollers 12.

Figure 42:
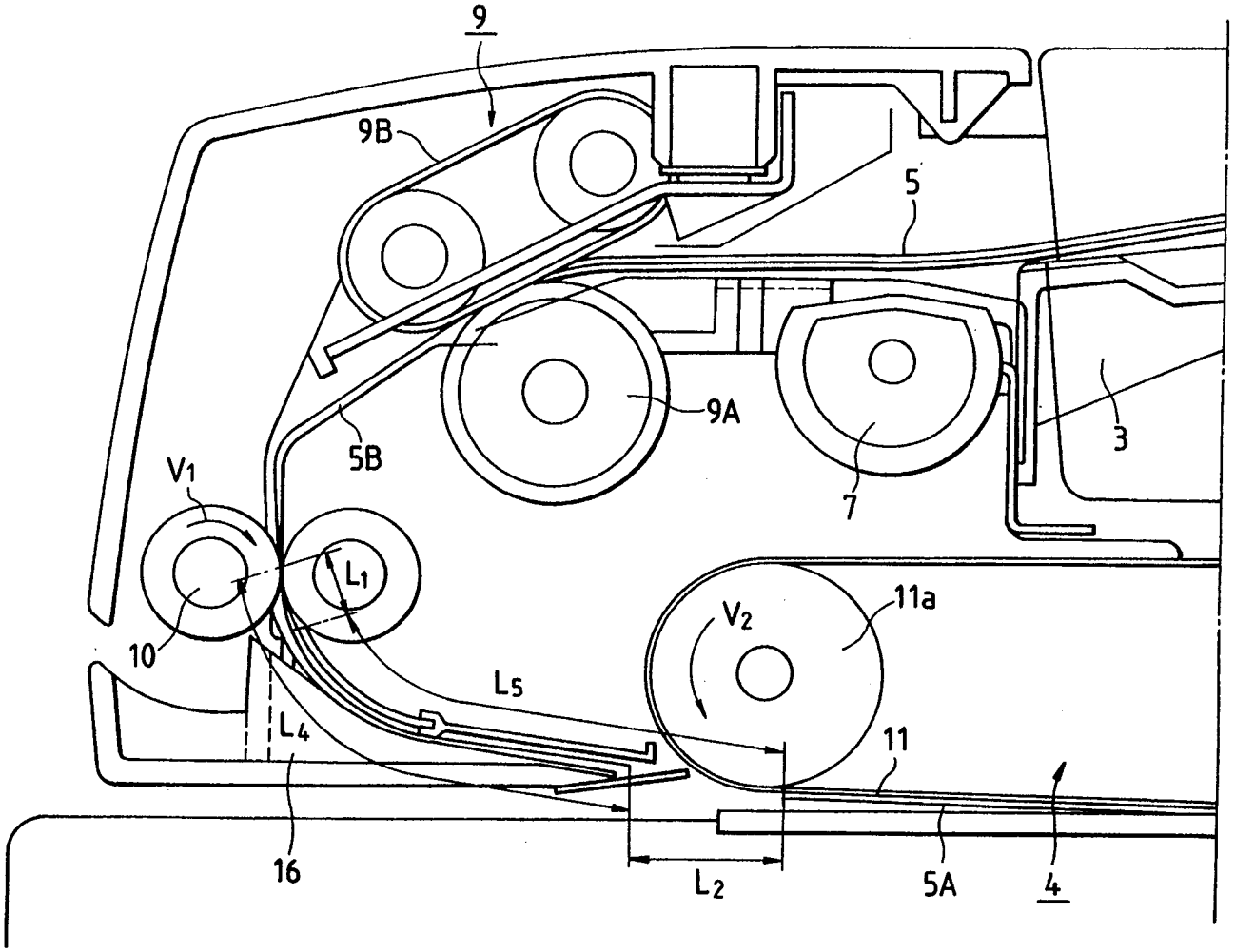
FIG. 42 is a detailed view for explaining the operation of the apparatus of FIGS. 2A to 2D (particularly FIG. 2C)

In this apparatus, as mentioned above, by adjusting the reverse feeding amount of the first original 5A in the condition shown in FIG. 42, the interval between the first and second originals 5A, 5B is adjusted.

Now, a method for feeding back the first original 5A to make the sheet interval zero will be explained. Incidentally, in this apparatus, as mentioned above, the feeding speed of the paired regist rollers 10 is $V_1$, the feeding speed of the convey belt 11 is $V_2$ and the relation $V_1<V_2$ is maintained. Further, in the condition shown in FIG. 41, the interval between the trailing end of the first original 5A and the leading end of the second original 5B is $L_1$.

In FIG. 42, when the distance that the original 5B is fed by the paired regist rollers 10, i.e., a distance between the nip of the paired regist rollers 10 and the leading end of the original 5B is $L_4$, a time t required for such feeding will be as follows:

$$t=L_4/V_1 \tag{1}$$

Further, when the distance that the original 5A is fed by the convey belt 11, i.e., a distance between a point spaced apart from the nip of the paired regist rollers 10 by the distance $L_1$ and the trailing end of the original 5A is $L_5$, the distance $L_5$ will be as follows:

$$L_5=V_2\cdot t=V_2\cdot(L_4/V_1) \tag{2}$$

Accordingly, the distance between the nip of the paired regist rollers 10 and the trailing end of the original 5A becomes $L_1+L_5$.

Therefore, the distance between the trailing end of the original 5A and the leading end of the original 5B in the condition shown in FIG. 42 becomes as follows:

$$\begin{aligned} L_2 &= (L_1 + L_5) - L_4 \\ &= \{L_1 + V_2 \cdot (L_4/V_1)\} - L_4 \end{aligned} \tag{3}$$

Figure 44:
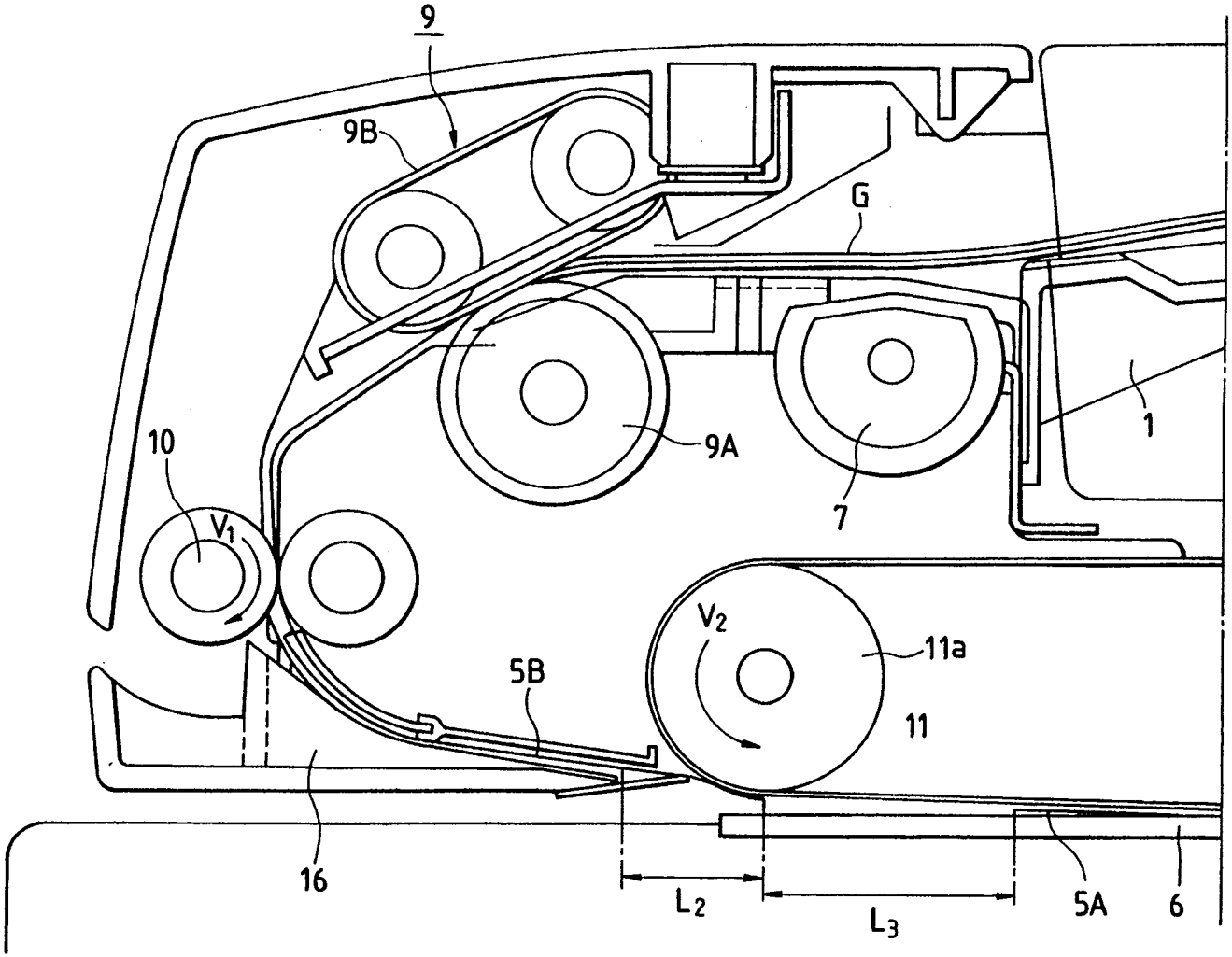

When the feeding of the originals is effected again in the condition shown in FIG. 42, as shown in FIG. 44, since the distance until the leading end of the original 5B reaches the nip of the convey belt 11 and the platen glass corresponds to the distance $L_2$, and the time required for this feeding is T, the following relation can be obtained:

$$T=L_2/V_1 \tag{4}$$

In this case, when a distance that the original 5A is fed by the convey belt 11 by the time T is $L_3$, the following relation can be obtained:

$$L_3=V_2\cdot T=V_2\cdot(L_2/V_1) \tag{5}$$

This distance $L_3$ corresponds to a distance (interval) between the trailing end of the original 5A and the leading end of the original 5B, which is maintained on the platen glass 6.

Figure 43:
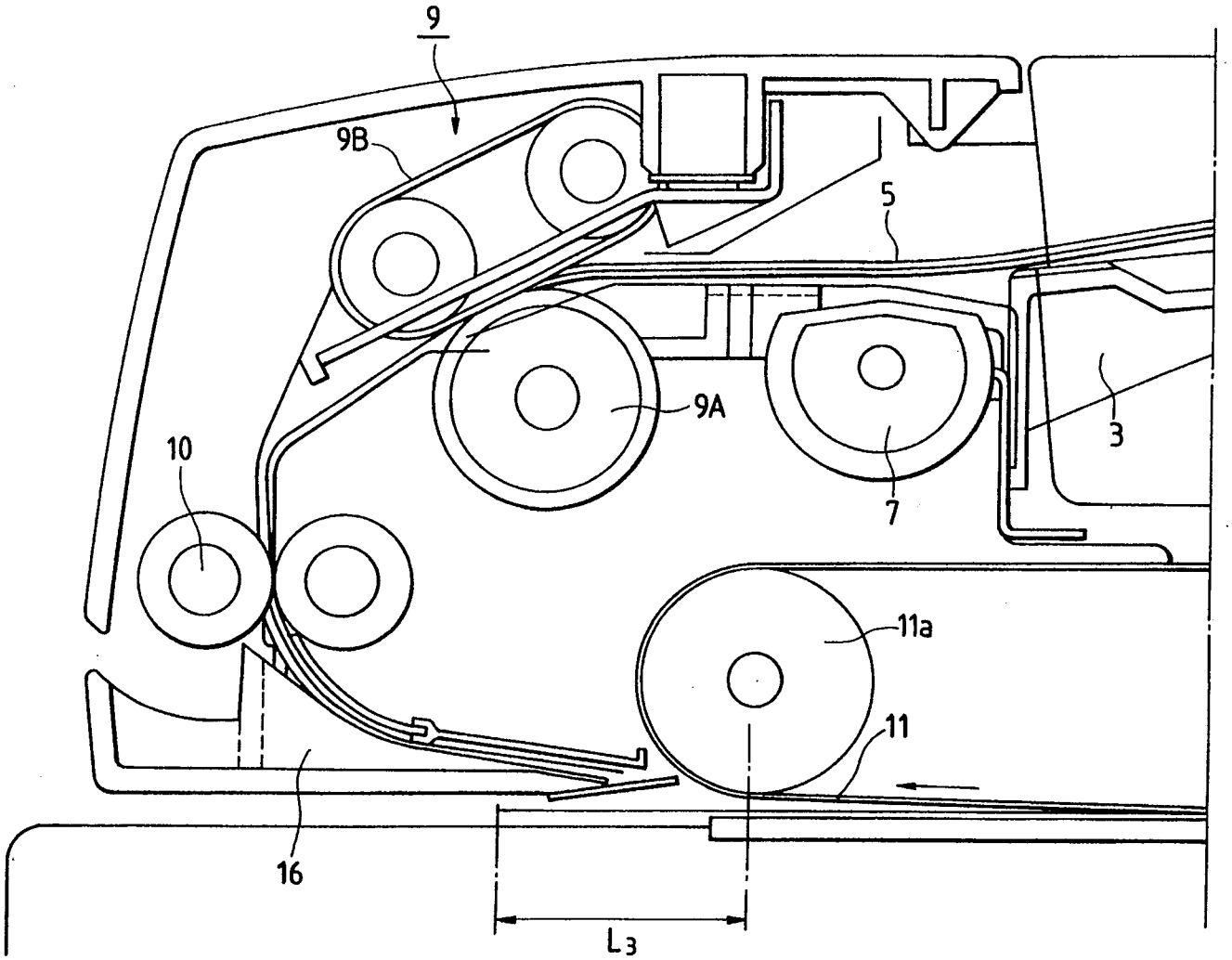
FIGS. 43 and 44 are detailed views for explaining the operation of the apparatus of FIGS. 2A to 2D.

Accordingly, as shown in FIG. 43, when the trailing end of the original 5A is returned back by the distance $L_3$, the distance $L_3$ between the trailing end of the original 5A and the leading end of the original 5B on the platen glass will become zero.

Therefore, from the above formula (5), the following relation is obtained:

$$L_3=\{L_1+(V_2/V_1)\cdot L_4-L_4\}\cdot V_2/V_1 \tag{6}$$

Thus, by determining the feeding speed $V_1$ of the paired regist rollers 10, the feeding speed $V_2$ of the convey belt 11 and the distances $L_1$, $L_4$, the distance $L_3$ which corresponds to the return amount of the original can be obtained. Incidentally, the distances $L_1$, $L_4$ are determined by the count timers. Therefore, since the time when the original is restrained by the regist rollers 10 is varied according to the original size, the distance $L_3$ is adjusted in consideration of such restrained time. Since the longer the original size the longer the restrained time, the distance $L_3$ should be longer.

Next, a movement of a copy sheet will be explained. At the same time, a relation of the copy sheet and an stapling system will also be explained.

Figure 19:
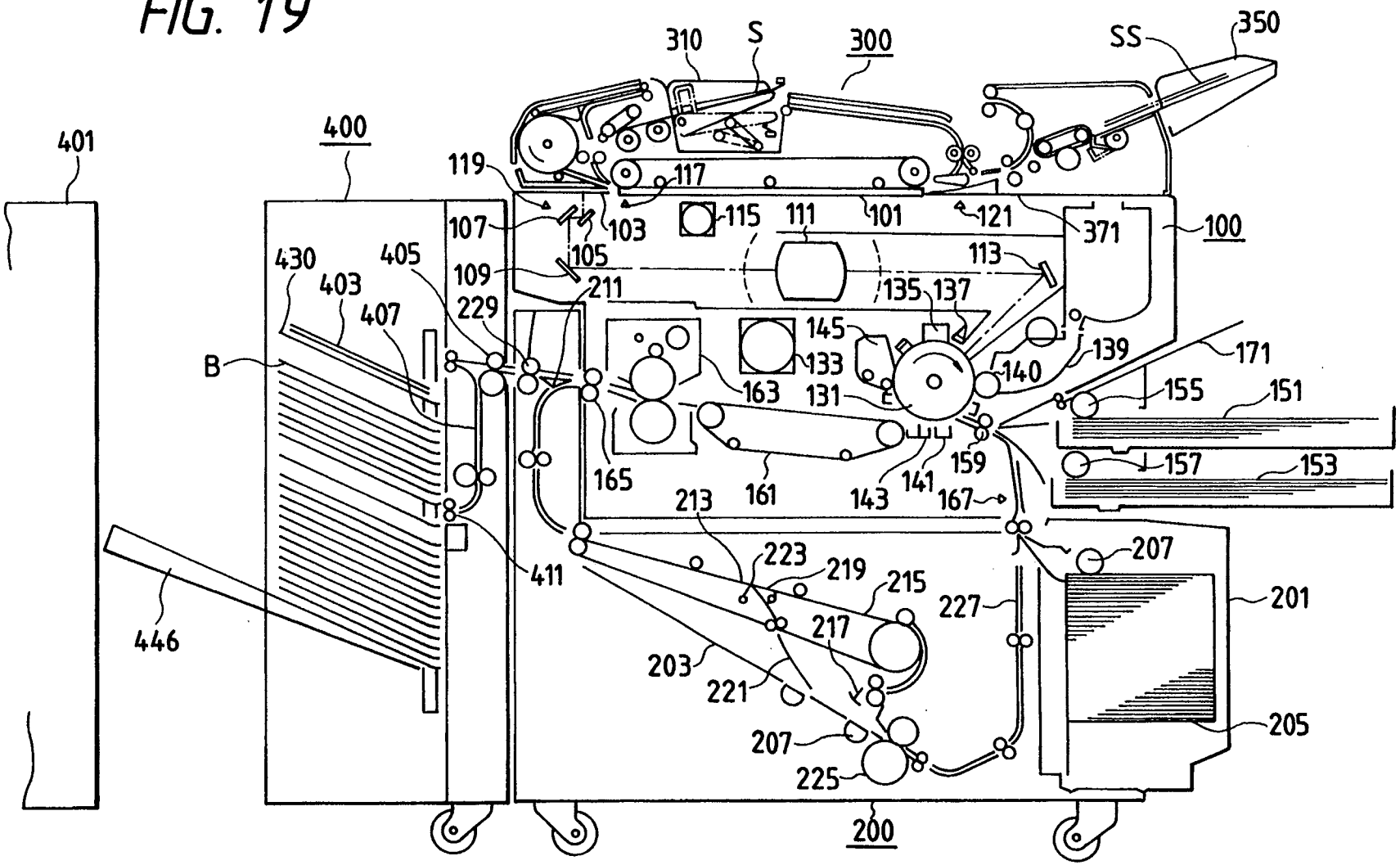
FIG. 19 is an elevational sectional view of an image forming apparatus according to a further embodiment, in relation to a stapling system.

A. Apparatus body (100):

In an apparatus body 100 shown in FIG. 19, there are arranged a platen glass 101 on which originals are set, an illuminating lamp (exposure lamp) 103 for illuminating the original, scan mirrors 105, 107, 109 for changing a light path to the original, a lens 111 having a focusing and magnifying function, and a fourth reflection mirror (scan mirror) 113 for changing the light 10 path to the original. Further, there are arranged an optical system motor 115 for driving the optical system, and sensors 117, 119, 121.

The reference numeral 131 denotes a photosensitive drum; 133 denotes a main motor for driving the photosensitive drum 131; 135 denotes a high voltage unit; 137 denotes a blank exposure unit; 139 denotes a developing device; 140 denotes a developing roller; 141 denotes a transfer charger; 143 denotes a separation charger; and 145 denotes a cleaning device.

The reference numeral 151 denotes an upper cassette; 153 denotes a lower cassette; 171 denotes a manual sheet insertion inlet; 155 and 157 denote sheet supply rollers; and 159 denotes regist rollers. Further, the reference numeral 161 denotes a convey belt for conveying the sheet on which the image was recorded toward a fixing device; 163 denotes the fixing device where the image is fixed to the sheet with heat and pressure; and 167 denotes a sensor used in a both-sided copying operation.

A surface of the photosensitive drum 131 comprises a seamless photosensitive body made of photoconductive material and conductive material, and the drum is rotatably supported so that it is rotated in a direction shown by the arrow by the main motor 133 when a copy start key (described later) is depressed. When the predetermined rotation control and potential control process is finished, the originals set on the platen glass 101 are illuminated by the illuminating lamp 103 formed integrally with the first scan mirror 105, with the result that the light reflected from the originals passes through the first scan mirror 105, second scan mirror 107, third scan mirror 109, lens 111 and fourth scan mirror 113, and is focused on the drum 131.

The drum 131 is corona charged by the high voltage unit 135. Thereafter, the drum is slit-exposed by the light images (original images) illuminated by the illuminating lamp 103, thereby forming an electrostatic latent image on the drum 131 in a conventional Carlson manner.

Then, the electrostatic latent image on the photosensitive drum 131 is developed by the developing roller 140 of the developing device 139, thus visualizing the latent image as a toner image. The toner image is transferred onto the copy sheet or transfer sheet by the transfer charger 141, as will be described later.

That is to say, the transfer sheet from the upper cassette 151 or lower cassette 153 or from the manual sheet insertion inlet 171 is supplied into the apparatus by the sheet supply roller 155 or 157, and then is fed toward the photosensitive drum 131 at the proper timing given by the regist rollers 159 so that a tip end of the latent image is aligned with a leading end of the transfer sheet. Thereafter, while the transfer sheet is being passed between the transfer charger 141 and the drum 131, the toner image on the drum 131 is transferred onto the transfer sheet.

After the transferring operation, the transfer sheet is separated from the drum 131 by the separation charger 143, and then is directed, by the convey belt 161, to the fixing device 163 where the transferred image is fixed to the transfer sheet with heat and pressure. Then, the transfer sheet is discharged onto a discharge tray 430 out of the apparatus body 100 by the discharge rollers 165.

After the transferring operation, the drum 131 continues to rotate; meanwhile, the surface of the drum is cleaned by the cleaning device 145 comprising a cleaning roller and a cleaning blade.

B. Pedestal (200):

A pedestal 200 shown in FIG. 19 can be separated from the apparatus body 100 and has a deck 201 capable of containing 2,000 transfer sheets, and an intermediate tray 203 for the both-sided copying operation. A lifter 205 for the deck 201 capable of containing 2,000 transfer sheets is lifted according to the amount of the transfer sheets so that the uppermost transfer sheet can always be urged against a sheet supply roller 207. Further, the reference numeral 211 denotes a sheet discharge flapper for switching a sheet path between the both-sided copying or multi copying path and the sheet discharge path; 213 and 215 denote sheet paths on the convey belt; and 217 denotes intermediate tray weight for holding down the transfer sheets. The transfer sheet is turned over by the sheet discharge flapper 211 and the sheet paths 213, 215 and is rested on the intermediate tray 203.

A multi flapper 219 for switching between the both-sided copying path and the multi copying path is arranged between the sheet paths 213, 215, so that, when the flapper is rotated upwardly, the transfer sheet is directed to the multi copying path 221. A multi sheet discharge sensor 223 serves to detect the end of the transfer sheet passing through the multi flapper 219. A sheet supply roller 225 serves to supply the transfer sheet toward the drum 131 through a sheet path 227. Sheet discharge rollers 229 serve to eject the transfer sheet out of the apparatus.

In the both-sided recording (both-sided copying) and the multi recording (multi copying), first of all, the sheet discharge flapper 211 in the body 100 is rotated upwardly so that the copied transfer sheet is collected on the intermediate tray 203 through the sheet paths 213, 215. In this case, in the both-sided recording, the multi flapper 219 is 10 lowered, whereas, in the multi recording, the multi flapper 219 is lifted. The intermediate tray 203 can receive the copied transfer sheets, for example, up to 99 sheets. The transfer sheets collected on the intermediate tray 203 are held down by the intermediate tray weight 217.

When the both-sided recording or the multi recording is effected, the transfer sheets collected on the intermediate tray 203 are directed one by one to the regist rollers 159 in the body 100 through the path 227 by the action of the sheet supply roller 225 and the weight 217.

Figure 21:
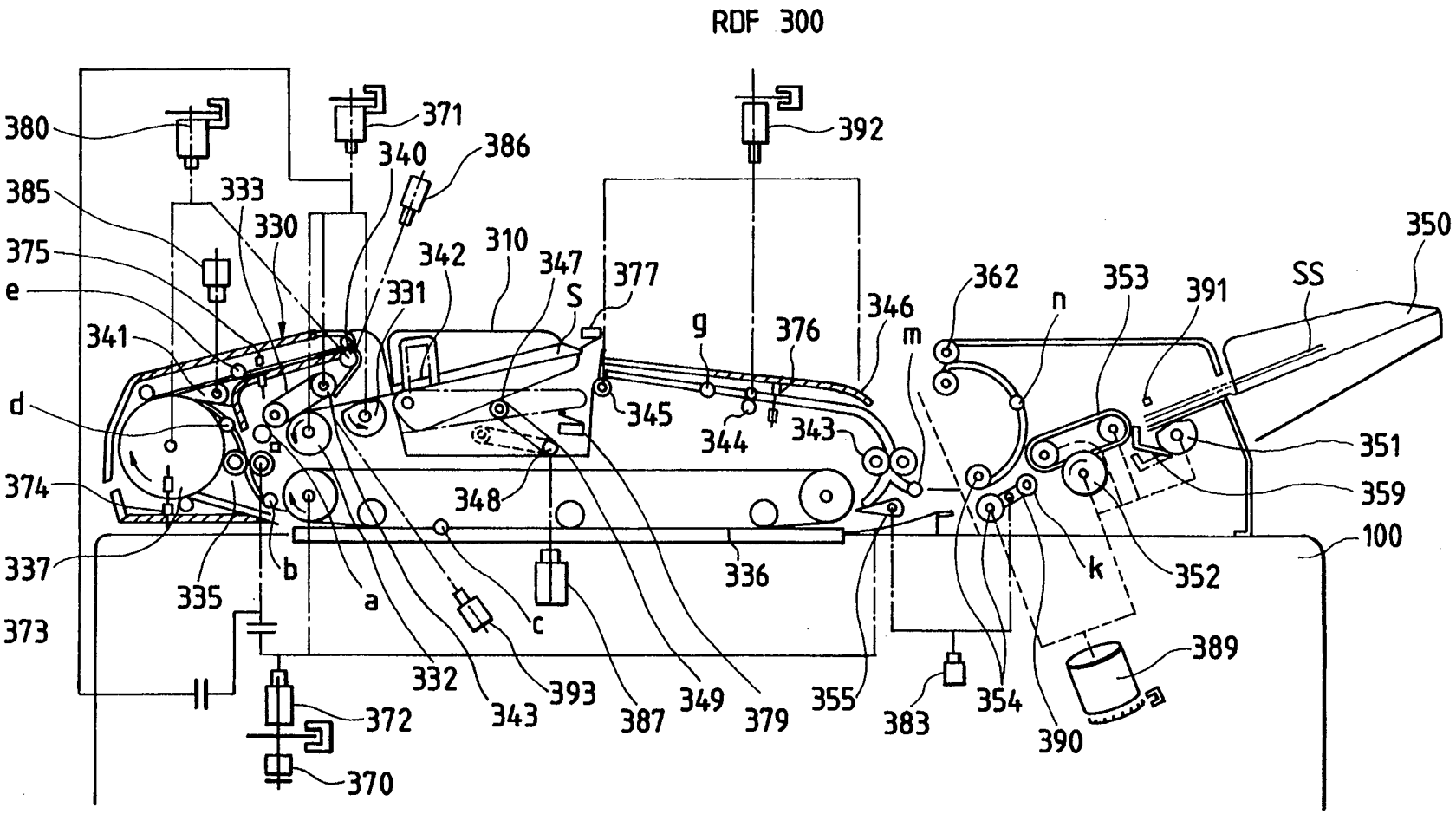
FIG. 21 is a sectional side view of an automatic original feeding apparatus incorporated into the apparatus of FIG. 19.

C. RDF (Recirculating Automatic Original Feeding Apparatus) (300):

As shown in FIG. 21 in detail, the RDF 300 comprises a stacking tray (first original tray) 310 for stacking an original stack S, and a stacking tray (second original tray) 350 for stacking an original stack SS. Although the construction of this apparatus differs from that shown in FIG. 1, the 2 in 1 control can be effected in the similar manner to that of FIG. 1.

Further, a sheet supply mechanism constituting a portion of an original supply means is arranged at a side of the stacking tray 310. The sheet supply mechanism comprises a semi-circular roller 331, a separation and feed roller 332, a separation belt 333, a separation motor SPRMTR, regist rollers 335, a whole surface belt 336, a belt motor BELTMTR, a large convey roller 337, a convey motor FEEDMTR, sheet discharge rollers 340, a flapper 341, a recycle lever 342, a sheet supply stopper 343, a sheet supply sensor ENTS, an inversion sensor TRNS, and a sheet discharge sensor EJTS.

The semi-circular roller 331, separation and feed roller 332, and separation belt 333 are rotated by the separation motor SPRMTR 393 so that the originals in the original stack S on the stacking tray 310 are separated one by one from the lowermost one.

Further, the regist rollers 335 and the whole surface belt 336 are rotated by the belt motor BELTMTR 372 so that the separated original is fed to the exposure station (sheet path c) on the platen glass 101 through sheet paths a and b. Further, the large convey roller 337 is rotated by the convey motor FEEDMTR 380 so that the original on the platen glass 101 is fed from the sheet path c to a sheet path e. The original fed into the sheet path e is returned onto the original stack S on the stacking tray 310 by the discharge rollers 340.

Furthermore, the recycle lever 342 serves to detect one circulation of the original. At the beginning of the original supply operation, the recycle lever 342 is rested on the original stack S. When the recycle lever is dropped by its own weight after the trailing end of the last original leaves the lever, one circulation of the original is detected.

In the sheet supply means 330, regarding the both-sided originals, the original is temporarily directed from the sheet paths a, b to the sheet path c, and then the large convey roller 337 is rotated to direct the leading end of the original to a sheet path d by changing the flapper 341 to a position shown by the broken line in FIG. 3, and then the original is passed through the sheet path b by the regist rollers 335. Thereafter, the original is fed to the platen glass 101 and is stopped there by the whole surface belt 336. In this way, the original is inverted or turned over. That is to say, the original is turned over while it is being passed through the sheet paths c -d -b.

Incidentally, by feeding each original of the original stack S through the sheet paths a - b - c - d - e until one circulation of the original is detected by the recycle lever 342, it is possible to count the number of the originals.

Further, at the right of the sheet supply means 330 in the body 100, there is disposed a second original discharge path (sheet path g) for discharging the read original on the platen glass 101 toward a direction opposite to the original feeding direction to the platen glass 101 and for returning the original onto the original stack S on the stacking tray 310. First and second convey rollers 343, 344 for conveying the original are disposed in the sheet path g, and, further, a second sheet discharge roller 345 is disposed at a downstream side of the sheet path g so that the original conveyed through the sheet path g is returned onto the original stack S on the stack tray 310.

An original discharge cover 346 is disposed above the sheet path g, and a third original discharge path (sheet path m) branched to a sheet path n in the vicinity of the downstream end of the whole surface belt 336 is formed. A switching flapper 355 is disposed at a junction between the sheet paths c and m, so that, by rocking the flapper between a position shown by the solid line and a position shown by the broken line by ON/-OFF of a sheet discharge flapper solenoid 383, the sheet paths are switched. Third sheet discharge rollers 362 are arranged at a downstream side of the sheet path n, thereby discharging the original fed through the sheet path n onto the original discharge cover 346. A second sheet discharge sensor 376 comprising an optical sensor of a permeable type for detecting the leading and trailing ends of the original in the sheet path is arranged in the sheet path g.

At the right side of the RDF 300, there is an original inlet path (sheet path 1) for receiving the original into the RDF from the outside, and a sheet path connecting the sheet path 1 with the sheet path g.

Next, the rocking movement of the original tray or stacking tray 310 will be explained. A motor output shaft of a tray rock motor 387 is connected to a tray rock arm shaft 348. A tray rock roller 347 is arranged at an end of a tray rock arm 349, and the other end of the tray rock arm 349 is secured to the tray rock arm shaft 348 so that the tray rock arm 347 can be rocked between a position shown by the solid line and a position shown by the broken line by the rotation of the tray rock arm shaft 348, thereby rocking the original tray 310 around a pivot center thereof between a position shown by the solid line and a position shown by the broken line.

An upper limit switch 377 serves to detect the fact that the original tray 310 reaches the upper position (position shown by the solid line), and a lower limit switch 379 serves to detect the fact that the original tray 310 reaches the lower position (position shown by the broken line). The rotation of the tray rock motor 387 is controlled by the detection of the upper and lower limit switches.

Further, a sheet supply mechanism constituting the other portion of the original supply means is arranged at a side of the stacking tray 350. The sheet supply mechanism comprises a semi-circular roller 351, a separation and feed roller 352, a separation belt 353, regist rollers 354, a convey motor 389, a sheet supply stopper 359, a subscription sheet supply sensor RENTS, an original detection sensor REMPS, and discharge rollers 362.

When the convey motor 389 is turned ON, the semi-circular roller 351, separation and feed roller 352, and separation belt 353 are rotated to separate the originals of the original stack SS on the stacking tray 350 one by one from the lowermost one. Further, when the regist rollers 354 are rotated by the convey motor 389 and the whole surface belt 336 is rotated by the belt motor 372, the original separated from the original stack SS can be fed to sheet paths k and c.

Incidentally, when the whole surface belt 336 is rotated normally by the normal rotation of the belt motor 372, and the discharge rollers 362 are rotated reversely by the reverse rotation of the convey motor 389, the original on the platen glass 101 can be ejected onto the upper cover 346 through the sheet paths c and n.

Figure 20:
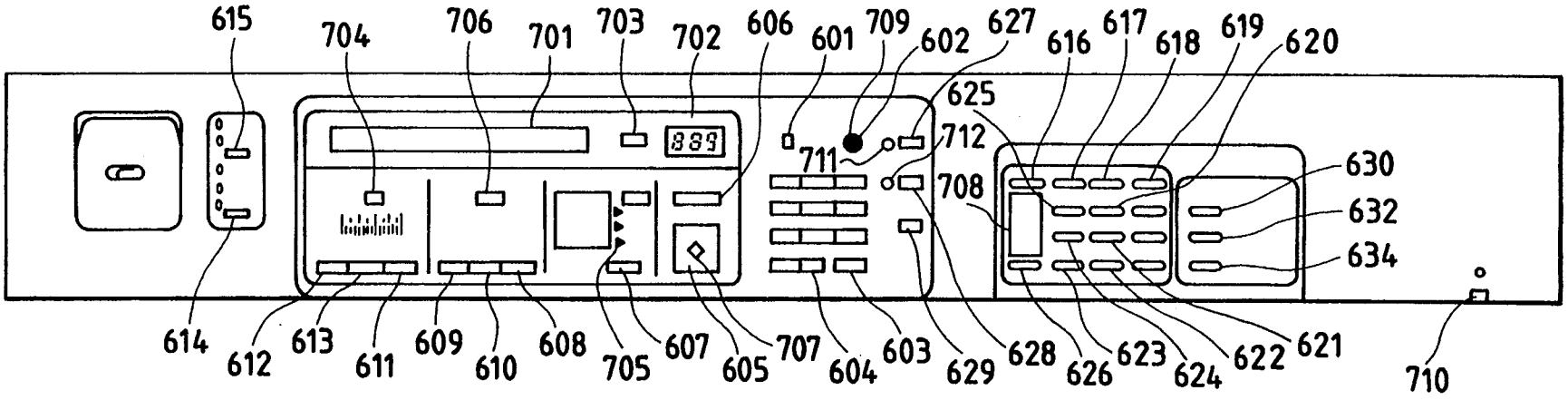
FIG. 20 is a plan view of operation and display portions of the apparatus of FIG. 19.

FIG. 20 shows the arrangement of an operation panel provided on the body 100. The operation panel includes a group of keys 600 and a group of displays 700 which will be described later.

Figure 23:
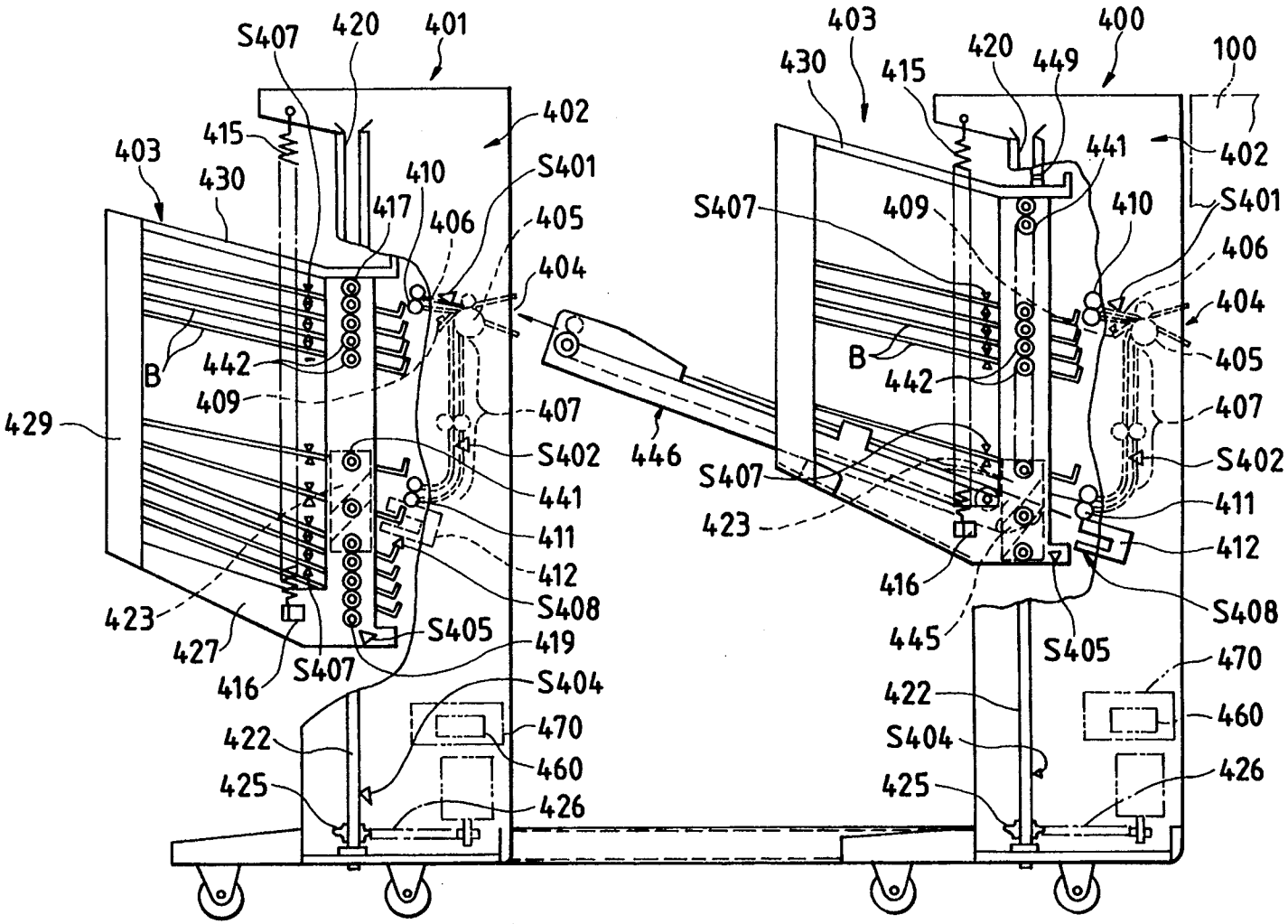
FIG. 23 is a sectional side view of a sheet post-processing device incorporated into the apparatus of FIG. 19.
Figure 24:
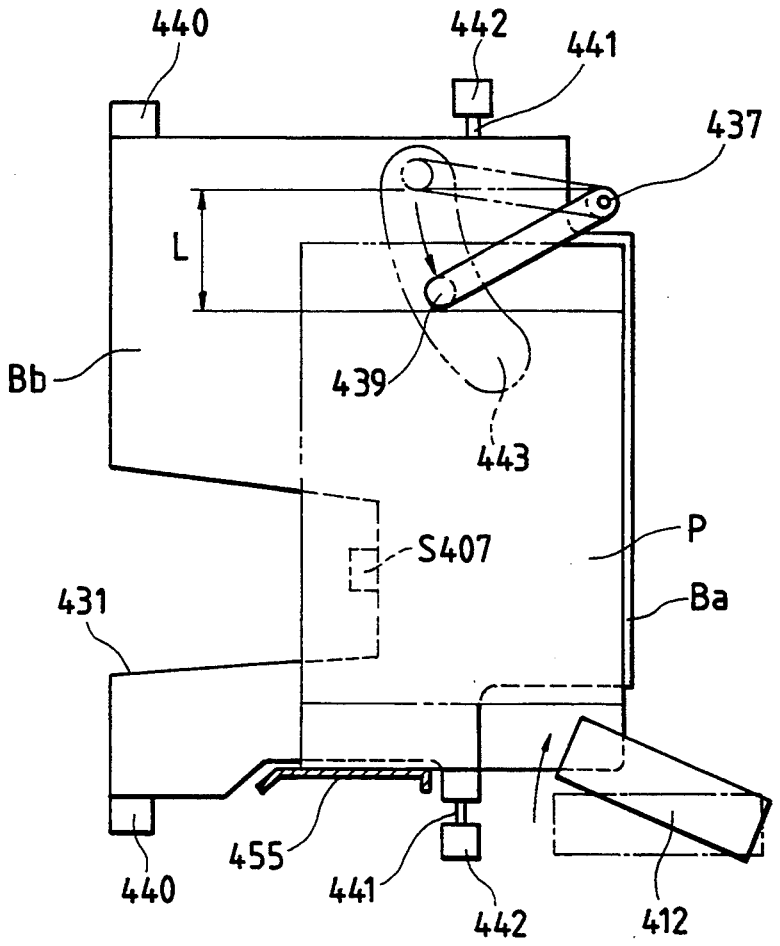
FIG. 24 is a partial plan view of the sheet post-processing device of FIG. 23.
Figure 25:
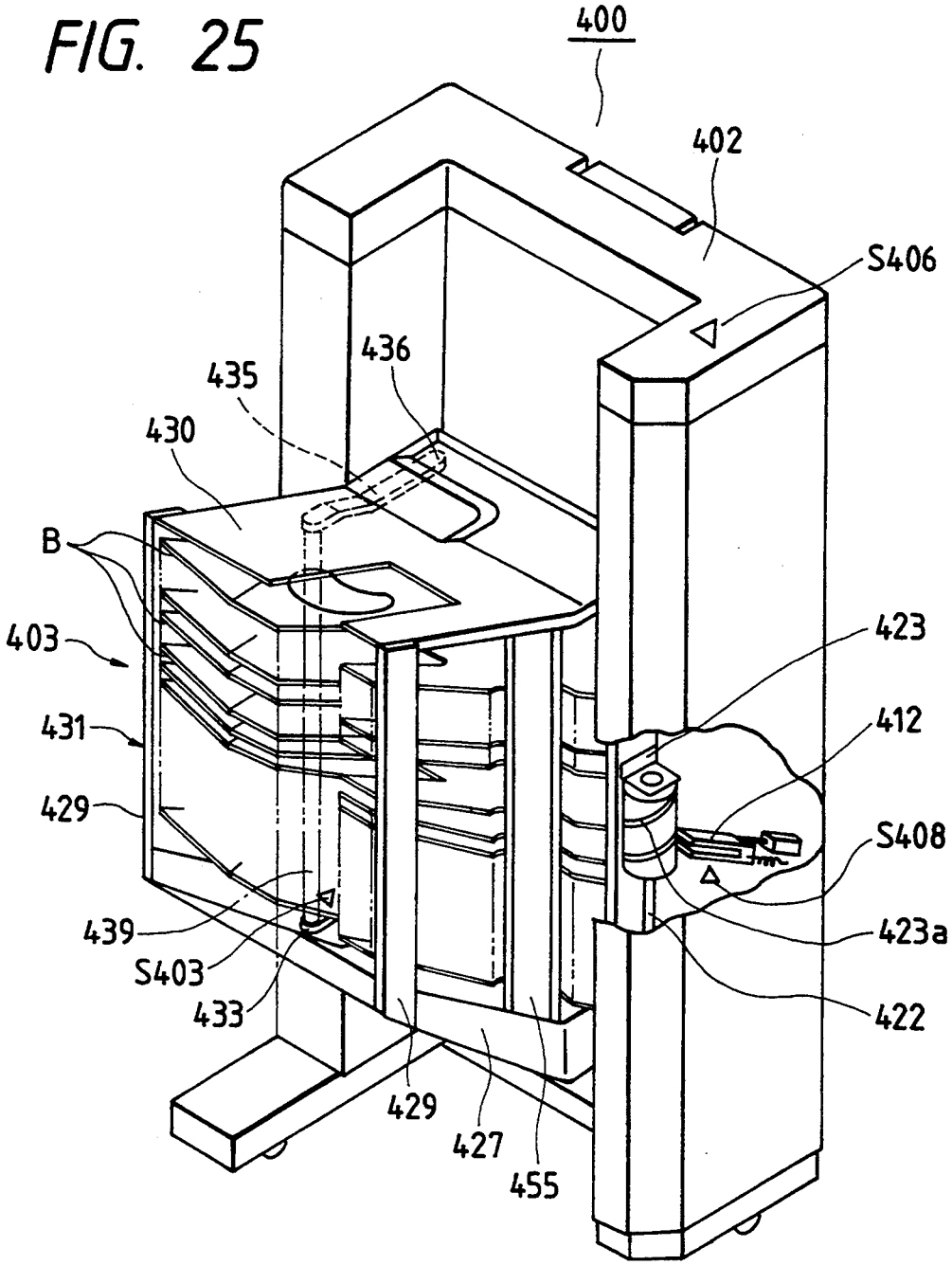
FIG. 25 is a partial perspective view of the sheet post-processing device of FIG. 23.

D. Sheet Post-process Device (400):

A sorter will be described with reference to FIGS. 23 to 25. In FIGS. 23 to 25, sorters 400, 401 each comprises a frame 402 and a bin unit, and the frame 402 is provided with a pair of feed-in rollers 405 in the vicinity of a feed-in inlet 404. A flapper 409 for switching a sheet feeding direction between a convey path 406 and a convey path 407 is disposed at a downstream side of the paired feed-in rollers 405. The convey path 406 extends horizontally and a pair of convey rollers 410 are disposed at a downstream side of the convey path 406. On the other hand, the other convey path 407 extends downward and a pair of convey rollers 411 are disposed at a downstream side of the convey path 407. Further, a stapler 412 is disposed in the vicinity of the paired convey rollers 411.

Figure 26:
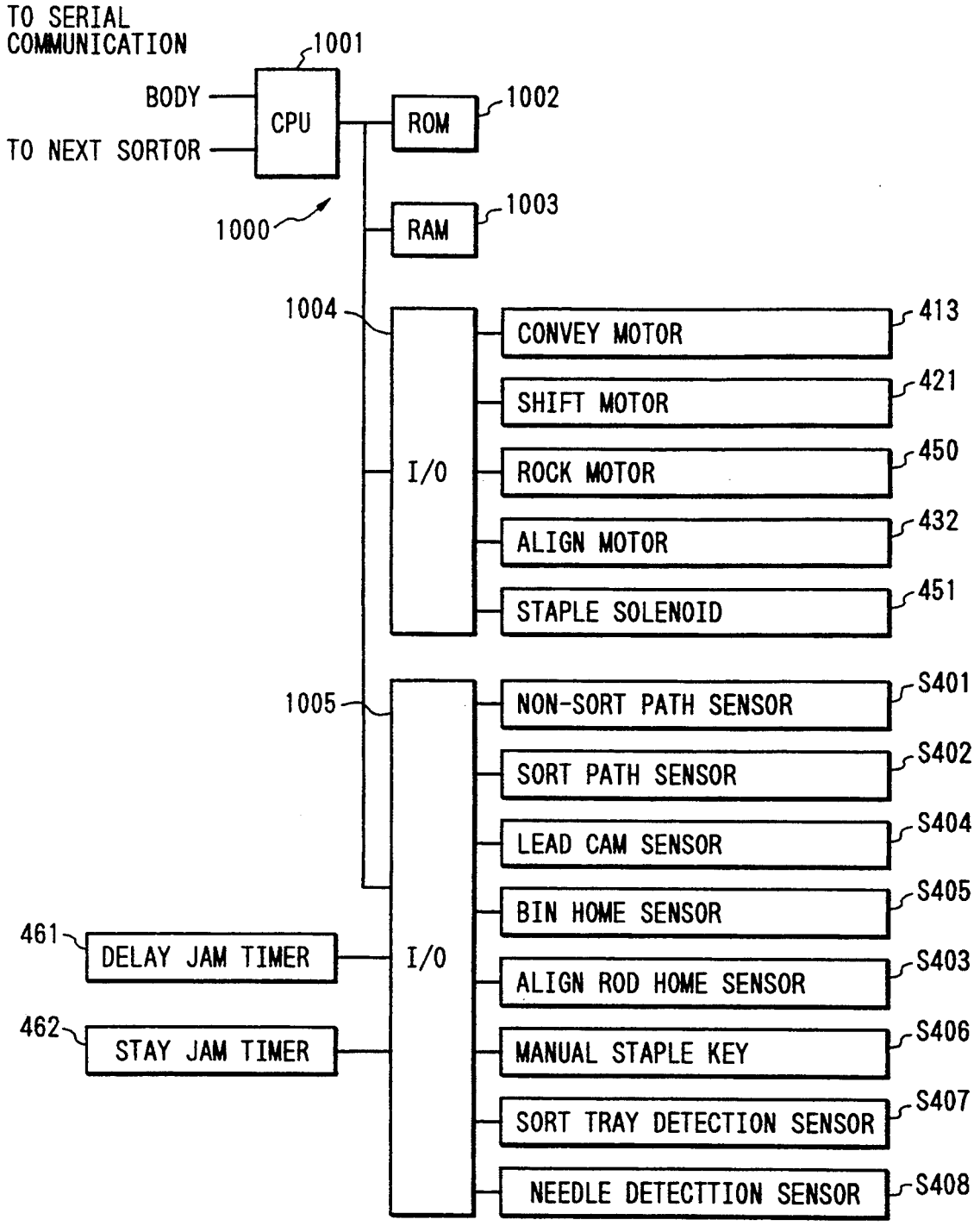
FIG. 26 is a block diagram of the sheet post-processing device of FIG. 19.

The feed-in rollers 405 and the paired convey rollers 410, 411 are driven by a convey motor 413 (FIG. 26). A non-sort path sensor S401 is disposed in the convey path 406, and a sort path sensor S402 is disposed in the convey path 407. Further, at a downstream side of the paired convey rollers 410, 411, there is arranged a bin unit 403 having a plurality of bins B. The bin unit is supported for lifting and lowering movements by holding the weight of the unit by means of a spring 415 having one end engaged by a hook 416 of the bin unit 403 and the other end secured to the frame 402.

Guide rollers 417, 419 are rotatably mounted at upper and lower portions of a base end of the bin unit. These guide rollers can be rolled in a vertical guide groove 420 formed in the frame 402 to guide the bin unit in an up-and-down direction. Further, a shift motor 421 is arranged on the frame 402. A lead cam 423 and a sprocket 425 is secured to a rotary shaft 422 rotatably mounted on the frame 402. A chain 426 is wound around and extends between the sprocket 425 and an output shaft of the shift motor 421 so that the rotation of the motor 421 is transmitted to the rotary shaft 422 via the chain 426.

Further, the bin unit has a unit body 431 comprising a bottom frame 427 having an inclined portion and a vertical portion, and a cover 430 supported by a pair of frames 429 formed uprightly on the bottom frame 427 at this and that sides thereof. A reference plate 455 capable of abutting against the sheets P (FIG. 24) to register them is arranged at this side of the unit body 431. Further, a lower arm 433 rotated by an align motor 432 is rotatably mounted on the bottom frame 427 at that side of a base end thereof (FIG. 25). Further, an upper arm 435 is secured to a rotary shaft 436 rotatably supported by the cover 430 at a position opposed to the lower arm 433, and the upper and lower arms 435, 433 can be pivoted around a shaft 437.

Further, a free end of the upper arm 435 and a free end of the lower arm 433 are interconnected by an align rod 439 which can be rocked by the align motor 432. The align motor 432 comprises a stepping motor so that the position of the align rod 439 can be corrected controlled by the number of pulses applied to the stepping motor. In addition, an align rod home sensor S403 serves to detect the position of the align rod 439, and the position of the align rod 439 is controlled by the align rod home sensor S403 and the number of pulses applied to the align motor 432.

As shown in FIG. 24, the bin B is provided with engagement plates 440 at this and that sides near the free end thereof. The free end of the bin B is supported by engaging the engagement plates 440 by support plates (not shown) provided on inner surfaces of the frames 429. Further, support shafts 441 are secured to the bin B at either side of a base end portions thereof, and rollers 442 are rotatably mounted on the support shafts 441, respectively.

Further, an elongated slot 443 is formed in the bin B at a position spaced apart from the shaft 437 by a predetermined distance, where the slot has a length greater than a rocking distance of the align rod 439 and a width sufficiently wider than a width or diameter of the align rod 439. The base end Ba of the bin B is bent perpendicular to a sheet receiving Bb of the bin. Each bin B is inclined by a predetermined angle with respect to the frame 402 with the free end being lifted more than the base end, so that the sheets P received on the bin can be slid along the inclined surface Bb of the bin until trailing ends of the sheets are abutted against the base end Ba, thereby aligning the sheets with each other.

The align rod 439 is received in the elongated slots 443 of the bins B1, B2, . . . and is rocked along the slots 443, thus abutting the sheets P against the reference plate 455 to register the sheets. Further, the lead cam 423 has a spiral groove 423a having a width slightly greater than the diameter of the roller 442 and receiving the roller 442, so that it can be lifted or lowered along the groove 423*a* by the rotation of the lead cam 423. Incidentally, one revolution of the lead cam 423 is detected by a lead cam sensor S404 disposed in the vicinity of the lead cam 423. Further, the position of the bin unit 403 is detected by a bin home position sensor S405.

Two series of stays 445 are arranged below the lowermost bin B. These stays 445 rotatably receive the roller 442 and can support two series of path units 446. The two series of path units 446 serve to feed the sheets P to the second sorter 401. By shifting the two series of path units 446 to a position opposed to the paired rollers 411 of the second sorter 401 by the rotation of the lead cam 423 and by feeding the sheets P by a two series pulse motor (not shown), the sheets P discharged from the body 100 of the image forming apparatus can be fed to the second sorter.

Incidentally, in the non-sort mode, the sheets P are discharged onto the non-sort tray 430 arranged below the lowermost bin B, and the presence of the sheet in the non-sort tray 430 is detected by a non-sort tray sheet presence detection sensor S409.

The presence of the sheets P on the sort bins B is detected by sort tray sheet presence detection sensors (sheet post-process position selection means) S407.

Further, the staplers 412, 480 are electrically operated. These staplers are driven by rock motors 450, 481 to be shifted toward a direction shown by the arrow (FIG. 24) to reach a position shown by the solid line, and needles (staples) are driven by solenoids 440, 482. Thereafter, the staplers are retarded by the rock motors 450, 481 to return to a position shown by the phantom line in FIG. 24.

Incidentally, the stapler 480 can be shifted in both directions in accordance with the size of the discharged sheet so that the staples can be driven in the end portion of various transfer sheets. The selection of the staplers 412, 480 will be described later.

In this way, the staplers 412, 480 staple the sheets P in the bin B, and then the bin B is shifted by the shift motor 421 by a distance between the bins, and then the sheets P in the next bin B are stapled. Incidentally, when a manual staple key S406 is depressed after the sorting operation, the stapling operation is started.

E. Key Group (600)

In FIG. 20, an asterisk (*) key is shown by 601. An all reset key 606 is depressed when a standard mode is to be restored. A pre-heat key is shown by 602. A copy start key 605 is depressed when the copying operation is to be started. A clear stop key is shown by 604. Ten key 603 is depressed when the number of copies are set. Memory keys are shown by 619. Copy density keys are shown by 611, 612. An AE key is shown by 613. A same magnification key is shown by 610. An auto variable magnification key is shown by 616. Zoom keys are shown by 617, 618. Fixed form variable magnification keys are shown by 608, 609.

A both-sided copy key is shown by 626. A staple margin key is shown by 625. A photo key is shown by 624. A multi copy key is shown by 623. An original frame (border line) erase key is shown by 620. A sheet frame erase key is shown by 621. A page continuous copying key is shown by 622.

A sheet discharge method (staple, sort or group) selection key is shown by 614. A sheet fold selection key is shown by 615. An interruption key is shown by 627. A prescription key is shown by 628. After a copy mode to be registered is set, when a prescription set key 629 is depressed. As a result, the set copy mode is stored in the 805 RAM.

A 2 in 1 mode key 630 is used to select or release a 2 in 1 mode wherein a plurality of originals are set on the platen glass and the images on these originals are copied on a single transfer sheet. A laterally written/vertically written original selection key according to the present invention is shown by 632. By using this key 632, it is possible to select the order of the setting of the plural originals when the 2 in 1 mode is selected by the 2 in 1 mode key 630. Incidentally, when this key 632 is not depressed, the vertically written original is selected.

An odd/even number input key is shown by 634. When the number of originals is odd, this key 634 is depressed, thereby informing the copying machine of the total number of originals.

F. Display Group (700):

In FIG. 20, a message display of LCD (liquid crystal) type is shown by 701. A same magnification display is shown by 706. A color developing device display is shown by 703. A copy number display is shown by 702. A used cassette display is shown by 705. An AE display is shown by 704. A pre-heat display is shown by 709. A both-sided copy display is shown by 708.

Further, a power source lamp is shown by 710. An interruption display is shown by 711. A prescription registration display is shown by 712.

Figure 22:
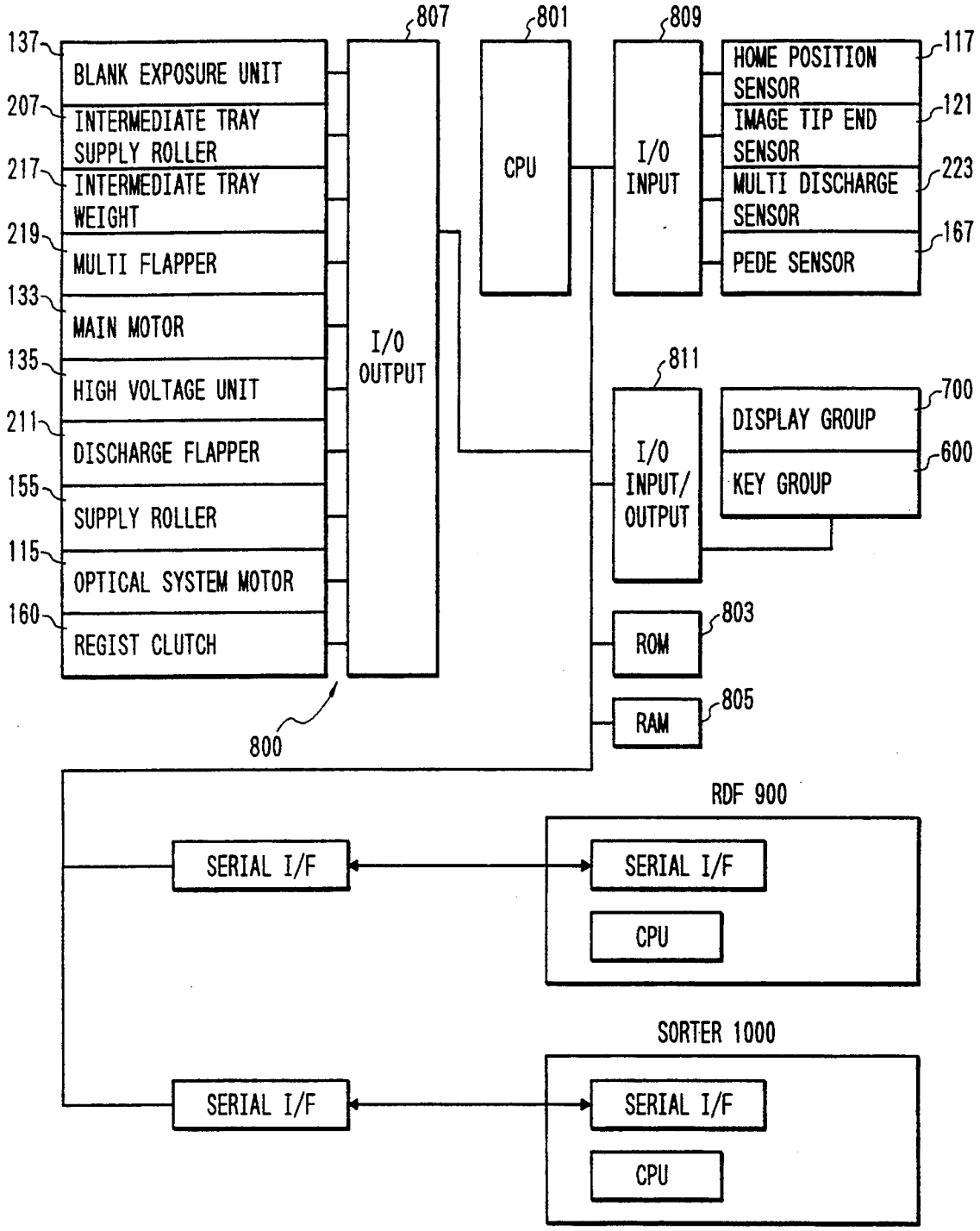
FIG. 22 is a block diagram of a control portion of the apparatus of FIG. 19.

G. Controller (800):

FIG. 22 shows a circuit diagram of a controller 800 according to the embodiment of FIG. 19. In FIG. 22, a CPU (central processing unit) 801 for performing the calculation (operation) control for carrying out the present invention and, for example, comprises a microcomputer V50 manufactured by NEC (National Electric Company) in Japan. The control sequences (control programs) shown in FIGS. 27 and so on are previously stored in a read only memory (ROM) 803, and the CPU 801 controls various devices connected to the CPU via baths, in accordance with the control sequences stored in the ROM. A random access memory (RAM) 805 is a main memory device for storing input data and used as a working memory area.

An interface 807 serves to send control signals from the CPU 801 to the loads such as the main motor 133 and the like, an interface 809 serves to send input signals from the image tip end sensor 121 and the like to the CPU 801, and an interface 811 serves to control the input/output of the key group 600 and the display group 700. The interfaces 807, 809, 811 utilize input-/output circuit ports uPD 825 manufactured by the above NEC, for example.

Further, a conventional communication IC is connected to the CPU via a bath, which communication IC is connected to the communication IC of the RDF and the communication IC of the sorter so that the communication of the control data required for the relative control between the copying machine and the RDF and between the copying machine and the sorter can be effected as needed.

Data sent from the copying machine to the RDF include a sheet supply signal for starting the supply of the originals resting on the RDF, a sheet discharge signal for starting the discharge of the originals set on the glass platen 101, and supply/discharge mode signals for determining the supply mode and the discharge mode of the originals including the prescription originals; whereas, data sent from the copying machine to the sorter include an image forming mode signal, a signal relating to a mode for containing the sheets in the sorters, a sheet size signal, a timing signal, and the like.

H. RDF Controller (900):

FIG. 22 shows a block diagram of the circuitry of the controller 900 of the circulating automatic original feeding apparatus according to the illustrated embodiment. The circuitry is constituted mainly by a one tip microcomputer 901 including ROM, RAM, and the like. Various signals from the various sensors are inputted to input ports of the microcomputer 901, and the various loads are connected to output ports of the microcomputer 9 01 via drivers. Further, the microcomputer is connected to the copying machine via the communication IC 903 for sending and receiving the control data therebetween. The data sent from the RDF to the copying machine include a sheet supply completion signal indicating the completion of the supply of the originals onto the platen glass, and the like.

I. Sorter Controller (1000):

As shown in FIG. 26, the sorter has a controller 1000 having a central calculation processing unit (CPU) 1001, a read only memory (ROM) 1002, a random access memory (RAM) 1003, an output port 1004, and an input port 1005. The control programs are stored in the ROM 1002, and the input data and the working data are stored in the RAM 1003. Various motors such as the 10 above-mentioned shift motor 421 and solenoid drive means are connected to the output port 1004, and the various sensors S401–S408 such as the non-sort path sensor and various switches are connected to the input port 1005. The CPU 1001 controls the various elements connected thereto via the baths, in accordance with the control programs stored in the ROM 1002. Further, the CPU 1001 has the serial interface function to permit the serial communication between the CPU and the CPU of the copying machine, thereby controlling the various elements on the basis of the signals from the copying machine and outputing a drive signal to the next sorter.

The align rod 439 received in the elongated slots 443 of the bins B1, B2, . . . can be rocked along the elongated slots 443 to abut the sheets P against the reference plate 455, thereby aligning the sheets. Further, the lead cam 423 has the spiral groove 423*a* having a width slightly greater than the diameter of the roller 442 so that the roller 442 can be lifted and lowered along the groove 423*a* by the rotation of the lead cam 423. Incidentally, one revolution of the lead cam 423 is detected by the lead cam sensor S404 disposed in the vicinity of the lead cam 423. Further, the position of the bin unit 403 is detected by the bin home position sensor S405.

The two series of stays 445 are arranged below the lowermost bin B. These stays 445 rotatably receive the roller 442 and can support two series of path units 446. The two series of path units 446 serve to feed the sheets P to the second sorter 401. By shifting the two series of path units 446 to the position opposed to the paired rollers 411 of the second sorter 401 by the rotation of the lead cam 423 and by feeding the sheets P by the two series pulse motor 447, the sheets P discharged from the body 100 of the copying machine can be fed to the second sorter.

Incidentally, in the non-sort mode, the sheets P are discharged onto the non-sort tray 430 arranged below the lowermost bin B, and the presence of the sheet in the non-sort tray 430 is detected by the non-sort tray sheet presence detection sensor S409.

The presence of the sheets P on the sort bins B is detected by the sort tray sheet presence detection sensors (sheet post-process position selection means) S407.

Further, the stapler 412 is electrically operated. The stapler 412 is driven by the rock motor 450 to be shifted toward the direction shown by the arrow (FIG. 24) to reach the position shown by the solid line, and the needles (staples) are driven by the solenoid 440. Thereafter, the stapler is retarded from the bin B by the rock motor 450 to return to the position shown by the phantom line in FIG. 24.

In this way, the stapler 412 staples the sheets P in the bin B, and then the bin B is shifted by the shift motor 421 by the distance between the bins, and then the sheets P in the next bin B are stapled. Incidentally, when the manual staple key S406 is depressed after the sorting operation, the stapling operation is started.

Next, a flow of the control according to the illustrated embodiment will be explained with reference to FIGS. 27 to 32. First of all, the image forming operation effected by using the automatic original feeding apparatus and the image forming apparatus will be described with reference to FIGS. 27 and 31. The originals are set in a STEP 1, and the one side copy mode is selected by the mode key 606 of the operation panel and the 2 in 1 control mode is selected by the 2 in 1 mode key 630 in a STEP 2. Then, the copy start key 605 is depressed in a STEP 3 to start the copy process.

In a STEP 5, as a result of the selection of the laterally written/vertically written original selection means, the normal sequence original supply command for supplying the originals on the original tray of the RDF 300 in order one by one from the lowermost one is sent to the RDF 300 (STEP 6), and then a 2 in 1 original left-right mount command is sent to the RDF 300 (STEP 8) to mount on the original on a position A (referred to as "left mount position" hereinafter) and a position B (referred to as "right mount position" hereinafter). Then, the program waits until the original supply is finished (STEP 9). Thereafter, if the original left-right mount response from the RDF 300 is affirmative in a STEP 9', the copy process 1 (described later) is effected (STEP 10).

After the copy process 1 is finished, it is judged whether the original is the last original or not (STEP 11); if negative, the program goes to a STEP 13, where the reverse discharge sequence command for discharging two originals rested on the platen glass while changing the discharge sequence thereof, and the normal supply sequence command for supplying the next originals are emitted (STEP 12). Then, after the discharge and supply processes are finished (STEP 13), the program returns to the STEP 10, thereby repeating the process.

In the STEP 11, if the affirmative is given, the program goes to a STEP 14, where the reverse discharge sequence command for discharging the originals while changing the discharge order thereof is emitted. After the discharge process is finished (STEP 15), the copy process is completed.

In the STEP 9, if the negative is given, the program goes to the STEP 10', where the copy process 2 (described later) is carried out.

After the copy process 2 is finished, it is judged whether the original is the last original or not (STEP 11'); if negative, the program goes to a STEP 12', where the normal discharge sequence command for discharging the original rested on the platen glass, and the normal supply sequence command for supplying the next original are emitted. Then, after the discharge and supply processes are finished (STEP 13), the program returns to the STEP 10, thereby repeating the process.

In the STEP 11', if the affirmative is given, the program goes to a STEP 14', where the normal discharge sequence command for discharging the originals in order is emitted. After the discharge process is finished (STEP 15'), the copy process is completed.

Figure 29:
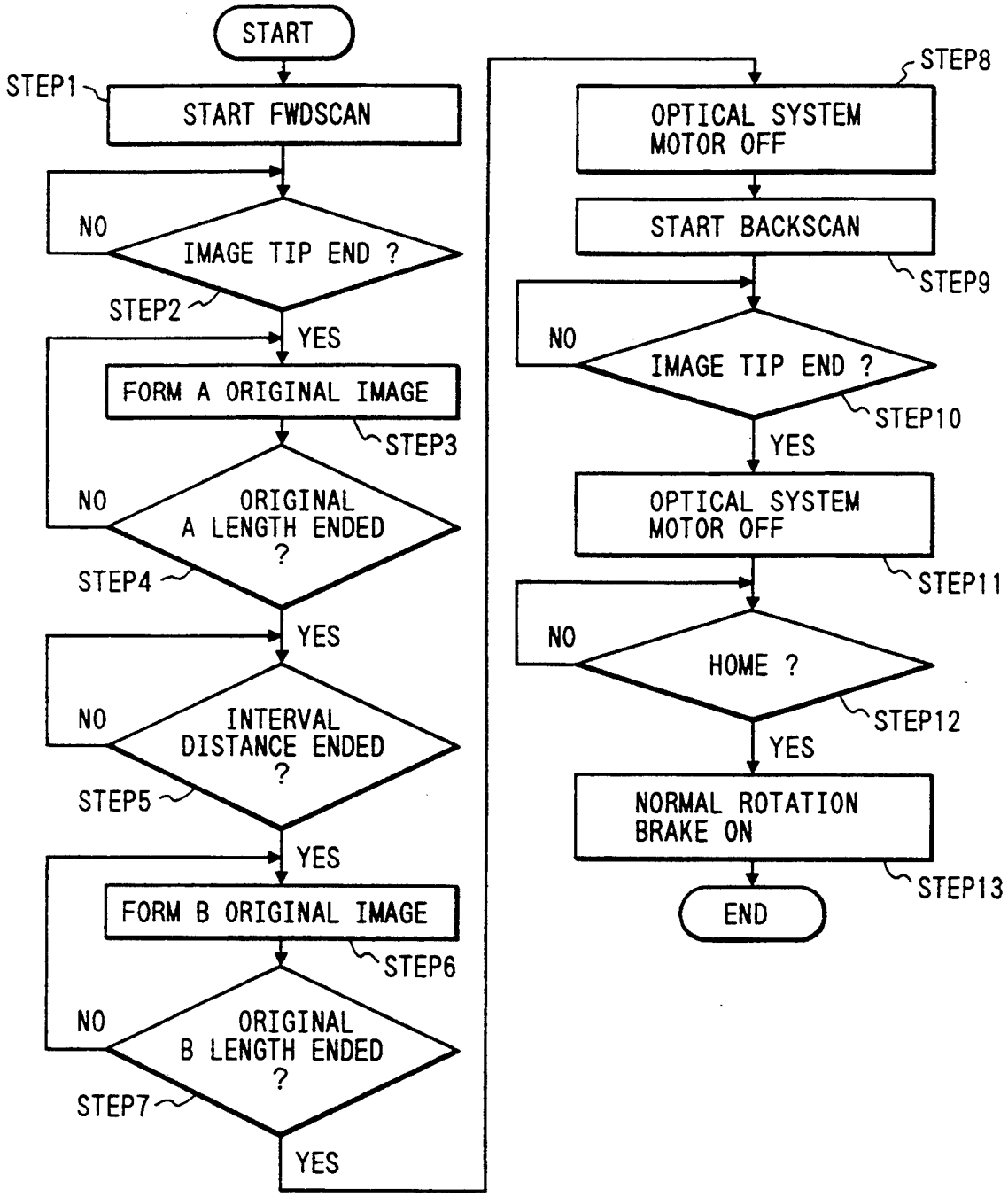
FIGS. 29 to 32 are flow charts showing the control of the apparatus of FIG. 19.

(Copy Process 1):

The copy process 1 is the known image forming process, which will be explained with reference to a flow chart shown in FIG. 29.

The optical system starts the forward scan in a STEP 1. When the image tip end is detected by the image tip end sensor (STEP 2), the exposure and formation of the original A are effected by an amount corresponding to the length of the original A (STEPs 3, 4). After the scan corresponding to the predetermined sheet interval distance is ended (STEP 5), the exposure and formation of the original B are effected by an amount corresponding to the length of the original B in the same manner as the original A (STEPs 6, 7).

Thereafter, the motor of the optical system is turned OFF (STEP 8), and the back scan is started (STEP 9), whereby the predetermined back scan control is effected to return the optical system to a predetermined home position (STEPs 10, 11, 12, 13). In this way, the copy process 1 is completed.

Figure 31:
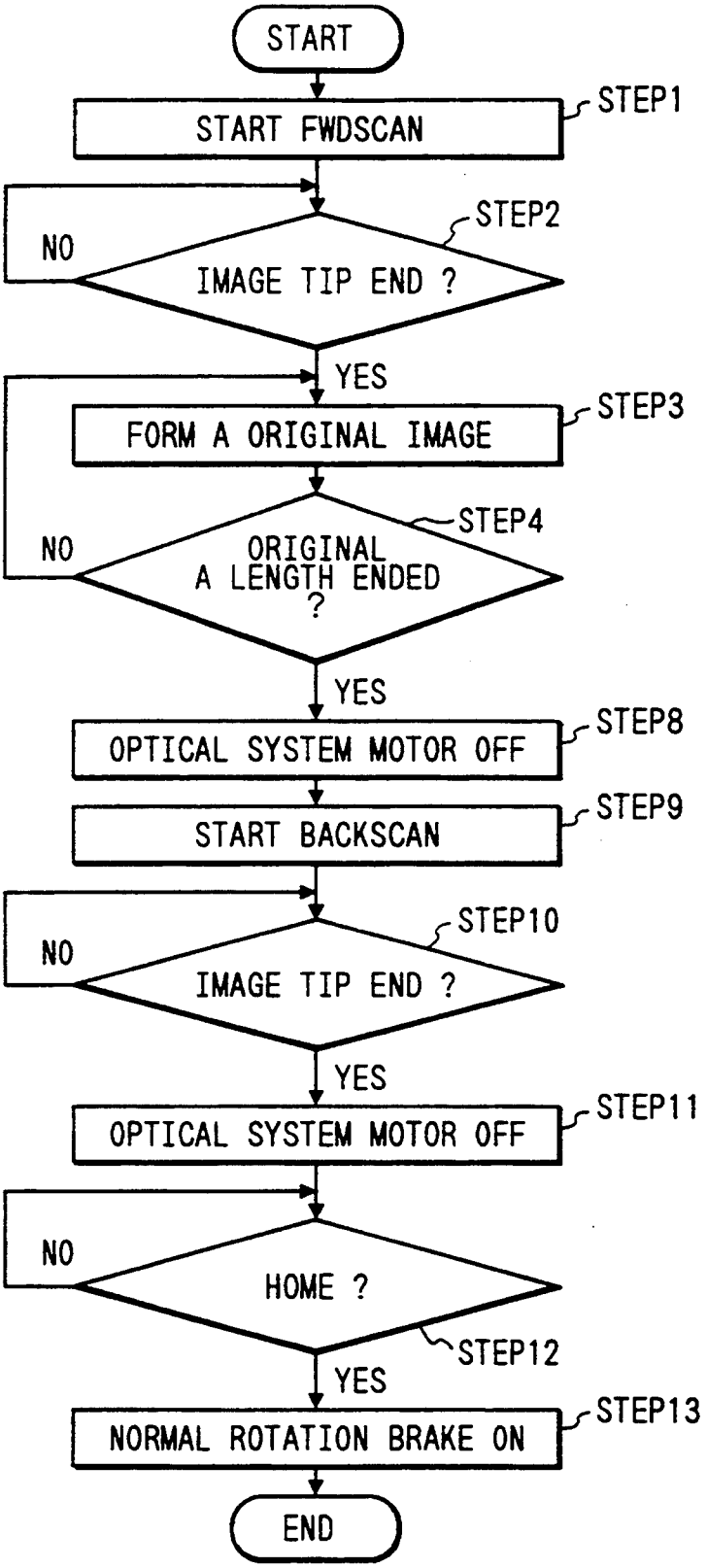

(Copy Process 2):

The copy process 2 is the known image forming process, which will be explained with reference to a flow chart shown in FIG. 31.

The optical system starts the forward scan in a STEP 1. When the image tip end is detected by the image tip end sensor (STEP 2), the exposure and formation of the original A are effected by an amount corresponding to the length of the original A (STEPs 3, 4). Thereafter, the motor of the optical system is turned OFF (STEP 8), and the back scan is started (STEP 9), whereby the predetermined back scan control is effected to return the optical system to the predetermined home position (STEPs 10, 11, 12, 13). In this way, the copy process 2 is completed.

Figure 30:
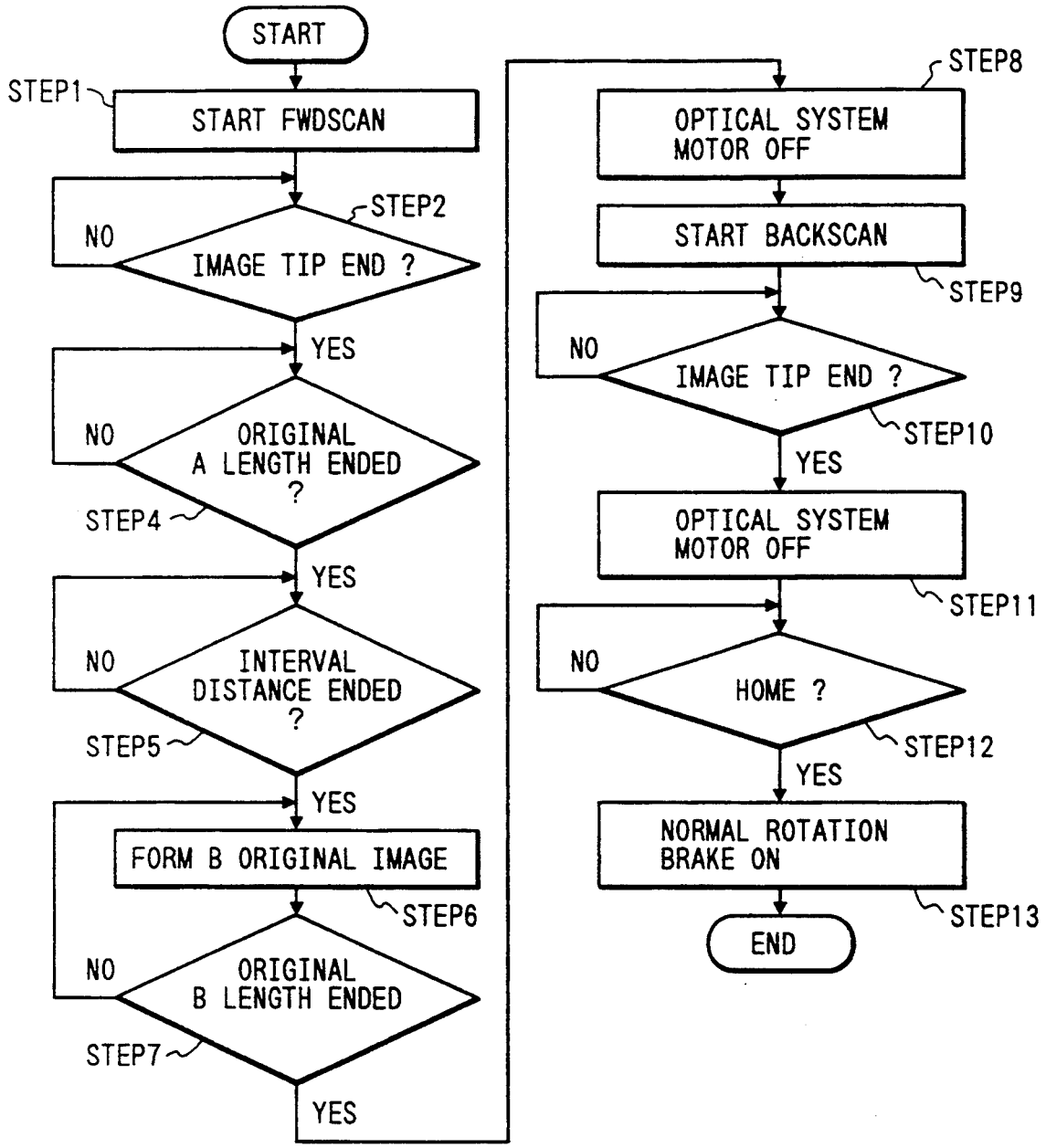

(Copy Process 3):

A copy process 3 is the known image forming process, which will be explained with reference to a flow chart shown in FIG. 30.

The optical system starts the forward scan in a STEP 1. When the image tip end is detected by the image tip end sensor (STEP 2), the idle scan is effected by an amount corresponding to the length of the original A (STEP 4). After the scan corresponding to the predetermined sheet interval distance is ended (STEP 5), the exposure and formation of the original B are effected by an amount corresponding to the length of the original B (STEPs 6, 7) . Thereafter, the motor of the optical system is turned OFF (STEP 8), and the back scan is started (STEP 9), whereby the predetermined back scan control is effected to return the optical system to a predetermined home position (STEPs 10, 11, 12, 13). In this way, the copy process 3 is completed.

Next, the process regarding the mode setting will be explained with reference to FIG. 32.

Figure 32:
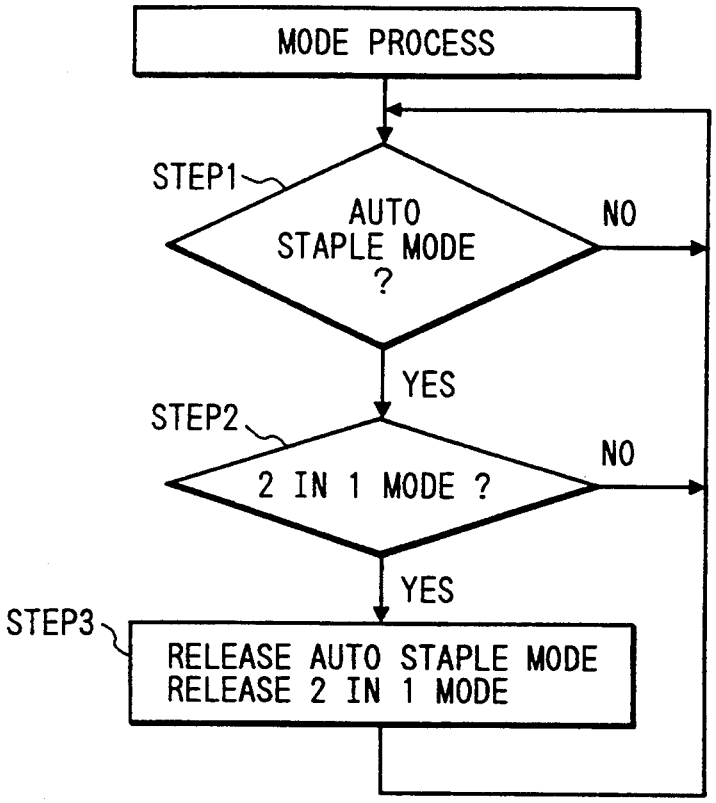

In the mode process shown in FIG. 32, the mode is checked.

First of all, in a STEP 1 and a STEP 2, it is checked whether the auto staple mode is selected, and whether the 2 in 1 control mode is selected, respectively. If both are affirmative, the both modes are released in a STEP 3. The simultaneous setting of the auto staple mode and the 2 in 1 control mode is inhibited, thereby preventing the malfunction that the stapling position differs from a desired position.

In FIG. 32, while the auto staple mode and the 2 in 1 control mode were released positively to prevent the simultaneous setting of both modes, when both modes are set simultaneously, only one of the modes may be released, which can achieve the same advantage.

The sheet post-processes shown in FIGS. 27, 29 and 33–35 can be effected.

Figures 27, 27A:
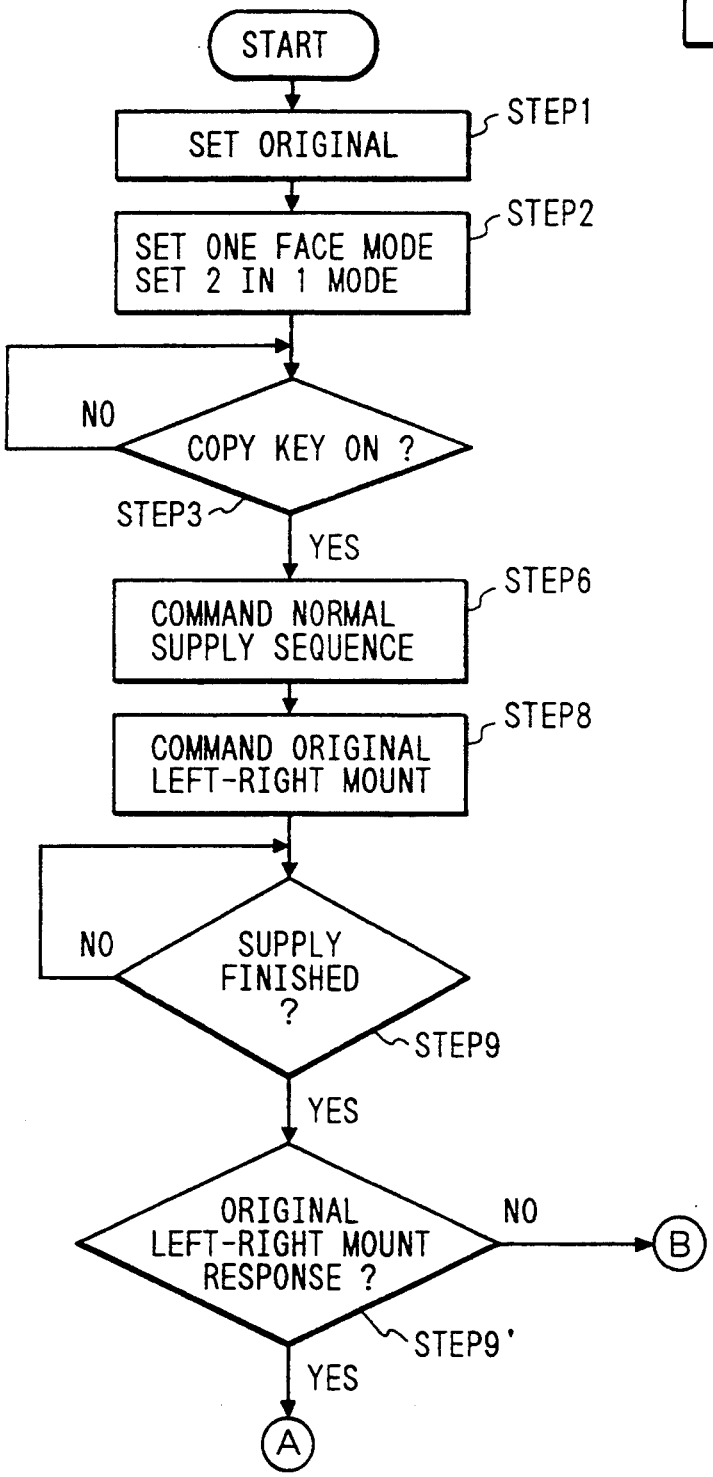
FIG. 27, comprised of FIGS. 27A and 27B, is a flow chart showing the control of the apparatus of FIG. 19.
Figure 27B:
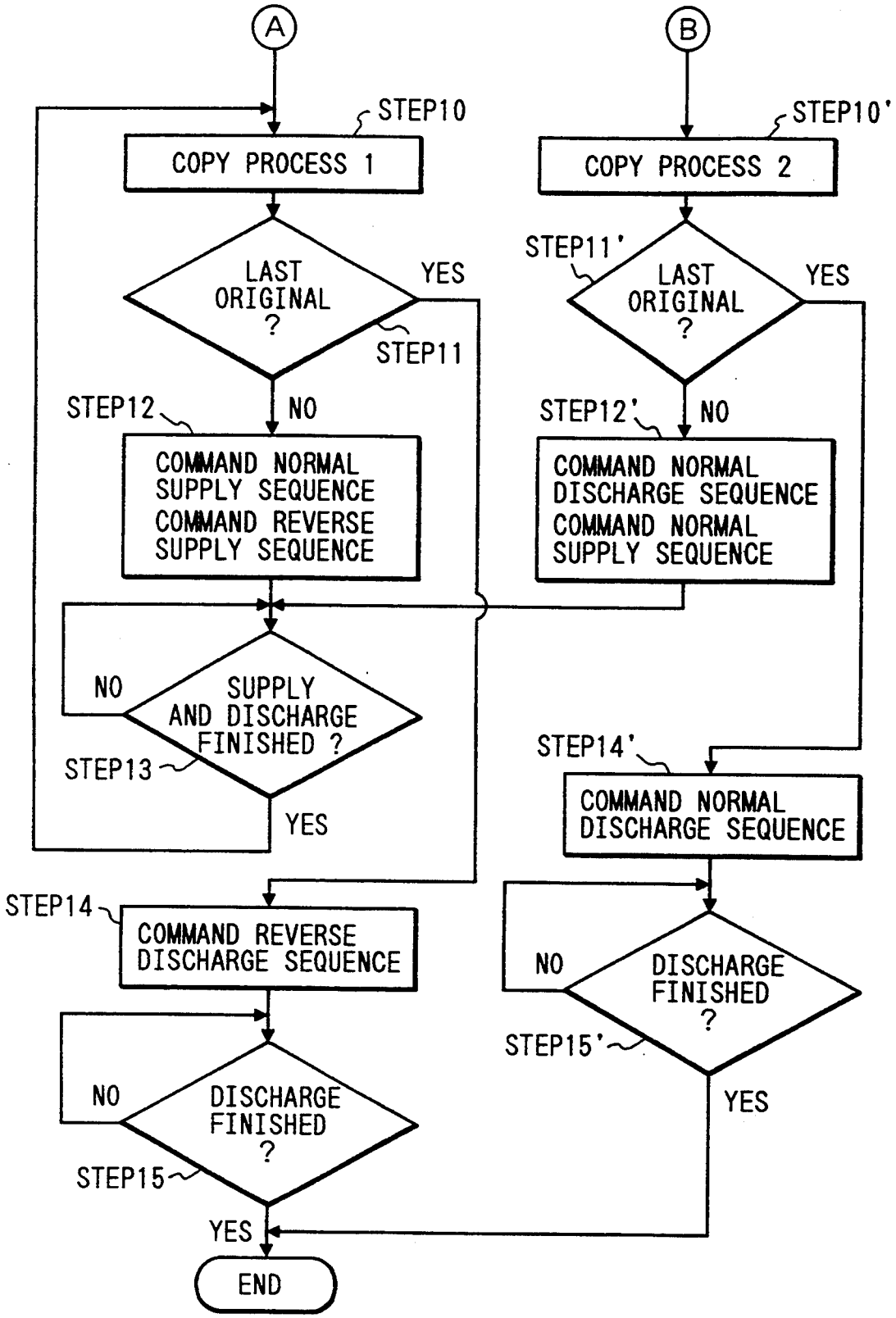

Regarding FIGS. 27 and 29, since the explanation was finished in connection with the first example, the explanation will be omitted, and a second example shown in FIGS. 33–35 will be explained.

Figure 35:
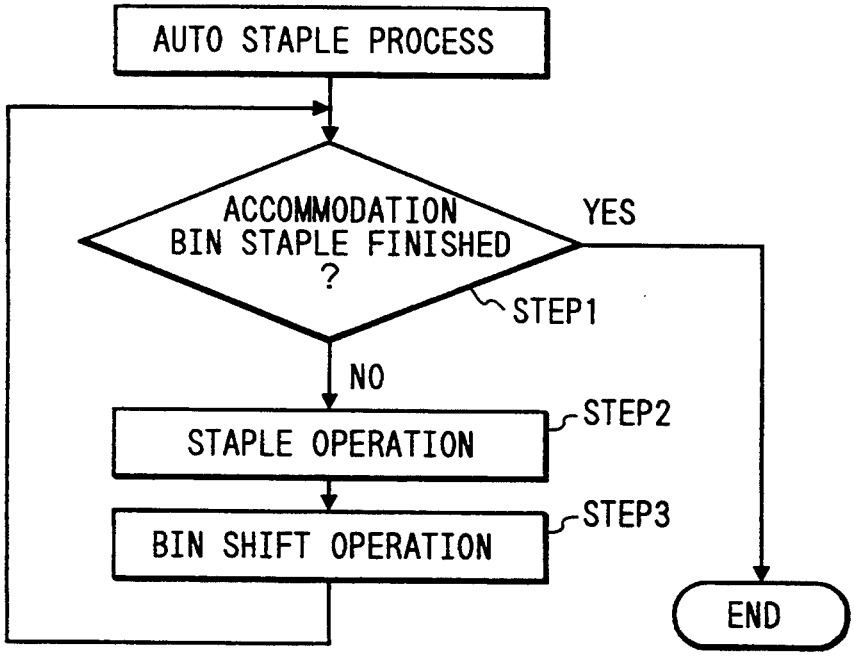
FIGS. 33 to 35 are flow charts showing the control of the apparatus of FIG. 19, according to a second example.
Figure 33:
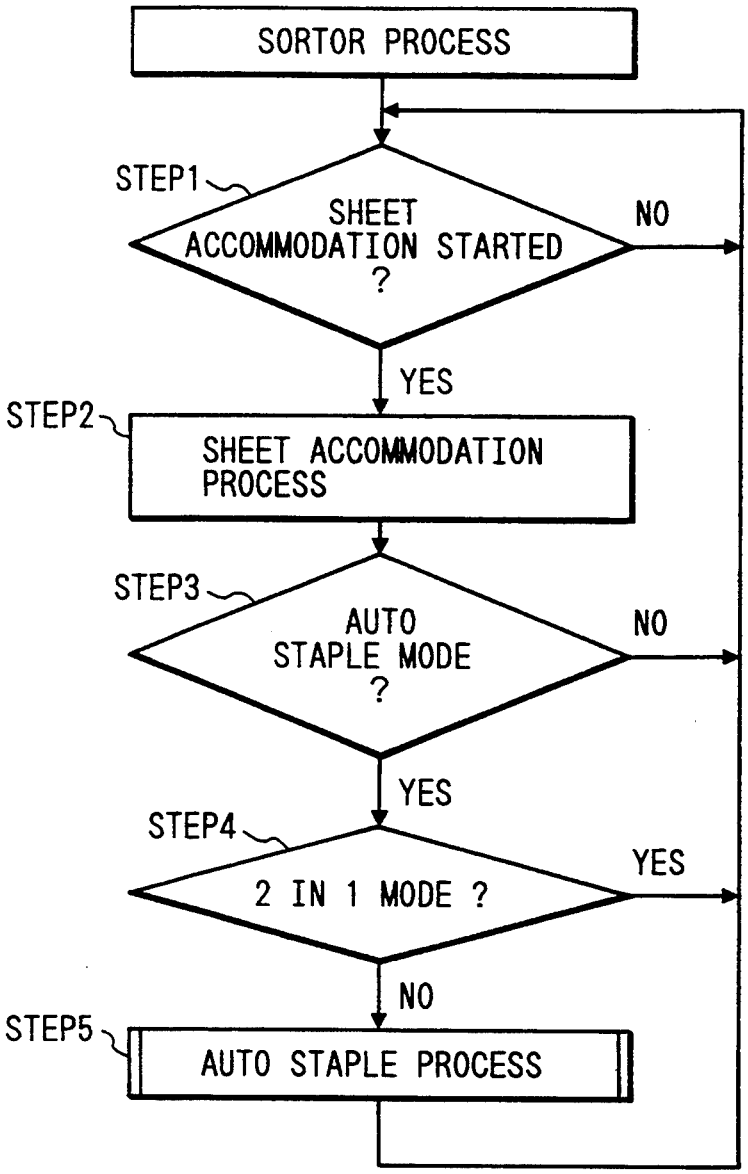
Figure 34:
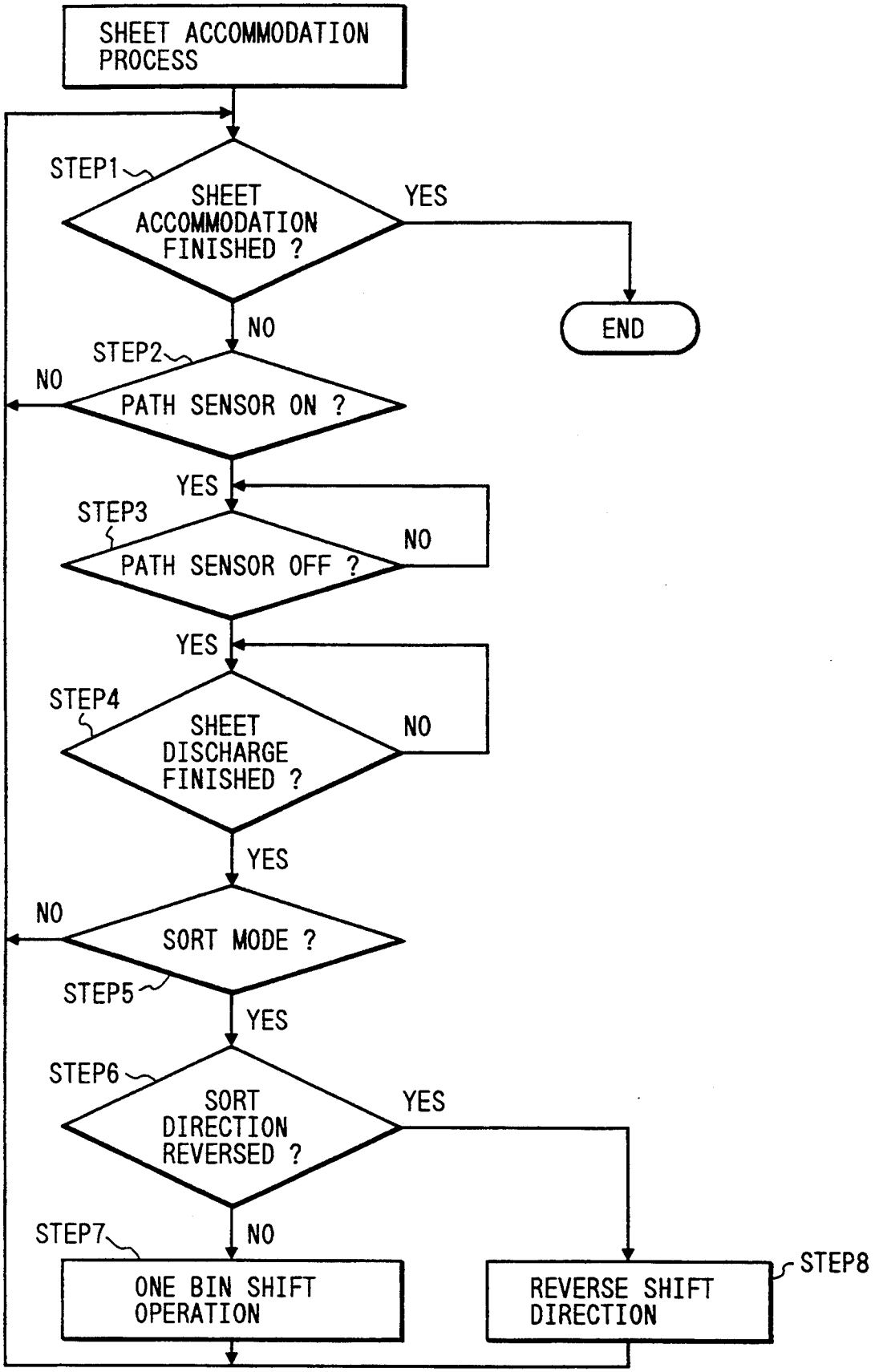

FIGS. 33–35 show the operation of the sheet post-process device.

The image formed sheet processed in the abovementioned manner is discharged from the image forming apparatus and is received in the sheet post-process device, where the sheets are sorted and stapled.

FIG. 33 shows a flow of the sorter process. First of all, in a STEP 1, after the sheet accommodation operation is finished, a sheet accommodation process (described later) is started in a STEP 2. After the sheet accommodation process is finished, the program goes to a STEP 3, where it is judged whether the auto staple mode is selected; if affirmative, the program goes to a STEP 4, whereas, if negative, the program returns to the STEP 1. In the STEP 4, it is judged whether the 2 in 1 control mode is selected; if negative, the auto staple process (described later) is effected in a STEP 5, whereas, if affirmative, the program returns to the STEP 1.

FIG. 34 shows the sheet accommodation process.

In a STEP 1, the completion of the sheet accommodation operation is monitored. When the sheet accommodation operation is finished, the sheet accommodation process is finished. In the STEP 1, if the sheet accommodation operation is not finished, in a STEP 2, STEP 3 and STEP 4, it is judged whether the sheet detection path sensor is turned ON, whether the sheet path sensor is turned OFF, and whether the sheet discharge to the bins is finished, respectively. In the STEP 4, when the sheet discharge is finished, it is judged whether the sort mode is selected in a STEP 5; if negative, the program returns to the STEP 1. In the STEP 5, if the sort mode is selected, it is judged whether the reverse operation for sort direction is required (STEP 6). If required, the shift operation is reversed; whereas, if not required, one bin shift operation is effected (STEPs 7, 8).

FIG. 35 shows the auto staple process.

In a STEP 1, it is judged whether the staple operation is finished regarding all of the bins in which the sheets are accommodated; if finished, the auto staple process is finished. In the STEP 1, if not finished, the staple operation is effected regarding the sheets accommodated in the bins, and the bin shift operation for switching the bins is effected (STEPs 2, 3).

The discharged images in the 2 in 1 control mode are grouped into four as shown in FIGS. 36A and 36B, and FIGS. 37C and 37D, in accordance with the kind of the originals (vertically written, laterally written) set on the stacking tray of the original feeding apparatus, and the set positions of the originals on the platen glass of the image forming apparatus. In this case, a condition which does not cause the inconvenience when the staple operation is effected at the predetermined staple position is only one case shown in FIG. 36A. The other cases will cause the inconvenience regarding the stapling. Thus, when the staple operation is effected in the 2 in 1 control mode, it is greatly feared that the staples are driven into positions which are not desired by the operator. Further, in this case, although two originals are set on the platen glass, if three or more originals are simultaneously set on the platen glass and the images of the originals are formed on the transfer sheet, it will be further difficult to expect the sheet condition after the image formation.

As mentioned above, in the auto staple mode wherein the sheets are automatically stapled after the sheets are accommodated, when the mode (such as the 2 in 1 control mode) wherein the images of the plural originals are simultaneously formed is set, the automatic staple operation is inhibited, thereby preventing the malfunction that the staple position differs from the desired position.

Further, in this case, if the staple operation is effected, it is judged whether the staples are to be driven into positions near the image on the sheet or not, and, if so, the staple operation may be effected independently by a staple start key and the like.

In the above second example, even when the staple operation is permitted in FIGS. 33–35, while the staple operation was positively inhibited, in a case where it can be judged whether the staple operation is permitted or not, depending upon any mode, the staple mode may be effected even when the 2 in 1 control mode and the auto staple mode are simultaneously selected.

An embodiment regarding this will be described hereinbelow.

By using the vertically written original selection key 632 of the operation panel of the image forming apparatus shown in FIG. 20, it is possible to judge whether the staple operation permitting mode is selected or not. If permitted, the control for effecting the auto staple operation can be carried out.

FIGS. 38A and 38B–40 show flow charts regarding the above.

Figures 38, 38A:
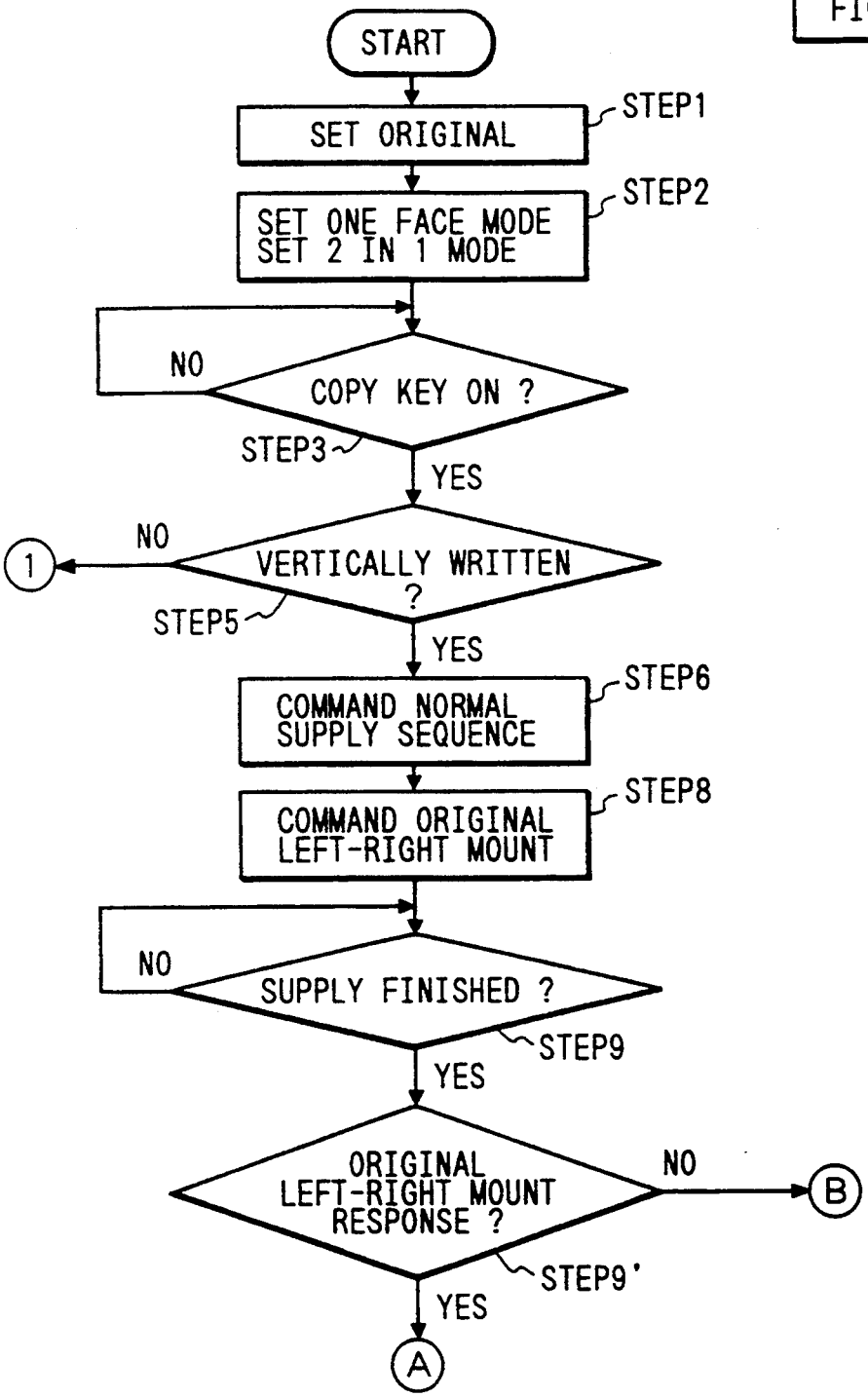
FIGS. 38, comprised of FIGS. 38A and 38B, to 40 are flow charts showing the control of the apparatus of FIG. 19, according to a third example.
Figure 38B:
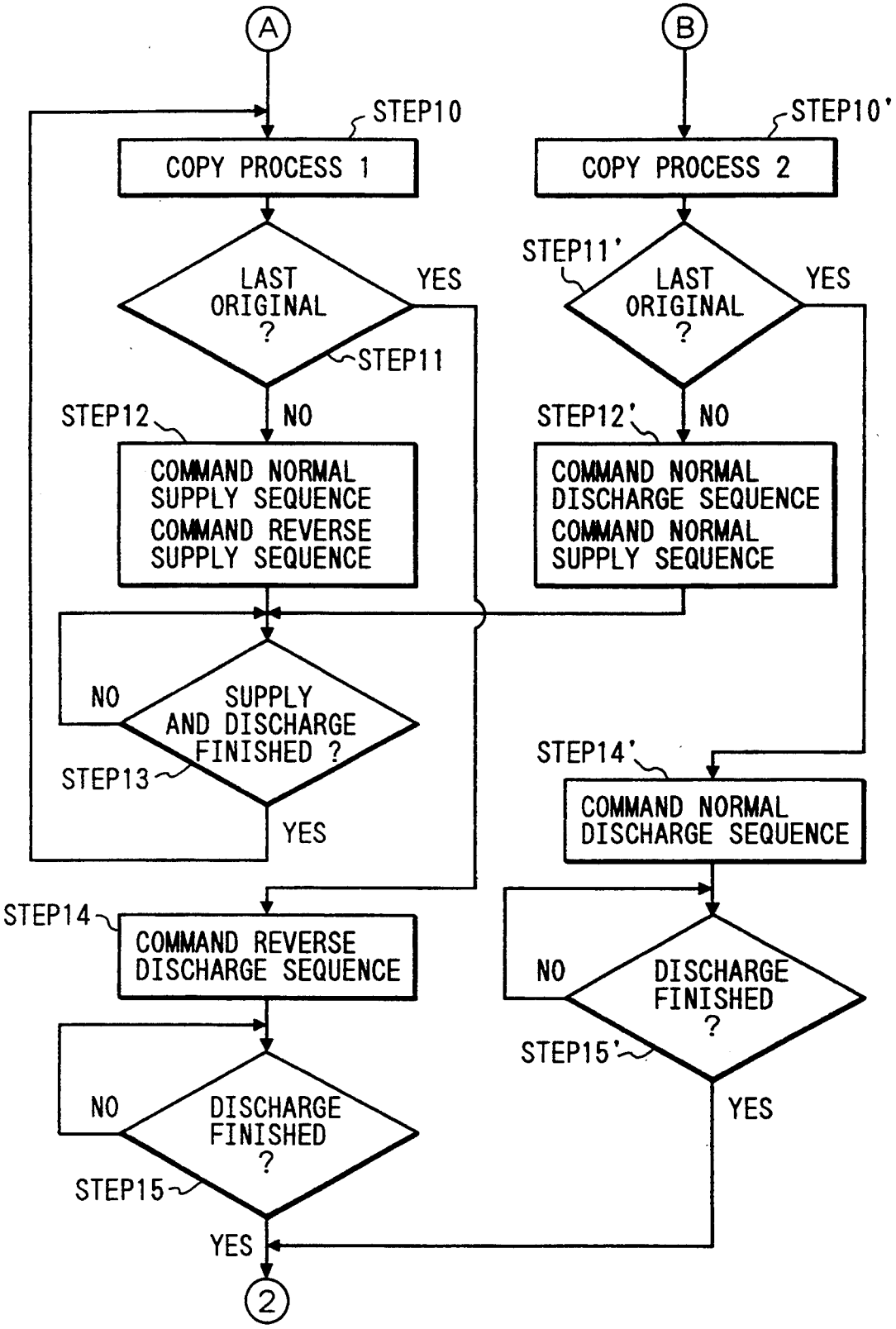
Figure 39:
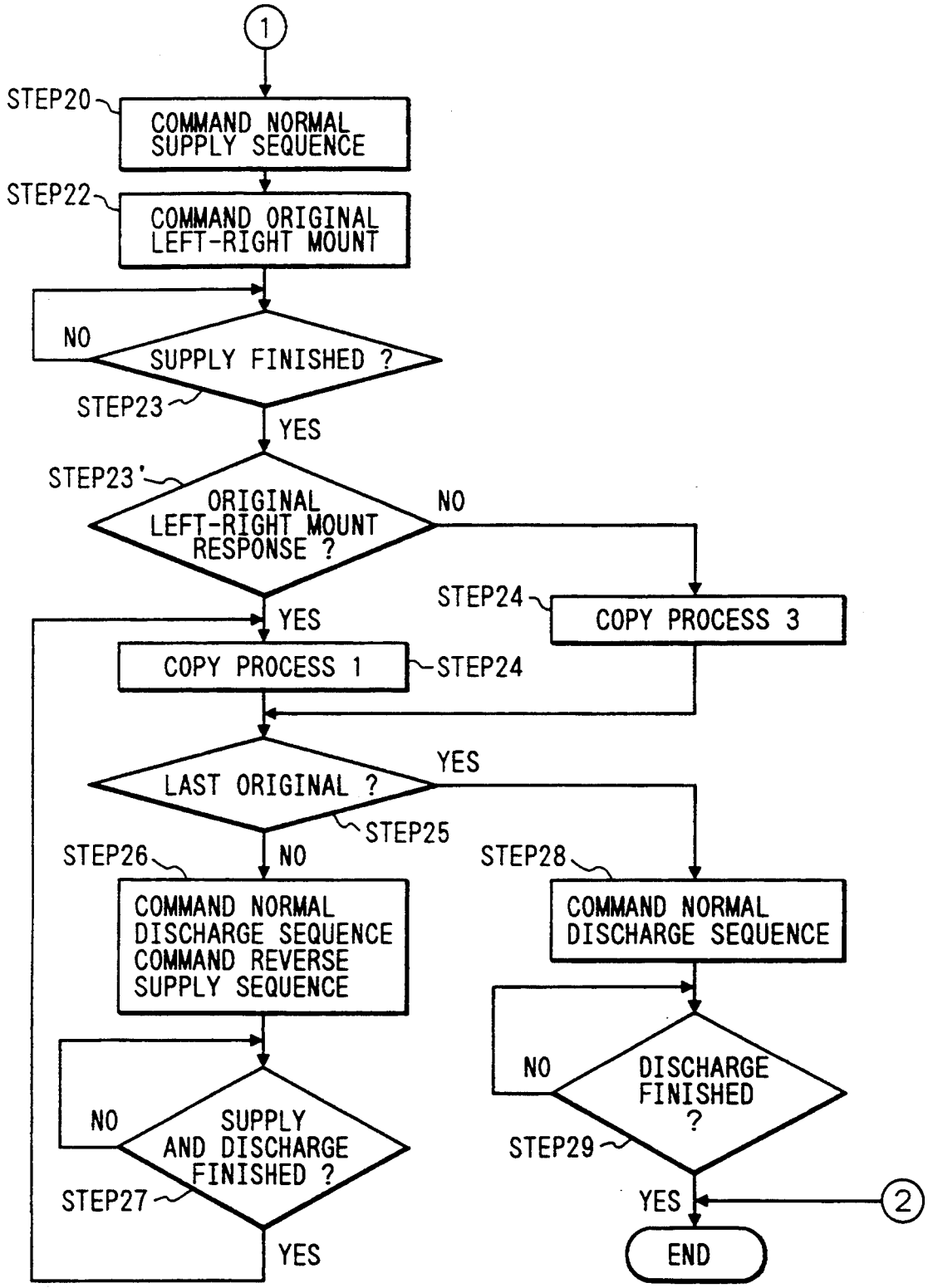

First of all, the image forming operation by using the automatic original feeding apparatus and the image forming apparatus will be explained with reference to FIGS. 38A and 38B. Incidentally, the copy processes 1, 2 and 3 are the same as those shown in the first example.

First of all, the originals are set in a STEP 1, and the one side copy mode is selected by the mode key 606 of the operation panel and the 2 in 1 control mode is selected by the 2 in 1 mode key 630 in a STEP 2. Then, the copy start key 605 is depressed in a STEP 3 to start the copy process.

Figure 28:
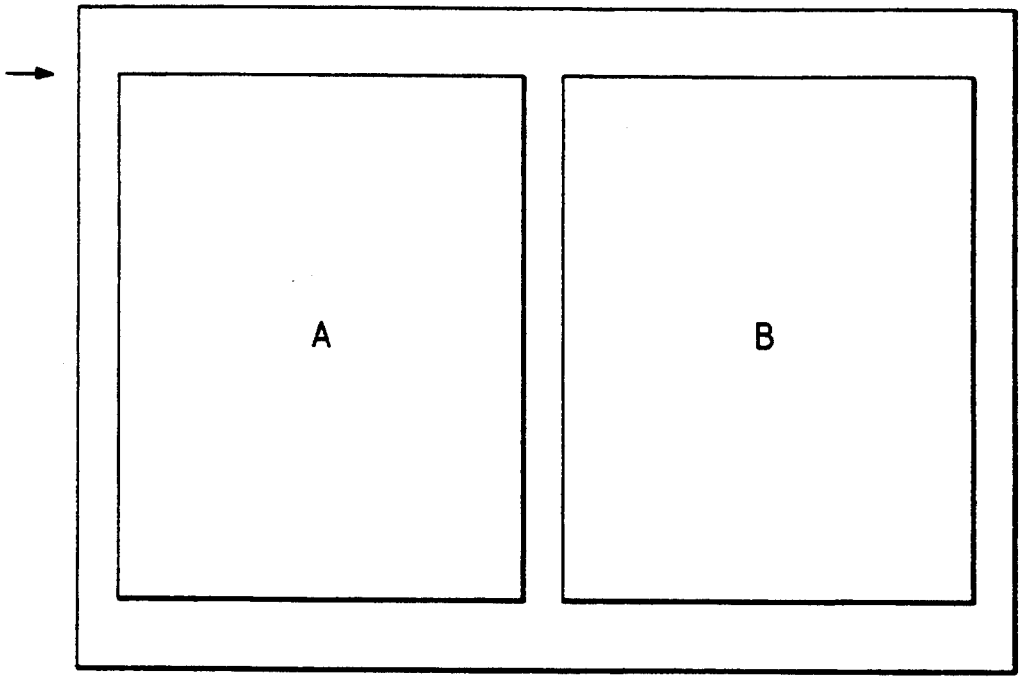
FIG. 28 is a plan view showing a condition of the 2 in 1 original mount.

In a STEP 5, as a result of the selection of the laterally written/vertically written original selection means, when the vertically written original is selected, the normal sequence original supply command for supplying the originals on the original tray of the RDF 300 in order one by one from the lowermost one is sent to the RDF 300 (STEP 6), and then a 2 in 1 original left-right mount command is sent to the RDF 300 (STEP 8) to mount the original on a position A (referred to as "left mount position" hereinafter) in FIG. 28 and a position B (referred to as "right mount position" hereinafter). Then, the program waits until the original supply is finished (STEP 9) . Thereafter, if the original left-right mount response from the RDF 300 is affirmative in a STEP 9', the copy process 1 (described later) is effected (STEP 10).

After the copy process 1 is finished, it is judged whether the original is the last original or not (STEP 11); if negative, the program goes to a STEP 12, where the reverse discharge sequence command for discharging two originals rested on the platen glass while changing the discharge sequence thereof, and the normal supply sequence command for supplying the next originals are emitted (STEP 12). Then, after the discharge and supply processes are finished (STEP 13), the program returns to the STEP 10, thereby repeating the process.

In the STEP 11, if the affirmative is given, the program goes to a STEP 14, where the reverse discharge sequence command for discharging the originals while changing the discharge order thereof is emitted. After the discharge process is finished (STEP 15), the copy process is completed.

In the STEP 9, if the negative is given, the program goes to the STEP 10', where the copy process 2 (described later) is carried out.

After the copy process 2 is finished, it is judged whether the original is the last original or not (STEP 11'); if negative, the program goes to a STEP 12', where the normal discharge sequence command for discharging the original rested on the platen glass, and the normal supply sequence command for supplying the next original are emitted. Then, after the discharge and supply processes are finished (STEP 13), the program returns to the STEP 10, thereby repeating the process.

In the STEP 11', if the affirmative is given, the program goes to a STEP 14', where the normal discharge sequence command for discharging the originals in order is emitted. After the discharge process is finished (STEP 15'), the copy process is completed.

In the STEP 5, if the negative is given, the program goes to a STEP 20, where the reverse sequence supply command for supplying the originals on the original tray of the RDF 300 in order one by one from the lowermost one is sent to the RDF 300 (STEP 6), and then the 2 in 1 original left-right mount command is sent to the RDF 300 (STEP 22) to effect the left-right mount of the originals. Then, the program waits until the original supply is finished (STEP 23). Thereafter, if the original left-right mount response from the RDF 300 is affirmative in a STEP 23', the copy process 1 is effected (STEP 24).

After the copy process 1 is finished, it is judged whether the original is the last original or not (STEP 25); if negative, the program goes to a STEP 26, where the normal discharge sequence command for discharging two originals rested on the platen glass in order, and the reverse supply sequence command for supplying the originals while changing the supply sequence thereof are emitted. Then, after the discharge and supply processes are finished (STEP 27), the program returns to the STEP 24, thereby repeating the process.

In the STEP 23, if the negative is given, the program goes to the STEP 24, the copy process 3 is carried out (STEP 24'), and the program goes to the STEP 25.

In the STEP 25, if the affirmative is given, the program goes to a STEP 28, where the normal sequence discharge command for discharging the originals in order is emitted. After the discharge process is finished (STEP 29), the whole copy process is completed.

Next, the operation regarding the sheet post-device will be explained with reference to FIG. 40.

The image formed sheet processed in the abovementioned manner is discharged from the image forming apparatus and is accommodated in the sheet post-process device, where the sheets are sorted and stapled.

Figure 40:
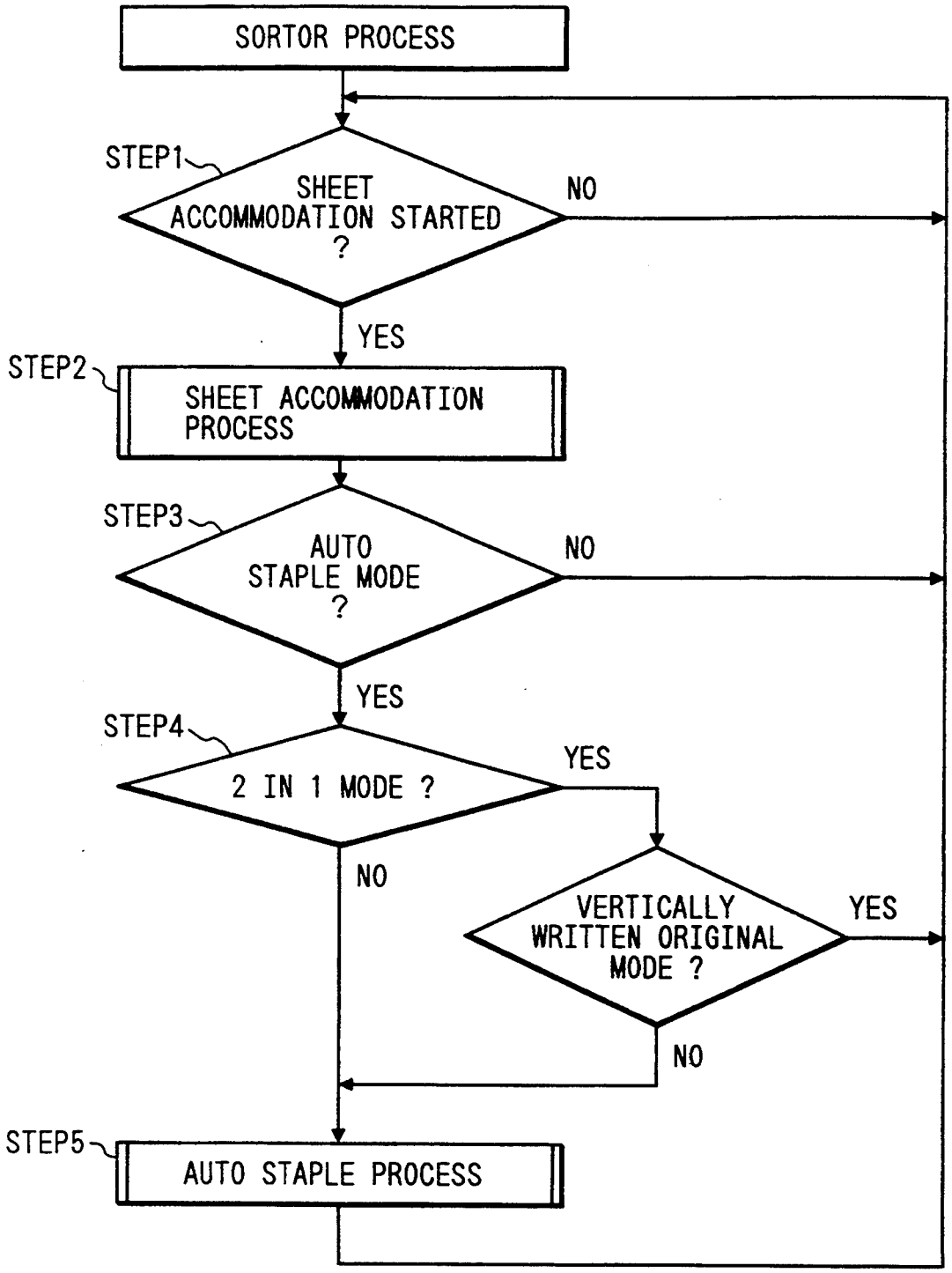
Figure 41:
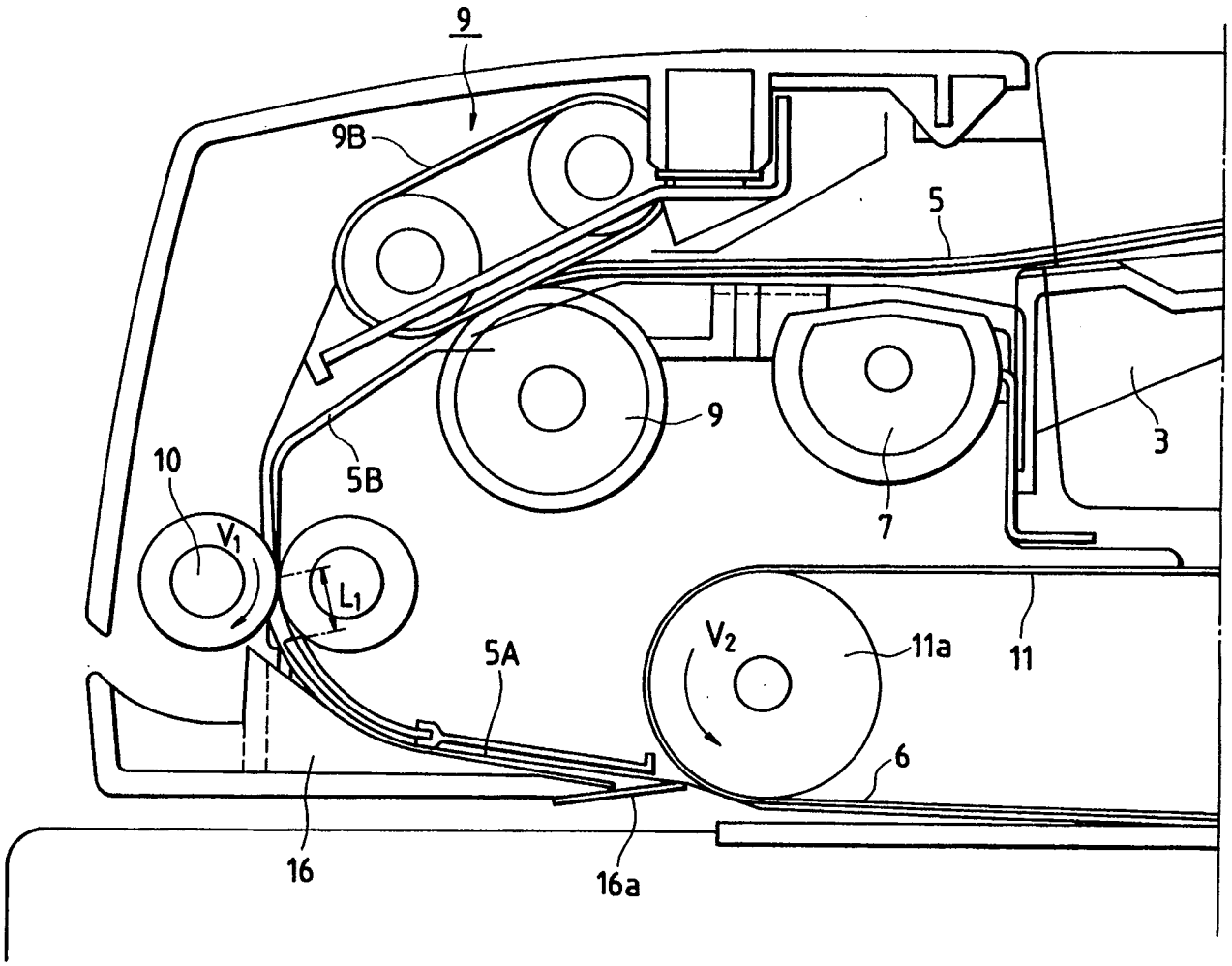
FIG. 41 is a detailed view for explaining the operation of the apparatus of FIGS. 2A to 2D (particularly FIG. 2B)

FIG. 40 shows a flow of the sorter process.

Figure 36A:
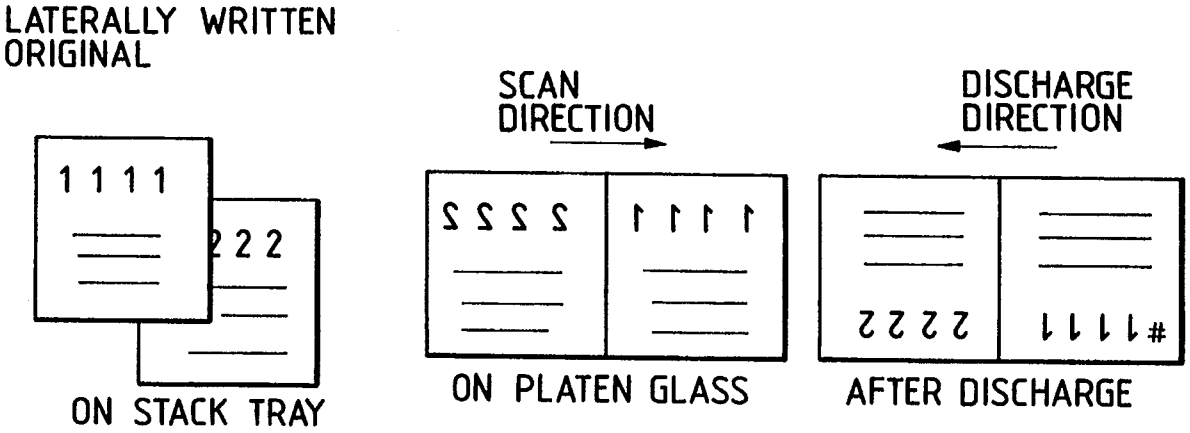
FIGS. 36A and 36B are schematic views showing a flow of originals in the laterally written original.
Figure 36B:
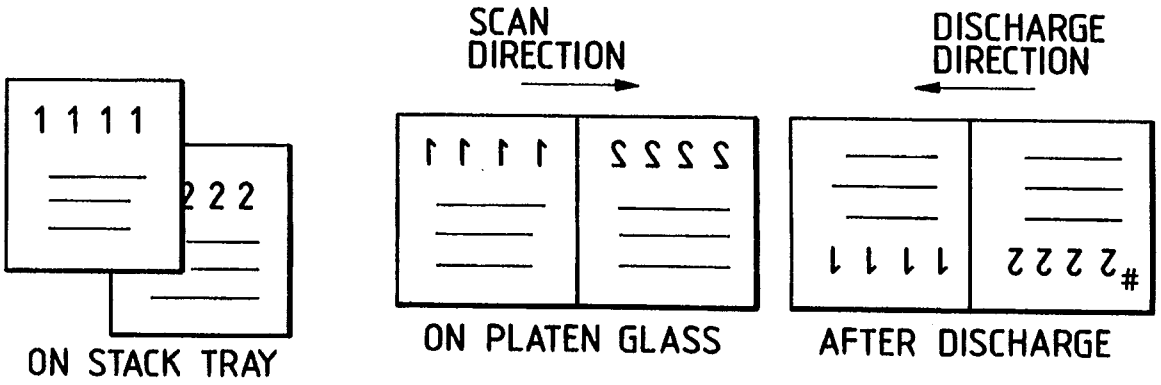
Figure 37C:
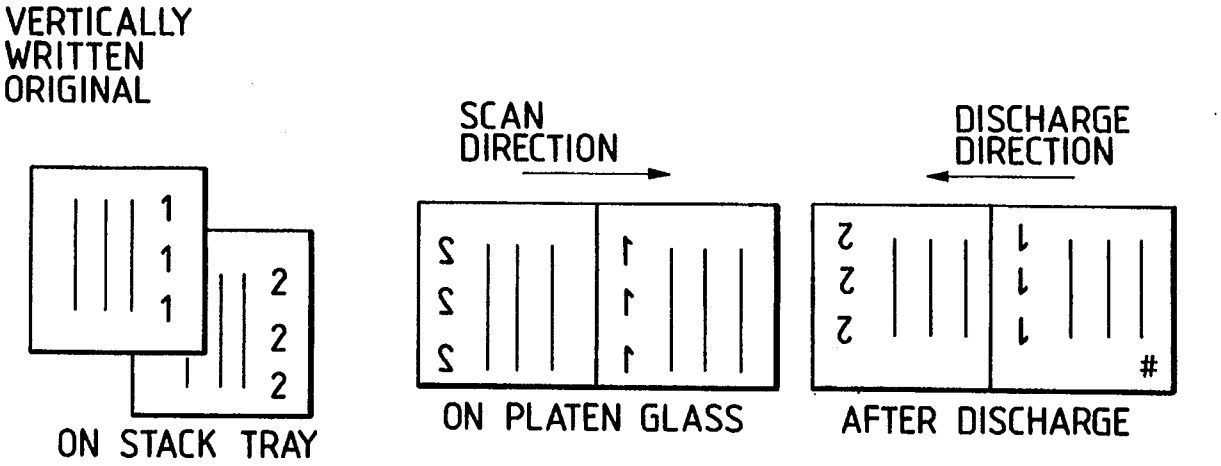
FIGS. 37C and 37D are schematic views showing a flow of originals in the vertically written original.
Figure 37D:
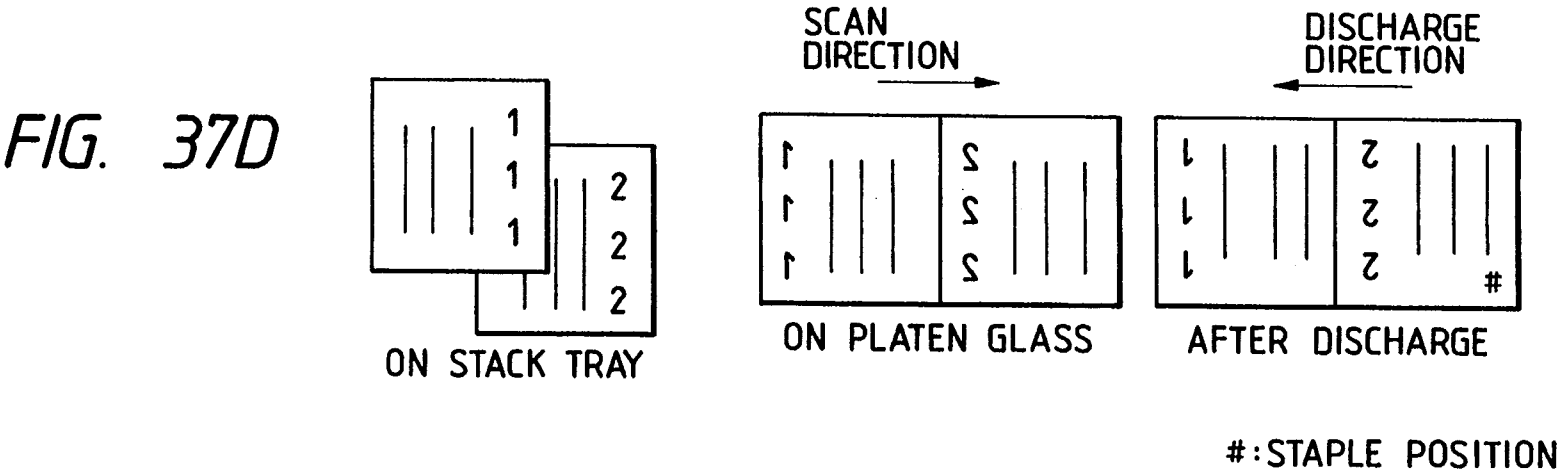

First of all, in a STEP 1, after the sheet accommodation operation is finished, a sheet accommodation process is started in a STEP 2. After the sheet accommodation process is finished, the program goes to a STEP 3, where it is judged whether the auto staple mode is selected; if affirmative, the program goes to a STEP 4, whereas, if negative, the program returns to the STEP 1. In the STEP 4, it is judged whether the 2 in 1 control mode is selected; if negative, the auto staple process is effected in a STEP 5, whereas, if affirmative, the program goes to a STEP 6, where the case is discriminated when the 2 in 1 control mode and the auto staple mode are both selected, so that one of the cases shown in FIGS. 36A, 36B and 37C, 37D is determined. In the illustrated embodiment, when the laterally written original mode is selected, the automatic original feeding apparatus controls so that the originals are set on the platen glass as shown in FIG. 36A, and, when the vertically written original mode is selected, the automatic original feeding apparatus controls so that the originals are set on the platen glass as shown in FIG. 37D. In the case shown in FIG. 36A, the staple operation is permitted, whereas, in the case shown in FIG. 37D, the inconvenience occurs. Thus, the writing direction of the original can be utilized to determine whether the staple operation is permitted or not. That is to say, in the STEP 6, if the vertically written original mode is selected, the program returns to the STEP 1, thereby inhibiting the staple operation. To the contrary, in the STEP 6, the laterally written original mode is selected, the staple operation is permitted, thereby performing the auto staple process of the STEP 5. In this way, the process is completed.

Incidentally, the sheet accommodation process and the auto staple process are the same as those described in relation to the above embodiment.

In this way, it can be judged whether the staple operation is permitted or not, depending upon any mode, the advance that the auto staple operation can be effected even when the 2 in 1 control mode and the auto staple mode are simultaneously selected can be achieved.

What is claimed is:

1. An automatic original feeding apparatus, comprising:

first rotary supply means for supplying a sheet original;

second rotary supply means disposed at a downstream side of said first supply means to further supply the sheet original;

control means for rotating said second rotary supply means reversely to return the sheet original toward an upstream side by a small amount;

retract means for directing a trailing end of the returned sheet original out of a sheet path connecting between said first rotary supply means and said second rotary supply means;

controlling means for controlling said first rotary supply means to cause said first rotary supply means to feed a next sheet original until a leading end of the next sheet original is overlapped with the trailing end of the first sheet original;

information means for the kind of sheet originals; and means for changing a return amount of the sheet original effected by said control means, in accordance with the kind of the sheet original from said information means;

wherein when the first and second sheet originals are supplied simultaneously, the first sheet original is supplied faster than the second sheet original so that the overlap between the sheet originals is cancelled.

2. An automatic original feeding apparatus according to claim 1, wherein said second rotary supply means is a convey belt disposed on a platen glass on which the sheet originals are set.

3. An automatic original feeding apparatus according to claim 2, wherein said convey belt as said second rotary supply means can supply the sheet original faster than said first rotary supply means, and the overlap is cancelled before the leading end of the next sheet original reaches said convey belt.

4. An automatic original feeding apparatus according to claim 1, wherein the kind of the sheet originals is determined by the magnitude of the size of the original.

5. An automatic original feeding apparatus according to claim 1, wherein said second rotary supply means can supply the sheet original faster than said first rotary supply means, and the overlap is cancelled immediately before the trailing end of the next sheet original passes throughout said first rotary supply means.

6. An image forming apparatus, comprising:

first rotary supply means for supplying a sheet original;

second rotary supply means disposed at a downstream side of said first supply means and adapted to further supply the sheet original;

control means for rotating said second rotary supply means reversely to return the sheet original toward an upstream side by a small amount;

retract means for directing a trailing end of the returned sheet original out of a sheet path connecting between said first rotary supply means and said second rotary supply means;

controlling means for controlling said first rotary supply means to cause said first rotary supply means to feed a next sheet original until a leading end of the next sheet original is overlapped with the trailing end of the first sheet original;

information means for the kind of sheet originals; and means for changing a return amount of the sheet original effected by said control means, in accordance with the kind of the sheet original from said information means;

wherein when the first and second sheet originals are supplied simultaneously, the first sheet original is supplied faster than the second sheet original so that the overlap between the sheet originals is cancelled, and image on the two sheet originals set side by side at a reading position are read and are copied onto a single sheet.

7. An automatic original feeding apparatus, comprising:

first rotary supply means for supplying a sheet original;

second rotary supply means disposed at a downstream side of said first supply means for further supplying the sheet original;

control means for rotating said second rotary supply means reversely to return the sheet original toward an upstream side by a small amount;

retract means for directing a trailing end of the returned sheet original out of a sheet path connecting between said first rotary supply means and said second rotary supply means; and controlling means for controlling said first rotary supply means to cause said first rotary supply means to feed a next sheet original so that a leading end of the next sheet original overlaps with the trailing end of the first sheet original, wherein when the first and second sheet originals are supplied simultaneously, the first sheet original is supplied faster than the second sheet original so that the overlap between the sheet originals is cancelled.

8. An automatic original feeding apparatus according to claim 7, wherein said second rotary supply means can supply the sheet original faster than said first rotary supply means, and the overlap is cancelled immediately before the trailing end of the next sheet original passes throughout said first rotary supply means.

9. An image forming apparatus, comprising:

image reading means for reading an image from a sheet original;

image forming means for a read image;

first rotary supply means for supplying a forming sheet original toward said image reading means;

second rotary supply means disposed at a downstream side of said first supply means for further supplying the sheet original toward said image reading means;

control means for rotating said second rotary supply means reversely to return the sheet original toward an upstream side by a small amount;

retract means for directing a trailing end of the returned sheet original out of a sheet path connecting between said first rotary supply means and said second rotary supply means; and controlling means for controlling said first rotary supply means to cause said first rotary supply means to feed a next sheet original so that a leading end of the next sheet original overlaps with the trailing end of the first sheet original, wherein when the first and second sheet originals are supplied simultaneously, the first sheet original is supplied faster than the second sheet original so that the overlap between the sheet originals is cancelled, and wherein images on the two sheet originals set side by side at a reading position of said image reading means are read and are formed onto a single sheet.

10. An automatic original feeding apparatus, comprising:

first rotary supply means for supplying a sheet original;

second rotary supply means disposed at a downstream side of said first supply means to further supply the sheet original;

control means for rotating said second rotary supply means reversely to return the sheet original toward an upstream side by a small amount;

retract means for directing a trailing end of the returned sheet original;

controlling means for controlling said first rotary supply means to cause said first rotary supply means to feed a next sheet original until a leading end of the next sheet original is overlapped with the trailing end of the first sheet original;

information means for the kind of sheet originals; and means for changing a return amount of the sheet original effected by said control means, in accordance with the kind of the sheet original from said information means;

wherein when the first and second sheet originals are supplied simultaneously, the first sheet original is supplied faster than the second sheet original so that the overlap between the sheet originals is cancelled.

11. An image forming apparatus, comprising:

first rotary supply means for supplying a sheet original;

second rotary supply means disposed at a downstream side of said first supply means and adapted to further supply the sheet original;

control means for rotating said second rotary supply means reversely to return the sheet original toward an upstream side by a small amount;

retract means for directing a trailing end of the returned sheet original;

controlling means for controlling said first rotary supply means to cause said first rotary supply means to feed a next sheet original until a leading end of the next sheet original is overlapped with the trailing end of the first sheet original;

information means for the kind of sheet originals; and means for changing a return amount of the sheet original effected by said controlling means, in accordance with the kind of the sheet original from said information means;

wherein when the first and second sheet originals are supplied simultaneously, the first sheet original is supplied faster than the second sheet original so that the overlap between the sheet originals is cancelled, and image on the two sheet originals set side by side at a reading position are read and are copied onto a single sheet.

12. An automatic original feeding apparatus, comprising:

first rotary supply means for supplying a sheet original;

second rotary supply means disposed at a downstream side of said first supply means for further supplying the sheet original;

control means for rotating said second rotary supply means reversely to return the sheet original toward an upstream side by a small amount;

retract means for directing a trailing end of the returned sheet original; and controlling means for controlling said first rotary supply means to cause said first rotary supply means to feed a next sheet original so that a leading end of the next sheet original overlaps with the trailing end of the first sheet original, wherein when the first and second sheet originals are supplied simultaneously, the first sheet original is supplied faster than the second sheet original so that the overlap between the sheet originals is cancelled.

13. An image forming apparatus, comprising:

image reading means for reading an image from a sheet original;

image forming means for a read image;

first rotary supply means for supplying a forming sheet original toward said image reading means;

second rotary supply means disposed at a downstream side of said first supply means for further supplying the sheet original toward said image reading means;

control means for rotating said second rotary supply means reversely to return the sheet original toward an upstream side by a small amount;

retract means for directing a trailing end of the returned sheet original; and controlling means for controlling said first rotary supply means to cause said first rotary supply means to feed a next sheet original so that a leading end of the next sheet original overlaps with the trailing end of the first sheet original, wherein when the first and second sheet originals are supplied simultaneously, the first sheet original is supplied faster than the second sheet original so that the overlap between the sheet originals is cancelled, and wherein images on the two sheet originals set side by side at a reading position of said image reading means are read and are formed onto a single sheet.

* * * * *

UNITED STATES PATENT AND TRADEMARK OFFICE

CERTIFICATE OF CORRECTION

PATENT NO. : 5,442,431

DATED : August 15, 1995

INVENTOR(S) : HITOSHI FUJIMOTO, ET AL.

It is certified that error appears in the above-indentified patent and that said Letters Patent is hereby corrected as shown below:

Figure 4,
"INERRUPTER" should read --INTERRUPTER--.

Figure 14,
"INERRUPTER" should read --INTERRUPTER--.

Figure 40,
"SORTOR" should read --SORTER--.

Column 1,
line 42, "Ser. No. 118,825)," should read --Ser. No. 591,759),--.

Column 5,
line 58, "increased more," should read --increased,--.

Column 6,
line 63, "(Step $2)" should read --(Step S2)--.

Column 10,
line 8, "apparatus] X" should read --apparatus] +--; and
line 17, "analogue" should read --analog--.

Column 13,
line 39, "zero to be," should read --to be zero,--.

UNITED STATES PATENT AND TRADEMARK OFFICE

CERTIFICATE OF CORRECTION

PATENT NO. : 5,442,431

DATED : August 15, 1995

INVENTOR(S) : HITOSHI FUJIMOTO, ET AL.

It is certified that error appears in the above-indentified patent and that said Letters Patent is hereby corrected as shown below:

Column 15,
line 14, "light 10 path" should read --light path--.

Column 19,
line 35, "is" should read --are--.

Signed and Sealed this

Nineteenth Day of March, 1996

Bruce Lehman

*Attest:*

BRUCE LEHMAN

*Attesting Officer*

*Commissioner of Patents and Trademarks*